US008764464B2

(12) United States Patent
Buck et al.

(10) Patent No.: US 8,764,464 B2
(45) Date of Patent: Jul. 1, 2014

(54) CROSS TALK REDUCTION FOR HIGH SPEED ELECTRICAL CONNECTORS

(75) Inventors: Jonathan E. Buck, Hershey, PA (US); Stefaan Hendrik Jozef Sercu, Brasschaat (BE); Jan De Geest, Wetteren (BE); Steven E. Minich, York, PA (US); Mark R. Gray, York, PA (US); Christopher J. Kolivoski, Lewisberry, PA (US); Douglas M. Johnescu, York, PA (US); Stuart C. Stoner, Lewisberry, PA (US); Alan Raistrick, Rockville, MD (US)

(73) Assignees: FCI Americas Technology LLC, Carson City, NV (US); FCI, Guyancourt (FR)

( * ) Notice: Subject to any disclaimer, the term of this patent is extended or adjusted under 35 U.S.C. 154(b) by 0 days.

(21) Appl. No.: 12/393,794

(22) Filed: Feb. 26, 2009

(65) Prior Publication Data

US 2009/0221165 A1 Sep. 3, 2009

Related U.S. Application Data

(60) Provisional application No. 61/032,613, filed on Feb. 29, 2008, provisional application No. 61/092,268, filed on Aug. 27, 2008.

(51) Int. Cl.

| | |
|---|---|
| ***H01R 4/66*** | (2006.01) |
| ***H01R 12/16*** | (2006.01) |
| ***H01R 13/6471*** | (2011.01) |
| ***H01R 13/514*** | (2006.01) |

(52) U.S. Cl.

CPC ..... *H01R 23/6873* (2013.01); *H01R 13/6471* (2013.01); *H01R 13/514* (2013.01)

USPC ..... 439/108; 439/189

(58) Field of Classification Search

USPC ..... 439/108, 941, 607.05, 189

See application file for complete search history.

(56) References Cited

U.S. PATENT DOCUMENTS

| | | | |
|---|---|---|---|
| 2,664,552 | A | 12/1953 | Ericsson et al. |
| 2,849,700 | A | 8/1958 | Perkin |
| 2,858,372 | A | 10/1958 | Kaufman |
| 3,115,379 | A | 12/1963 | McKee |

(Continued)

FOREIGN PATENT DOCUMENTS

| | | |
|---|---|---|
| EP | 0 273 683 | 7/1988 |
| EP | 0 554 821 | 8/1993 |

(Continued)

OTHER PUBLICATIONS

DesignCon, Interconnect Design Optimization and Characterization for Advanced High Speed Backplane Channel Links, Jan. 2009, 38 pages.

(Continued)

*Primary Examiner* — Neil Abrams
*Assistant Examiner* — Travis Chambers
(74) *Attorney, Agent, or Firm* — Baker & Hostetler LLP

(57) ABSTRACT

Example electrical connectors are provided including a plurality of electrical contacts configured to communicate between electrical devices. The plurality of electrical contacts includes a plurality of ground contacts. A ground coupling assembly is configured to electrically connect ground contacts of an electrical connector to adjust a performance characteristic of the electrical connector as desired.

38 Claims, 43 Drawing Sheets

(56) References Cited

U.S. PATENT DOCUMENTS 3,286,220 A 11/1966 Marley et al.
3,343,120 A 9/1967 Whiting
3,399,372 A 8/1968 Uberbacher
3,538,486 A 11/1970 Shlesinger, Jr.
3,587,028 A 6/1971 Uberbacher
3,591,834 A 7/1971 Kolias
3,601,775 A 8/1971 Longenecker et al.
3,641,475 A 2/1972 Irish et al.
3,663,925 A 5/1972 Proctor
3,669,054 A 6/1972 Desso et al.
3,701,076 A 10/1972 Irish
3,748,633 A 7/1973 Lundergan
3,827,005 A 7/1974 Friend
3,867,008 A 2/1975 Gartland, Jr.
4,030,792 A 6/1977 Fuerst
4,076,362 A 2/1978 Ichimura
4,157,612 A 6/1979 Rainal
4,159,861 A 7/1979 Anhalt
4,232,924 A 11/1980 Kline et al.
4,260,212 A 4/1981 Ritchie et al.
4,288,139 A 9/1981 Cobaugh et al.
4,383,724 A 5/1983 Verhoeven
4,402,563 A 9/1983 Sinclair
4,407,552 A 10/1983 Watanabe et al.
4,482,937 A 11/1984 Berg
4,487,464 A 12/1984 Kirschenbaum
4,523,296 A 6/1985 Healy, Jr.
4,560,222 A 12/1985 Dambach
4,571,014 A 2/1986 Robin et al.
4,664,456 A 5/1987 Blair et al.
4,664,458 A 5/1987 Worth
4,717,360 A 1/1988 Czaja
4,762,500 A 8/1988 Dola et al.
4,776,803 A 10/1988 Pretchel et al.
4,815,987 A 3/1989 Kawano et al.
4,846,727 A 7/1989 Glover et al.
4,850,887 A 7/1989 Sugawara
4,867,713 A 9/1989 Ozu et al.
4,898,539 A 2/1990 Glover et al.
4,900,271 A 2/1990 Colleran et al.
4,907,990 A 3/1990 Bertho et al.
4,913,664 A 4/1990 Dixon et al.
4,917,616 A 4/1990 Demler, Jr. et al.
4,932,888 A 6/1990 Senor
4,973,271 A 11/1990 Ishizuka et al.
4,975,066 A 12/1990 Sucheski et al.
4,975,069 A * 12/1990 Fedder et al. ..... 439/101
4,997,390 A 3/1991 Scholz et al.
5,004,426 A 4/1991 Barnett
5,046,960 A 9/1991 Fedder
5,055,054 A 10/1991 Doutrich
5,065,282 A 11/1991 Polonio
5,066,236 A 11/1991 Broeksteeg
5,077,893 A 1/1992 Mosquera et al.
5,094,623 A 3/1992 Scharf et al.
5,098,311 A 3/1992 Roath et al.
5,104,341 A 4/1992 Gilissen et al.
5,127,839 A 7/1992 Korsunsky et al.
5,141,455 A 8/1992 Ponn
5,161,987 A 11/1992 Sinisi
5,163,337 A 11/1992 Herron et al.
5,163,849 A 11/1992 Fogg et al.
5,167,528 A 12/1992 Nishiyama et al.
5,169,337 A 12/1992 Ortega et al.
5,174,770 A 12/1992 Sasaki et al.
5,181,855 A 1/1993 Mosquera et al.
5,197,893 A 3/1993 Morlion et al.
5,226,826 A 7/1993 Nillson et al.
5,228,864 A 7/1993 Fusselman et al.
5,231,274 A 7/1993 Reynier et al.
5,238,414 A 8/1993 Yaegashi et al.
5,254,012 A 10/1993 Wang
5,257,941 A 11/1993 Lwee et al.
5,274,918 A 1/1994 Reed
5,277,624 A 1/1994 Champion et al.
5,286,212 A 2/1994 Broeksteeg
5,288,949 A 2/1994 Crafts
5,302,135 A 4/1994 Lee
5,330,371 A 7/1994 Andrews
5,342,211 A 8/1994 Broeksteeg
5,356,300 A 10/1994 Costello et al.
5,356,301 A 10/1994 Champion et al.
5,357,050 A 10/1994 Baran et al.
5,382,168 A 1/1995 Azuma et al.
5,387,111 A 2/1995 DeSantis et al.
5,395,250 A 3/1995 Englert, Jr. et al.
5,399,104 A 3/1995 Middlehurst et al.
5,413,491 A * 5/1995 Noschese ..... 439/108
5,429,520 A 7/1995 Morlion et al.
5,431,578 A 7/1995 Wayne
5,474,472 A 12/1995 Niwa et al.
5,475,922 A 12/1995 Tamura et al.
5,518,422 A 5/1996 Zell et al.
5,522,727 A 6/1996 Saito et al.
5,558,542 A 9/1996 O'Sullivan et al.
5,564,949 A 10/1996 Wellinsky
5,575,688 A 11/1996 Crane, Jr.
5,586,908 A 12/1996 Lorrain
5,586,912 A 12/1996 Eslampour et al.
5,586,914 A 12/1996 Foster, Jr. et al.
5,590,463 A 1/1997 Feldman et al.
5,609,502 A 3/1997 Thumma
5,620,340 A 4/1997 Andrews
5,634,821 A 6/1997 Crane, Jr.
5,637,019 A 6/1997 Crane, Jr. et al.
5,664,968 A 9/1997 Mickievicz
5,668,408 A 9/1997 Nicholson
5,672,064 A 9/1997 Provencher et al.
5,697,799 A 12/1997 Consoli et al.
5,713,746 A 2/1998 Olson et al.
5,713,767 A 2/1998 Hanson et al.
5,730,609 A 3/1998 Harwath
5,741,144 A 4/1998 Elco et al.
5,741,161 A 4/1998 Cahaly et al.
5,766,023 A 6/1998 Noschese et al.
5,775,947 A 7/1998 Suzuki et al.
5,782,656 A 7/1998 Zell et al.
5,795,191 A 8/1998 Preputnick et al.
5,803,768 A 9/1998 Zell et al.
5,817,973 A 10/1998 Elco et al.
5,820,392 A * 10/1998 Lin et al. ..... 439/108
5,823,828 A 10/1998 Bricaud et al.
5,833,475 A 11/1998 Mitra
5,853,797 A 12/1998 Fuchs et al.
5,860,816 A 1/1999 Provencher et al.
5,871,362 A 2/1999 Campbell et al.
5,876,222 A 3/1999 Gardner et al.
5,882,227 A 3/1999 Neidich
5,887,158 A 3/1999 Sample et al.
5,892,791 A 4/1999 Moon
5,893,761 A 4/1999 Loungeville
5,902,136 A 5/1999 Lemke et al.
5,904,581 A 5/1999 Pope et al.
5,904,594 A 5/1999 Longueville et al.
5,908,333 A 6/1999 Perino et al.
5,938,479 A 8/1999 Paulson et al.
5,961,355 A 10/1999 Morlion et al.
5,967,844 A 10/1999 Doutrich et al.
5,971,817 A 10/1999 Longueville
5,980,321 A 11/1999 Cohen et al.
5,984,690 A 11/1999 Riechelmann et al.
5,992,953 A 11/1999 Rabinovitz
5,993,259 A 11/1999 Stokoe et al.
6,007,376 A 12/1999 Shimizu
6,022,227 A 2/2000 Huang
6,027,345 A 2/2000 McHugh et al.
6,042,427 A 3/2000 Adriaenssens et al.
6,050,862 A 4/2000 Ishii
6,053,751 A 4/2000 Humphrey
6,068,520 A 5/2000 Winings et al.
6,086,386 A 7/2000 Fjrlstad et al.
6,095,868 A 8/2000 Hyland et al.
6,116,926 A 9/2000 Ortega et al.
6,116,965 A 9/2000 Arnett et al.

(56) References Cited

U.S. PATENT DOCUMENTS 6,123,554 A 9/2000 Ortega et al.
6,125,535 A 10/2000 Chiou et al.
6,129,592 A 10/2000 Mickievicz et al.
6,132,255 A 10/2000 Verhoeven
6,139,336 A 10/2000 Olson
6,146,157 A 11/2000 Lenoir et al.
6,146,202 A 11/2000 Ramey et al.
6,146,203 A 11/2000 Elco et al.
6,152,747 A 11/2000 McNamara
6,154,742 A 11/2000 Herriot
6,168,458 B1 * 1/2001 Kraft ..... 439/488
6,171,115 B1 1/2001 Mickievicz et al.
6,171,149 B1 1/2001 Van Zanten
6,179,663 B1 1/2001 Bradley et al.
6,190,213 B1 2/2001 Reichart et al.
6,210,227 B1 4/2001 Yamasaki et al.
6,212,755 B1 4/2001 Shimada et al.
6,219,913 B1 4/2001 Uchiyama
6,220,896 B1 4/2001 Bertoncini et al.
6,224,432 B1 5/2001 Billma
6,227,882 B1 5/2001 Ortega et al.
6,241,535 B1 6/2001 Lemke et al.
6,267,604 B1 7/2001 Mickievicz et al.
6,269,539 B1 8/2001 Takahashi et al.
6,273,759 B1 8/2001 Perino et al.
6,280,209 B1 8/2001 Bassler et al.
6,280,809 B1 8/2001 Wang et al.
6,293,827 B1 9/2001 Stokoe et al.
6,299,483 B1 10/2001 Cohen et al.
6,299,484 B2 10/2001 Van Woensel et al.
6,302,711 B1 10/2001 Ito
6,319,075 B1 11/2001 Clark et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 2/2002 Billman et al.
6,347,952 B1 2/2002 Hasegawa et al.
6,347,962 B1 2/2002 Kline
6,350,134 B1 2/2002 Fogg et al.
6,354,877 B1 3/2002 Shuey et al.
6,358,061 B1 3/2002 Regnier
6,361,366 B1 3/2002 Shuey et al.
6,363,607 B1 4/2002 Chen et al.
6,364,710 B1 4/2002 Billman et al.
6,371,773 B1 4/2002 Crofoot et al.
6,375,474 B1 4/2002 Harper, Jr. et al.
6,375,478 B1 4/2002 Kikuchi
6,379,188 B1 4/2002 Cohen et al.
6,386,914 B1 5/2002 Collins et al.
6,386,924 B2 5/2002 Long
6,390,826 B1 5/2002 Affolter et al.
6,409,543 B1 6/2002 Astbury, Jr. et al.
6,414,248 B1 7/2002 Sundstrom
6,420,778 B1 7/2002 Sinyansky
6,431,914 B1 8/2002 Billman
6,435,914 B1 8/2002 Billman
6,457,983 B1 10/2002 Bassler et al.
6,461,202 B2 10/2002 Kline
6,464,529 B1 10/2002 Jensen et al.
6,471,548 B2 * 10/2002 Bertoncini et al. ..... 439/607.1
6,482,038 B2 11/2002 Olson
6,485,330 B1 11/2002 Doutrich
6,494,734 B1 12/2002 Shuey
6,503,103 B1 1/2003 Cohen et al.
6,506,076 B2 1/2003 Cohen et al.
6,506,081 B2 1/2003 Blanchfield et al.
6,520,803 B1 2/2003 Dunn
6,526,519 B1 2/2003 Cuthbert
6,527,587 B1 3/2003 Ortega et al.
6,528,737 B1 3/2003 Kwong et al.
6,530,134 B1 3/2003 Laphan et al.
6,537,086 B1 3/2003 Mac Mullin
6,537,087 B2 3/2003 McNamara et al.
6,537,111 B2 3/2003 Brammer et al.
6,540,522 B2 4/2003 Sipe
6,540,558 B1 4/2003 Paagman
6,540,559 B1 4/2003 Kemmick et al.
6,544,074 B2 4/2003 Bricaud et al.
6,547,066 B2 4/2003 Koch
6,551,140 B2 4/2003 Billman et al.
6,554,640 B1 4/2003 Koike et al.
6,554,647 B1 4/2003 Cohen et al.
6,561,849 B2 5/2003 Naito et al.
6,565,387 B2 5/2003 Cohen
6,565,388 B1 5/2003 Van Woesel et al.
6,572,409 B2 6/2003 Nitta et al.
6,572,410 B1 6/2003 Volstorf et al.
6,589,071 B1 7/2003 Lias et al.
6,592,381 B2 7/2003 Cohen et al.
6,602,095 B2 8/2003 Astbury, Jr. et al.
6,607,402 B2 8/2003 Cohen et al.
6,609,933 B2 8/2003 Yamasaki
6,633,490 B2 10/2003 Centola et al.
6,641,411 B1 11/2003 Stoddard et al.
6,641,825 B2 11/2003 Scholz et al.
6,648,657 B1 11/2003 Korsunsky et al.
6,652,318 B1 11/2003 Winings et al.
6,652,319 B1 11/2003 Billman
6,655,966 B2 12/2003 Rothermel et al.
6,659,808 B2 12/2003 Billman et al.
6,672,886 B2 1/2004 Billman
6,672,907 B2 1/2004 Azuma
6,692,272 B2 2/2004 Lemke et al.
6,695,627 B2 2/2004 Ortega et al.
6,712,646 B2 3/2004 Shindo
6,717,825 B2 4/2004 Volstorf
6,736,664 B2 5/2004 Ueda et al.
6,743,057 B2 * 6/2004 Davis et al. ..... 439/701
6,746,278 B2 6/2004 Nelson et al.
6,749,439 B1 6/2004 Potter et al.
6,749,468 B2 6/2004 Avery
6,762,067 B1 7/2004 Quinnones et al.
6,764,341 B2 7/2004 Lappoehn
6,776,649 B2 8/2004 Pape et al.
6,786,771 B2 9/2004 Gailus
6,799,215 B1 9/2004 Giroir et al.
6,805,278 B1 10/2004 Olson et al.
6,808,399 B2 10/2004 Rothermel et al.
6,808,420 B2 10/2004 Whiteman, Jr. et al.
6,824,391 B2 11/2004 Mickievicz et al.
6,835,072 B2 12/2004 Simons et al.
6,843,679 B2 1/2005 Kuo et al.
6,843,686 B2 1/2005 Ohnishi et al.
6,848,944 B2 2/2005 Evans
6,851,974 B2 2/2005 Doutrich
6,851,980 B2 2/2005 Nelson et al.
6,852,567 B1 2/2005 Lee et al.
6,863,543 B2 * 3/2005 Lang et al. ..... 439/75
6,869,292 B2 3/2005 Johnescu et al.
6,872,085 B1 3/2005 Cohen et al.
6,884,117 B2 4/2005 Korsunsky et al.
6,890,214 B2 5/2005 Brown et al.
6,893,300 B2 5/2005 Zhou et al.
6,893,686 B2 5/2005 Egan
6,899,566 B2 5/2005 Kline et al.
6,902,411 B2 6/2005 Kubo
6,913,490 B2 7/2005 Whiteman, Jr. et al.
6,918,776 B2 7/2005 Spink, Jr.
6,918,789 B2 7/2005 Lang et al.
6,932,649 B1 8/2005 Rothermel et al.
6,939,173 B1 9/2005 Elco et al.
6,945,796 B2 9/2005 Bassler et al.
6,951,466 B2 10/2005 Sandoval et al.
6,953,351 B2 10/2005 Fromm et al.
6,960,103 B2 11/2005 Tokunaga
6,969,280 B2 11/2005 Chien et al.
6,976,886 B2 12/2005 Winnings et al.
6,979,215 B2 12/2005 Avery et al.
6,981,883 B2 1/2006 Raistrick et al.
6,988,902 B2 1/2006 Winings et al.
6,994,569 B2 2/2006 Minich et al.
7,001,188 B2 2/2006 Kobayashi
7,021,975 B2 4/2006 Lappohn

(56) References Cited

U.S. PATENT DOCUMENTS

| | | | |
|---|---|---|---|
| 7,040,901 | B2 | 5/2006 | Benham et al. |
| 7,044,794 | B2 | 5/2006 | Consoli et al. |
| 7,048,589 | B2 | 5/2006 | Bricaud et al. |
| 7,074,086 | B2 | 7/2006 | Cohen et al. |
| 7,090,501 | B1 | 8/2006 | Scherer et al. |
| 7,094,102 | B2 | 8/2006 | Cohen et al. |
| 7,097,506 | B2 | 8/2006 | Nakada |
| 7,101,191 | B2 | 9/2006 | Benham |
| 7,108,556 | B2 | 9/2006 | Cohen et al. |
| 7,112,082 | B2 | 9/2006 | Tsai |
| 7,114,964 | B2 | 10/2006 | Winings et al. |
| 7,118,391 | B2 | 10/2006 | Minich et al. |
| 7,131,870 | B2 | 11/2006 | Whiteman, Jr. et al. |
| 7,137,832 | B2 | 11/2006 | Mongold et al. |
| 7,139,176 | B2 | 11/2006 | Taniguchi et al. |
| 7,153,162 | B2 | 12/2006 | Mizumura et al. |
| 7,160,117 | B2 | 1/2007 | Ngo |
| 7,172,461 | B2 | 2/2007 | Davis et al. |
| 7,175,446 | B2 | 2/2007 | Bright et al. |
| 7,179,108 | B2 | 2/2007 | Goodman et al. |
| 7,186,123 | B2 | 3/2007 | Lemke et al. |
| 7,207,807 | B2 | 4/2007 | Fogg |
| 7,207,836 | B2 | 4/2007 | Tsai |
| 7,239,526 | B1 | 7/2007 | Bibee |
| 7,241,168 | B2 | 7/2007 | Sakurai et al. |
| 7,244,126 | B2 | 7/2007 | Morana et al. |
| 7,247,050 | B1 | 7/2007 | Minich |
| 7,270,574 | B1 | 9/2007 | Ngo |
| 7,278,856 | B2 | 10/2007 | Minich |
| 7,281,950 | B2 | 10/2007 | Belopolsky |
| 7,285,018 | B2 | 10/2007 | Kenny et al. |
| 7,292,055 | B2 | 11/2007 | Egitto et al. |
| 7,310,875 | B2 | 12/2007 | Evans |
| 7,322,855 | B2 | 1/2008 | Mongold et al. |
| 7,331,802 | B2 | 2/2008 | Rothermel et al. |
| 7,331,830 | B2 | 2/2008 | Minich |
| 7,396,259 | B2 | 7/2008 | Marshall |
| 7,407,387 | B2 | 8/2008 | Johnescu et al. |
| 7,422,483 | B2 | 9/2008 | Avery et al. |
| 7,429,176 | B2 | 9/2008 | Johnesu et al. |
| 7,431,616 | B2 | 10/2008 | Minich |
| 7,438,600 | B1 | 10/2008 | Hung et al. |
| 7,462,924 | B2 | 12/2008 | Shuey |
| 7,467,955 | B2 | 12/2008 | Raistrick et al. |
| 7,494,379 | B2 | 2/2009 | Do et al. |
| 7,494,381 | B1 | 2/2009 | Wu et al. |
| 7,497,735 | B2 | 3/2009 | Belopolsky |
| 7,497,736 | B2 | 3/2009 | Minich et al. |
| 7,500,871 | B2 | 3/2009 | Minich et al. |
| 7,503,804 | B2 | 3/2009 | Minich |
| 7,524,209 | B2 | 4/2009 | Hull et al. |
| 7,534,142 | B2 | 5/2009 | Avery et al. |
| 7,553,182 | B2 | 6/2009 | Buck et al. |
| 7,621,781 | B2 | 11/2009 | Rothermel et al. |
| 7,651,337 | B2 | 1/2010 | McNamara |
| 7,663,890 | B2 | 2/2010 | Nelson et al. |
| 7,670,185 | B2 | 3/2010 | Zhang et al. |
| 7,762,843 | B2 | 7/2010 | Minich et al. |
| 7,789,716 | B2 | 9/2010 | Fedder et al. |
| 7,798,861 | B2 | 9/2010 | Liu et al. |
| 7,916,488 | B2 | 3/2011 | Chang |
| 8,062,046 | B2 | 11/2011 | Daily et al. |
| 8,137,119 | B2 | 3/2012 | Stoner |
| 8,361,896 | B2 | 1/2013 | De Geest |
| 2001/0012729 | A1 | 8/2001 | Van Woensel |
| 2001/0046810 | A1 | 11/2001 | Cohen et al. |
| 2002/0017397 | A1 | 2/2002 | Ramey et al. |
| 2002/0039857 | A1 | 4/2002 | Naito et al. |
| 2002/0084105 | A1 | 7/2002 | Geng et al. |
| 2002/0098727 | A1 | 7/2002 | McNamara et al. |
| 2002/0106930 | A1 | 8/2002 | Pape et al. |
| 2002/0111068 | A1 | 8/2002 | Cohen et al. |
| 2002/0115318 | A1* | 8/2002 | Apicelli ..... 439/108 |
| 2002/0127890 | A1 | 9/2002 | Billman et al. |
| 2003/0116857 | A1 | 6/2003 | Taniguchi et al. |
| 2003/0143894 | A1 | 7/2003 | Kline et al. |
| 2003/0171010 | A1 | 9/2003 | Winings et al. |
| 2003/0203665 | A1 | 10/2003 | Ohnishi et al. |
| 2003/0220021 | A1 | 11/2003 | Whiteman, Jr. et al. |
| 2004/0127098 | A1 | 7/2004 | Kuo et al. |
| 2004/0157477 | A1 | 8/2004 | Johnson et al. |
| 2004/0224559 | A1 | 11/2004 | Nelson et al. |
| 2004/0235321 | A1 | 11/2004 | Mizumura et al. |
| 2005/0009402 | A1 | 1/2005 | Chien et al. |
| 2005/0032401 | A1 | 2/2005 | Kobayashi |
| 2005/0048838 | A1 | 3/2005 | Korsunsky et al. |
| 2005/0079763 | A1 | 4/2005 | Lemke et al. |
| 2005/0101188 | A1 | 5/2005 | Benham et al. |
| 2005/0118869 | A1 | 6/2005 | Evans |
| 2005/0148239 | A1 | 7/2005 | Hull et al. |
| 2005/0164555 | A1 | 7/2005 | Winings et al. |
| 2005/0170700 | A1 | 8/2005 | Shuey et al. |
| 2005/0196987 | A1 | 9/2005 | Shuey et al. |
| 2005/0202722 | A1 | 9/2005 | Regnier et al. |
| 2005/0215121 | A1 | 9/2005 | Tokunaga |
| 2005/0227552 | A1 | 10/2005 | Yamashita et al. |
| 2005/0277315 | A1 | 12/2005 | Mongold et al. |
| 2005/0287869 | A1 | 12/2005 | Kenny et al. |
| 2006/0003628 | A1 | 1/2006 | Long et al. |
| 2006/0014433 | A1 | 1/2006 | Consoli et al. |
| 2006/0024983 | A1 | 2/2006 | Cohen et al. |
| 2006/0024984 | A1 | 2/2006 | Winings et al. |
| 2006/0046526 | A1 | 3/2006 | Minich |
| 2006/0051987 | A1 | 3/2006 | Goodman et al. |
| 2006/0068610 | A1 | 3/2006 | Belopolsky |
| 2006/0068641 | A1 | 3/2006 | Hull et al. |
| 2006/0073709 | A1 | 4/2006 | Reid |
| 2006/0116857 | A1 | 6/2006 | Sevic et al. |
| 2006/0121749 | A1 | 6/2006 | Fogg |
| 2006/0160425 | A1 | 7/2006 | Fuerst |
| 2006/0192274 | A1 | 8/2006 | Lee et al. |
| 2006/0216969 | A1 | 9/2006 | Bright et al. |
| 2006/0228912 | A1 | 10/2006 | Morlion et al. |
| 2006/0232301 | A1 | 10/2006 | Morlion et al. |
| 2007/0004287 | A1 | 1/2007 | Marshall |
| 2007/0042639 | A1 | 2/2007 | Manter et al. |
| 2007/0099455 | A1 | 5/2007 | Rothermel et al. |
| 2007/0138617 | A1 | 6/2007 | Knighten et al. |
| 2007/0205774 | A1 | 9/2007 | Minich |
| 2007/0207641 | A1 | 9/2007 | Minich |
| 2008/0045079 | A1 | 2/2008 | Minich et al. |
| 2008/0176453 | A1 | 7/2008 | Minich et al. |
| 2008/0318450 | A1 | 12/2008 | Regnier et al. |
| 2009/0011641 | A1 | 1/2009 | Cohen et al. |
| 2009/0017652 | A1 | 1/2009 | Stoner |
| 2009/0017682 | A1 | 1/2009 | Amleshi et al. |
| 2009/0267183 | A1 | 10/2009 | Temple et al. |
| 2009/0303689 | A1 | 12/2009 | Chang |

FOREIGN PATENT DOCUMENTS

| | | |
|---|---|---|
| EP | 0 932 226 | 7/1999 |
| EP | 0 635 910 | 6/2000 |
| EP | 0 891 016 | 10/2002 |
| EP | 1 148 587 | 4/2005 |
| EP | 1635429 | 3/2006 |
| EP | 1 933 422 | 6/2008 |
| JP | 02-284372 A | 11/1990 |
| JP | 03-266383 A | 11/1991 |
| JP | 06-236788 | 8/1994 |
| JP | 07-114958 | 5/1995 |
| JP | 11/185886 | 7/1999 |
| JP | 2000-003743 | 1/2000 |
| JP | 2000-003744 | 1/2000 |
| JP | 2000-003745 | 1/2000 |
| JP | 2000-003746 | 1/2000 |
| JP | 2004-103527 A | 4/2004 |
| WO | WO 90/16093 | 12/1990 |
| WO | WO 01/29931 | 4/2001 |
| WO | WO 01/39332 | 5/2001 |
| WO | WO 02/101882 | 12/2002 |
| WO | WO 2006/031296 | 3/2006 |

(56) References Cited

FOREIGN PATENT DOCUMENTS

| | | |
|---|---|---|
| WO | WO 2006/105535 | 10/2006 |
| WO | WO 2008/082548 | 7/2008 |
| WO | WO 2010/068671 | 6/2010 |

OTHER PUBLICATIONS

Search Report/Written Opinion for PCT/US2009/035388, dated Oct. 12, 2009.
B.? Bandwidth and Rise Time Budgets, Module 1-8. Fiber Optic Telecommunications (E-XVI-2a), htt-://cord.org/step online/st1-8/st18exvi2a.htm, 3 pages.
Amphenol TCS (ATCS): VHDM Connector, http://www.teradyne.com/prods/tcs/products/connectors/backplane/vhdm/index.html, 2 pages.
Amphenol TCS (ATCS):HDM® Stacker Signal Integrity, http://www.teradyne.com/prods/tcs/products/connectors/mezzanine/hdm_stacker/signintegr, 3 pages.
Backplane Products Overview Page, http://www.molex.com/cgi-bin/bv/molex/super_family/super_family.jsp?BV_Session ID=@, 2005-2006 © Molex, 4 pages.
Communications, Data, Consumer Division Mezzanine High-Speed High-Density Connectors Gig-Array® and Meg-Array® electrical Performance Data, 10 pages FCI Corporation.
FCI's Airmax VS Connector System Honored at Design.con, 2005, Heilind Electrnoics, Inc., http://www.heilind.com/products/fci/airmax-vs-design.asp, 1 page.
Framatome Connector Specification, 1 page.
HDM Separable Interface Detail, Molex®, 3 pages.
Hult, B., "FCI's Problem Solving Approach Changes Market, The FCI Electronics AirMax VS®", ConnectorSupplier.com, Http://www.connectorsupplier.com/tech_updates_FCI-Airmax_archive.htm, 2006, 4 pages.
Lucent Technologies' Bell Labs and FCI Demonstrate 25gb/S Data Transmission over Electrical Backplane Connectors, Feb. 1, 2005, http://www.lucent.com/press/0205/050201.bla.html, 4 pages.
Metral® 2mm High-Speed Connectors, 1000, 2000, 3000 Series, Electrical Performance Data for Differential Applications, FCI Framatome Group, 2 pages.
MILLIPACS Connector Type A Specification, 1 page.
Molex Incorporated Drawings, 1.0 HDMI Right Angle Header Assembly (19 PIN) Lead Free, Jul. 20, 2004, 7 pages.
*Molex, High Definition Multimedia Interface* (*HDMI*), www.molex.com, 2 pages.
*NSP, Honda The World Famous Connectors*, http://www.honda-connectors.co.jp, 6 pages, English Language Translation attached.
PCB-Mounted Receptacle Assemblies, 2.00 mm(0.079in) Centerlines, Right-Angle Solder-to-Board Signal Receptacle, *Metral*™, Berg Electronics, 10-6-10-7, 2 pages.
Samtec, High Speed Characterization Report, SEAM-30-02.0-S-10-2 Mates with SEAF-30-05.0-S-10-2, Open Pin Field Array, 1.27 mm x 1.27mm Pitch 7mm Stack Height, 2005, www.samtec.com, 51 pages.
Teradyne Connection Systems, Inc., Customer Use Drawing No. C-163-5101-500, Rev. 04.
Tyco Electronics, "Champ Z-Dok Connector System", Catalog # 1309281, Issued Jan. 2002, 3 pages.
Tyco Electronics, Z-Pack TinMan Product Portofolio Expanded to Include 6-Pair Module, 2005, 1 page.
VHDM High-Speed Differential (VHDM HSD), http://www.teradyne.com/prods/bps/vhdm/hsd.html, 6 pages.
International Patent Application No. PCT/US2010/059639: International Search Report dated Aug. 26, 2011, 3 pages.
U.S. Appl. No. 12/833,322: Non-Final Office Action, dated Feb. 18, 2011, 11 pages.
U.S. Appl. No. 12/833,322: Response to Office Action dated Feb. 18, 2011, dated May 18, 2011, 11 pages.
U.S. Appl. No. 12/833,322: Final Rejection dated Jul. 25, 2011, 25 pages.
U.S. Appl. No. 12/833,322, filed Jul. 9, 2010, Stuart C. Stoner.
U.S. Appl. No. 12/833,322: Response to Final Rejection dated Jul. 25, 2011, dated Oct. 25, 2011, 7 pages.
Tyco Electronics, "High Speed Backplane Connectors, Multigig RT Connector Products," Catalog 1773095 Issued Apr. 2005, 21 pages.
U.S. Appl. No. 60/584,928, filed Jul. 1, 2004, Cohen.
International Patent Application No. PCT/US2008/002569: International Search Report, dated Sep. 26, 2008, 2 pages.
U.S. Appl. No. 11/713,503: Advisory Action, dated May 5, 2009, 3 pages.
U.S. Appl. No. 11/713,503: Notice of Abandonment, dated Sep. 11, 2009, 2 pages.
U.S. Appl. No. 11/713,503: Final Rejection, dated Feb. 27, 2009, 4 pages.
U.S. Appl. No. 11/713,503: Non-Final Office Action, dated Nov. 6, 2008, 4 pages.
U.S. Appl. No. 11/713,503: Notice of Publication, dated Sep. 4, 2008, 1 page.
U.S. Appl. No. 11/713,503: Non-Final Office Action, dated Jun. 20, 2008, 5 pages.
U.S. Appl. No. 11/713,503: (Tyco) Declaration Under 37 1.132, dated Sep. 22, 2008, 11 pages.
U.S. Appl. No. 11/713,503: Request for Consideration after Final Rejection, dated Apr. 24, 2009, 5 pages.
U.S. Appl. No. 11/713,503: Response to Non-Final Office Action issued Nov. 6, 2008, dated Feb. 6, 2009, 5 pages.
U.S. Appl. No. 11/713,503: Response to Non-Final Office Action issued Jun. 20, 2008, dated Sep. 22, 2008, 4 pages.
Tyco Electronics, "Z-Pack TinMan High Speed Orthogonal Connector Product Feature Selector", http://catalog.tycoelectronics.com/catalog/feat/en/s/24643?BML=10576.17560.17759, accessed Oct. 13, 2009, 2 pages.
"Tyco Unveils Z-Pack TinMan Orthogonal Connector System", http://www.epn-online.com/page/new59327/tyco-unveils-z-pack-tinman-orthogonal-conn, accessed Oct. 13, 2009, 4 pages.
International Preliminary Report on Patentability, issued Apr. 2, 2013, for PCT/US2011/053378 filed Sep. 27, 2011.
4.0 UHD Connector: Differential Signal Crosstalk, Reflections, 1998, p. 8-9.
Airmax VS®, High Speed Connector System, Communications, Data, Consumer Division, 2004, 16 pages.
AMP Z-Pack 2mm HM Connector, 2mm Centerline, Eight-Row, Right-Angle Applications, Electrical Performance Report, EPR 889065, Issued Sep. 1998, 59 pages.
AMP Z-Pack 2mm HM Interconnection System, 1992 and 1994 © by AMP Incorporated, 6 pages.
AMP Z-Pack HM-Zd Performance at Gigabit Speeds, Tyco Electronics, Report #20GC014, Rev.B., May 4, 2001, 30 pages.
Amphenol TCS (ATCS): Backplane Connectors, 2002, www.amphenol-tcs.com, 3 pages.
Amphenol TCS (ATCS): Ventura® High Performance, Highest Density Available, 2002, www.amphenol-tcs.com, 2 pages.
Amphenol TCS (ATCS) VHDM Connector, http://www.teradyne.com/prods/tcs/products/connectors/backplane/vhdm/index.html, 2 pages, 2006.
Amphenol TCS (ATCS):HDM® Stacker Signal Integrity, http://www.teradyne.com/prods/tcs/products/connectors/mezzanine/hdm_stacker/signintegr, 3 pages, 2006.
Amphenol TCS (ATCS)-XCede® Connector, 2002, www.amphenol-tcs.com, 5 pages.
Amphenol TCS(ATCS): VHDM L-Series Connector, http://www.teradyne.com/prods/tcs/products/connectors/backplane/vhdm_1-series/index.html, 2006, 4 pages.
Backplane Products Overview Page, http://www.molex.com/cgi-bin/bv/molex/super_family.jsp?BV_Session ID=@, 2005-2006 © Molex, 4 pages.
Backplane Products, www.molex.com, 2007, 3 pages.
Communications, Data, Consumer Division Mezzanine High-Speed High-Density Connectors GIG-ARRAY® and MEG-ARRAY® electrical Performance Data, 10 pages FCI Corporation, Jun. 5, 2008.
FCI's Airmax VS Connector System Honored at Design.con, 2005, Heilind Electronics, Inc., http://www.heilind.com/products/fci/airmax-vs-design.asp, 1 page.
Framatome Connector Specification, 1 page, May 10, 1999.

(56) References Cited

OTHER PUBLICATIONS

Fusi, M.A. et al., "Differential Signal Transmission through Backplanes and Connectors", *Electronic Packaging and Production*, Mar. 1996, 27-31.
GIG-ARRAY® High Speed Mezzanine Connectors 15-40 mm Board to Board, Jun. 5, 2006, 1 page.
Gig-Array® Connector System, Board to Board Connectors, 2005, 4 pages.
Goel, R.P. et al., "AMP Z-Pack Interconnect System", 1990, AMP Incorporated, 9 pages.
HDM Separable Interface Detail, Molex®, 3 pages, Feb. 17, 1993.
HDM/HDM *plus*, 2mm Backplane Interconnection System, Teradyne Connection Systems, © 1993, 22 pages.
HDM® HDM Plus® Connectors, http://www.teradyne.com/prods/tcs/products/connectors/backplane/hdm/index.html, 2006, 1 page.
Honda Connectors, Honda High-Speed Backplane Connector NSP Series, Honda Tsuschin Kogyo Co. Ltd. Development Engineering Division, Tokyo Japan, Feb. 7, 2003, 25 pages.
Hult, B., "FCI's Problem Solving Approach Changes Market, The FCI Electronics AirMax VS® ", ConnectorSupplier.com, Http://www.connectorsupplier.com/tech_updates_FCI-Airmax_archive.htm, 2006, 4 pages.
Lucent Technologies' Bell Labs and FCI Demonstrate 25gb/S Data Transmission over Electrical Backplane Connectors, Feb. 1, 2005, http://www.lucent.com/press/0205/050201.bla.hml, 4 pages.
Metral® 2mm High-Speed Connectors, 1000, 2000, 3000 Series, Electrical Performance Data for Differential Application, FCI Framatome Group, 2 pages, Jan. 1, 2000.
*Metral*™, "Speed & Density Extensions", *FCI*, Jun. 3, 1999, 25 pages.
MILLIPACS Connector Type A Specification, 1 page, Dec. 14, 2004.
Molex Incorporated Drawing, 1.0 HDMI Right Angle Header Assembly (19 PIN) Lead Free, Jul. 20, 2004, 7 pages.
Molex, Features and Specifications, www.molex.com/link/Impact.html, May 2008, 5 pages.
Molex, GbXI-Trac™ Backplane Connector System, www.molex.com/cgi-bin, 2007, 3 pages.
Molex, High Definition Multimedia Interface (HDMI), www.molex.com, 2 pages, 2008.
Nadolny, J. et al., "Optimizing Connector Selection for Gigabit Signal Speeds", ECN™, Sep. 1, 2000, http://www.ecnmag.com/article/CA45245, 6 pages.
NSP, Honda The World Famous Connectors, http://www.honda-connectors.co.jp, 6 pages, English Language Translation attached, Feb. 3, 2003.
PCB-Mounted Receptacle Assemblies, 2.00 mm(0.079in) Centerlines, Right-Angle Solder-to-Board Signal Receptacle, *Metral*™, Berg Electronics, 10-6-10-7, 2 pages, 2001.
SAMTEC, E.I.P. Extended Life Product, Open Pin Field Array Seaf Series, 2005, www.samtec.com, 1 page.
SAMTEC, High Speed Characterization Report, SEAM-30-30.02.0-S-10-2 Mates with SEAF-30-05.0-S-10-2, Open Pin Field Array, 1.27 mm x 1.27mm Pitch 7mm Stack Height, 2005, www.samtec.com, 51 pages.
TB-2127 "VENTURA™ Application Design", Revision, "General Release", Specification Revision Status-B. Hurisaker, Aug. 25, 2005, Amphenol Coproation 2006, 1-13.
Teradyne Connection Systems, Inc., Customer Use Drawing No. C-163-5101-500, Rev. 04, Aug. 25, 2005.
Tyco Electronics Engineering Drawing, Impact, 3 Pair 10 Column Signal Module, Mar. 25, 2008, 1 page.
Tyco Electronics Engineering Drawing, Impact, 3 Pair Header Unguided Open Assembly, Apr. 11, 2008, 1 page.
Tyco Electronics Z-Dok+ Connector, May 23, 2003, http://zdok.tycoelectronics.com, 15 pages.
Tyco Electronics, High Speed Backplane Interconnect Solutions, Feb. 7, 2003, 6 pages.
Tyco Electronics, Impact™ Connector Offered by Tyco Electronics, High Speed Backplane Connector System, Apr. 15, 2008, 12 pages.
Tyco Electronics, Overview for High Density Backplane Connector (Z-Pack TinMan), 2005, 1 page.
Tyco Electronics, Overview for High Density Backplane Connectors (Impact™) Offered by Tyco Electronics, www.tycoelectronics.com/catalog, 2007, 2 pages.
Tyco Electronics, Two-Piece, High-Speed Connectors, www.tycoelectronics.com/catalog, 2007, 3 pages.
Tyco Electronics, Z-Dok and Connector, Tyco Electronics, Jun. 23, 2003, http://2dok.tyco.electronics.com, 15 pages.
Tyco Electronics, Z-Pack Slim UHD, http://www.zpackuhd.com, 2005, 8 pages.
Tyco Electronics, Z-Pack TinMan Product Portfolio Expanded to Include 6-Pair Module, 2005, 1 page.
Tyco Electronics/AMP, "Z-Dok and Z-Dok and Connectors", Application Specification # 114-13068, Aug. 30, 2005, Revision A, 16 pages.
VHDM Daughterboard Connectors Feature press-fit Terminations and a Non-Stubbing Seperable Interface, © Teradyne, Inc. Connections Systems Division, Oct. 8, 1997, 46 pages.
VHDM High-Speed Differential (VHDM HSD), http://www.teradyne.com/prods/bps/vhdm/hsd.html, 6 pages, Jan. 24, 2000.

* cited by examiner

CROSS TALK REDUCTION FOR HIGH SPEED ELECTRICAL CONNECTORS

CROSS REFERENCE TO RELATED APPLICATIONS

This application claims the benefit of U.S. patent application No. 61/032,613 filed Feb. 29, 2008, and U.S. patent application No. 61/092,268 filed Aug. 27, 2008, the disclosure of each of which is hereby incorporated by reference This application is related by subject matter to U.S. patent application Ser. No. 11/958,098, filed Dec. 17, 2007, and U.S. Pat. No. 6,471,548, the disclosure of each of which is hereby incorporated by reference as if set forth in its entirety herein.

FIELD

In general, the invention relates to the field of electrical connectors, in particular to a high speed electrical connector comprising an insulating housing module having a plurality of contacts. The invention further relates to a connector comprising a plurality of such insulating housing modules.

BACKGROUND

Electrical connectors provide signal connections between electronic devices using signal contacts. Often, the signal contacts are so closely spaced that undesirable interference, or "cross talk," occurs between adjacent signal contacts. Cross talk occurs when a signal in one signal contact induces electrical interference in an adjacent signal contact due to interfering electrical fields, thereby compromising signal integrity. Cross talk may also occur between differential signal pairs. Cross talk increases with reduced distance between the interfering signal contacts. Cross talk may be reduced by separating adjacent signal contacts or adjacent differential signal pairs with ground contacts.

With electronic device miniaturization and high speed signal transmission, high signal integrity electronic communications and the reduction of cross talk become a significant factor in connector design. It is desired to provide an improved connector reducing the problematic occurrence of cross talk, especially for high speed connectors.

SUMMARY

Figure 1A:
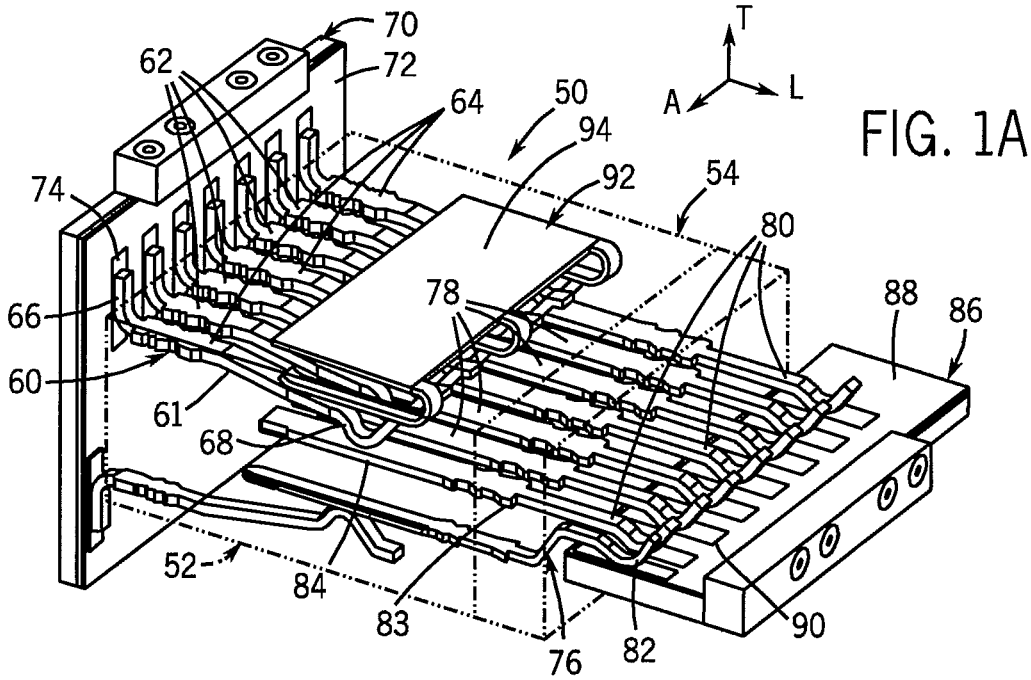
FIG. 1A is a perspective view of an example connector assembly including a first and second electrical connector.
Figure 1B:
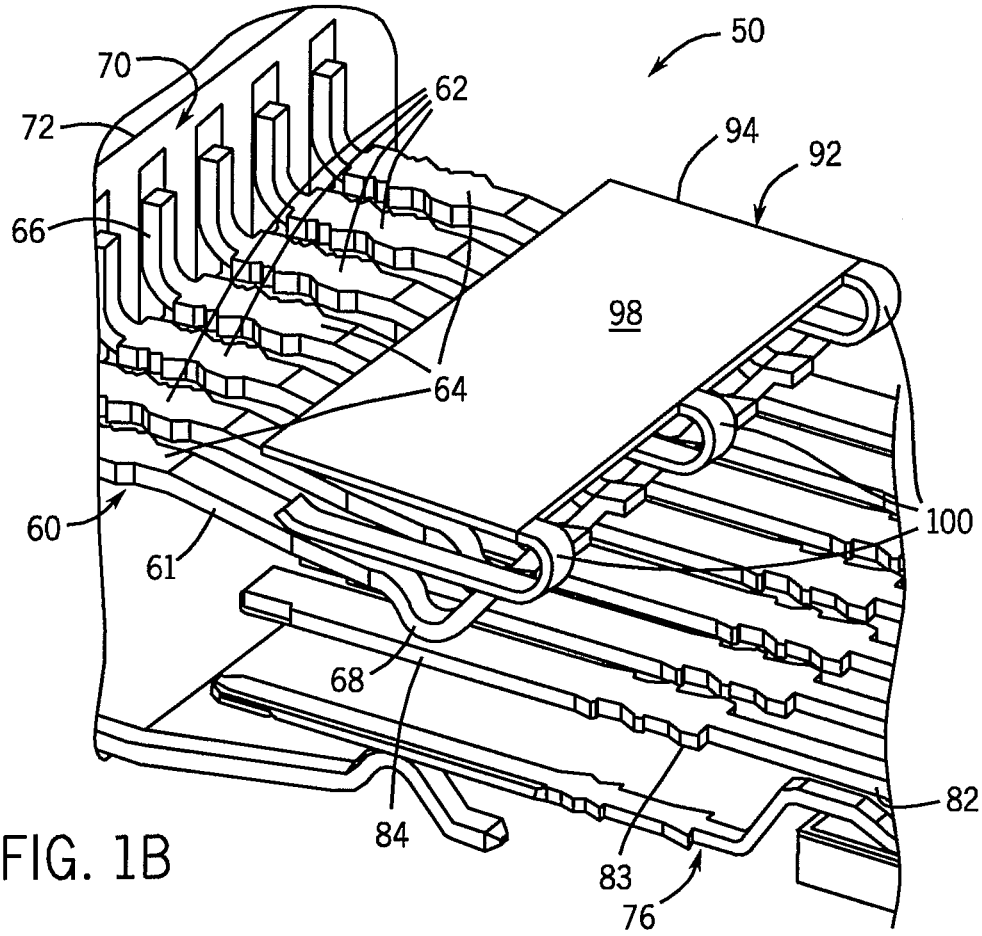
FIG. 1B is an enlarged perspective view of a portion of the connector assembly illustrated in FIG. 1A with the housing removed.
Figure 1C:
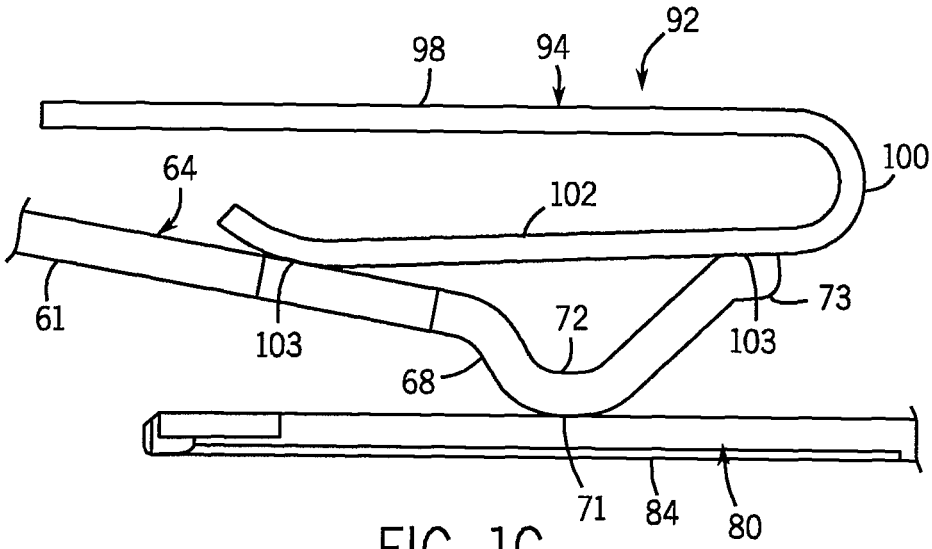
FIG. 1C is a side elevation view of a portion of the connector assembly illustrated in FIG. 1B.
Figure 1D:
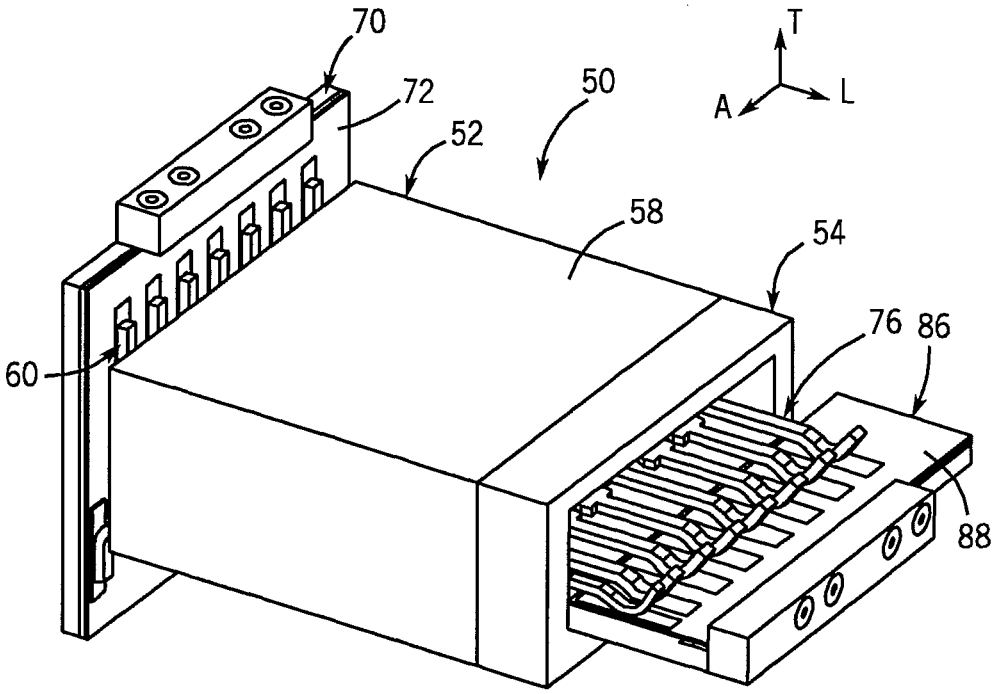
FIG. 1D is a perspective view of an example connector assembly including a first and second electrical connector, but including a schematic illustration of the connector housing.

In one embodiment, an electrical connector includes a housing that retains a plurality of electrical contacts, wherein the electrical contacts includes a plurality of signal contacts and a plurality of ground contacts. The electrical connector further includes a shieldless ground coupling assembly that places at least a portion of the ground contacts in electrical communication with each other. The shieldless ground coupling assembly shifts unwanted spikes in insertion loss resonance frequencies to a higher frequency. Another embodiment includes an electrical connector that includes a first insulative housing comprising differential signal pairs, ground contacts, and a non-shielding ground coupling assembly, wherein the non-shielding ground coupling assembly shifts a resonance frequency to higher value as compared to a second electrical connector that is virtually identical to the electrical connector except for the non-shielding ground coupling assembly.

DETAILED DESCRIPTION

Electrical performance of existing differential signal connectors, such as serial advanced technology attachment (SATA), serial attached small computer system interface (SCSI) (SAS), back panel, and mezzanine connectors can be improved by electrically connecting ground contacts within the connectors. Embodiments described herein allow for a simple retrofit of existing connectors designed to operate at slower data transmission rates, resulting in a drop-in compatible, higher data transmission speed connector this is also compliant with developing new standards such as SATA Revision 2.6, SAS-2 Revision 15, IEEE 802.3ap, etc, the disclosure of each of which is hereby incorporated by reference as if set forth in its entirety herein. More specifically, embodiments described herein can shift resonance frequencies of existing connectors to extend the existing operating frequency range without changing the mating or mounting interface dimensions of existing standardized or non-standardized connectors. Stated another way, the described embodiments can allow existing connectors to be modified and/or replaced to produce a modified connector within the confines of the existing connector housing dimensions so that the modified connector effectively operates at faster data transmission rates (within frequency domain and time domain crosstalk limits such as six percent or less at about 40 ps for time domain or about −24 dB or less (−26 dB) for frequency domain at about 40 ps set forth in the standards), yet still remain drop-in compatible with existing connectors that cannot operate with the parameters of the new developing standards. The embodiments described herein are simple to construct, yet provides a significant advantage to existing implementers of various standards and a significant cost savings to standard implementers and component suppliers.

Referring to FIGS. 1A-D, an electrical connector assembly 50 constructed in accordance with one embodiment includes a first electrical connector 52 and a second electrical connector 54. As shown, the first electrical connector 52 may be a SATA connector, however it should be appreciated that the connector 52 can be in the form of any suitable alternative connector configured to facilitate electrical communications between a first and second electrical device, such as a SAS connector or any suitable alternative connector. That is, the first electrical connector 52 may define a first end in the form of a mating end, and a second end in the form of a mounting end, such that the mating end extends parallel to the mounting end.

The first electrical connector 52 is illustrated as a receptacle connector having electrical contacts 60 that receive complementary electrical contacts 76 of the second electrical connector 54. Thus, the electrical contacts 76 are configured as header contacts of a header connector 54. It should be appreciated, however, that the first connector 52 could be provided as a header connector and the second connector 54 could be provided as a receptacle connector having electrical contacts that receive the contacts of the first connector 52, or either connector could be provided as some other suitable mating connector that mates with other connector.

Accordingly, though the embodiment illustrated in FIGS. 1A-D show a vertical receptacle connector and a vertical header connector, it should be understood that the first and second electrical connectors 52 and 54 and, unless otherwise noted, any other connectors of the type described herein, can each be vertical connectors, right-angle connectors, or mezzanine connectors, and can further be provided as header connectors or receptacle connectors.

Various structures are described herein as extending horizontally along a longitudinal direction "L" and lateral direction "A", and vertically along a transverse direction "T". As illustrated, the longitudinal direction "L" extends along a forward/rearward direction of the connector assembly 50, the lateral direction "A" extends along a width of the connector assembly 50, and the transverse direction "T" extends along a height of the connector assembly 50. Thus, unless otherwise specified herein, the terms "lateral," "longitudinal," and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the orientation of the various components. Accordingly, the directional terms "vertical" and "horizontal" are used to describe the connector assembly 50 and its components as illustrated merely for the purposes of clarity and convenience, it being appreciated that these orientations may change during use.

The first electrical connector 52 may include an electrically insulating receptacle housing 58 (schematically illustrated in FIG. 1D) that can be made from any suitable dielectric material, such as plastic. The housing 58 carries a first set of electrically conductive contacts 60, which includes signal contacts 62 and ground contacts 64 that can be made from a metal or metal alloy, for example. The ground contacts 64 can be disposed regularly or irregularly among the signal contacts 62. For instance, the ground contacts 64 can be disposed between pairs of signal contacts in an S-S-G configuration, such that first and second ground contacts are disposed on opposing sides of the differential signal pair. Pairs of signal contacts 62 can form differential signal pairs, or can be provided as single ended contacts. One or more power contacts can also be provided. The contacts 60 may be insert-molded prior to attachment to the receptacle housing 52 or stitched into the receptacle housing 52.

The contacts 60 each include a lead portion 61, a mounting portion 66 disposed at the rear end of the lead portion 61, and a mating portion 68 disposed opposite the mounting portion 66 at the forward end of the lead portion 61. The mounting portions 66 may include press-fit tails, surface mount tails, or fusible elements such as solder balls that are configured to electrically connect to a first electrical component 70, which may be provided as a printed circuit board 72 having electrical terminals or contact pads 74, or any alternative electrical device such as cables.

Likewise, the second electrical connector 54 may include an electrically insulating header housing that can be made from any suitable dielectric material, such as plastic. The housing carries a second set of electrically conductive contacts 76, which includes signal contacts 78 and ground contacts 80. The ground contacts 80 can be disposed regularly or irregularly among the signal contacts 78. For instance, the ground contacts 80 can be disposed between pairs of signal contacts 78 in an S-S-G configuration. Pairs of signal contacts 78 can form differential signal pairs, or can be provided as single ended contacts. One or more power contacts can also be provided. The contacts 76 may be insert-molded prior to attachment to the header housing or stitched into the header housing.

The contacts 76 each include a lead portion 83, a mounting portion 82 disposed at the rear end of the lead portion 83, and a mating portion 84 disposed opposite the mounting portion 82 at the forward end of the lead portion 83. The mounting portions 82 may include press-fit tails, surface mount tails, or fusible elements such as solder balls that are configured to electrically connect to a second electrical component 86, which may be provided as a printed circuit board 88 having electrical terminals or contact pads 90, or any alternative electrical device such as cables.

The mating portions 68 of each of the first set of contacts 60 can be provided as receptacle ends, and the mating portions 84 of each of the second set of contacts 76 can be provided as horizontally oriented blade ends or beams. The lead portion 61 extends forward from the mounting portion 66 and can be slightly angled vertically toward the complementary second contact 76 to be mated. The lead portion 61 can be flexible so as to be compliant when mating with the complementary second electrical contact 76. The mating portion 68 can define a bend 71 that forms a hook that presents concave surface 72 with respect to the mating portion 84 of the complementary electrical contact 76, and a terminal end 73 can extend forward from the bend 71 and can be angled vertically upward.

Thus, one or more contacts 60 can have upwardly angled lead portions 61 whose mating portions 68 define upward-facing hooks whose upper horizontal surfaces mate with the second contacts 76. The terminal ends 73 extend forward and downward from the forward end of the hooks. One or more contacts 60 can also have downwardly angled lead portions 61 whose mating portions 68 define upward-facing hooks whose lower horizontal surfaces mate with the second contacts 76. The terminal ends 73 extend forward and upward from the forward end of the hooks. The mating portions 84 of the second contacts 86 can have a horizontally oriented blade-shaped mating ends that are configured to electrically connect to the lowest point of the bend 71 of the first contacts 60 when the second contacts 76 are received in the first connector housing 58.

Accordingly, the second set of contacts 76 is configured to be inserted into the first electrical connector 52 and electrically connect to the complementary first set of contacts 60, such that an electrical connection is established between the first and second electrical devices 70 and 86, respectively. Each of the first and second sets of contacts 60 and 76 can be compliant, or have compliant portions, so as to induce a biasing force at the mating interface between the contacts 60 and 76 that increases the reliability of the electrical connection. The contacts 60 and 76 each define a length from their respective mounting portions to their respective mating portions along the longitudinal direction L, and further define a width extending in the lateral direction A.

With continuing reference to FIGS. 1A-1D, the first connector 52 can include an ground coupling assembly 92 that is configured to electrically connect ground contacts 64 while maintaining electrical isolation with respect to the signal contacts 62. The ground coupling assembly 92 can be provided as a ground shorting bar 94 in one embodiment. The ground shorting bar 94 can be constructed from any desirable electrically conductive material, such as a metal or metal alloy. The ground shorting bar 94 can be connected to more than one, up to and including all, ground contacts 64 at contact locations 103 to define an electrical path that includes all ground contacts to which the ground shorting bar 94 is connected. The ground shorting bar 94 can include an electrically conductive plate 98 and one or more, for instance a plurality of, electrically conductive legs 100 extending from the plate 98. The legs 100 can be integrally formed with the plate 98, or can be discreetly connected to the plate 98, for instance via solder. The plate 98 can be elongate in a horizontal plane as illustrated, or can be elongate in a plane that is angled with respect to the horizontal, including in a vertical plane.

The legs 100 can extend longitudinally, and curve forward and downward from the plate 98, and then curve downward and rearward so as to define a hairpin turn that extends into a mating portion 102 that connects to the upper surface of the ground contacts 64. Thus, each leg 100 can correspond to one ground contact 64 that is to be electrically connected to at least one other ground contact. Alternatively, a given leg 100 can be electrically connected to more than one of the ground contacts 64. The legs 100 can be soldered or otherwise connected to any desired location along the ground contacts 64. In the illustrated embodiment, the legs 100 are discretely connected at two connection locations 103 to the ground contacts 64, for instance via solder or a clamping mechanism, though it should be appreciated that the legs 100 could alternatively be connected to the ground contacts 64 at one location or more than two locations. When the ground shorting bar 94 is connected to the ground contacts 64, the legs 100 position the plate 98 at a location spaced with respect to the signal contacts 62, such that the ground shorting bar 94 is electrically isolated from the signal contacts 62.

As illustrated, the mating portions 102 of the legs 100 are connected to the upper surface of the terminal ends 73 of the ground contacts 64, and are further connected to the lead portion 61 at a location between the mounting portion 66 and the mating portion 68. The distal end of the mating portions 102 of the legs 100 can flare upward away from the contact 64 such that the interface between the mating portions 102 of the legs 100 and the contacts 64 define a surface area greater than that of an edge of the legs 100. It should be appreciated, however, that the ground shorting bar 94 can alternatively be connected to the ground contacts 64 at any desired location along the ground contacts 64 or contact pads 74, and at any desired location of the ground shorting bar 94.

In the illustrated embodiment, the ground shorting bar 94 can be overmolded by the housing 58, or otherwise retained in the housing 58, such that the bar 94 does not interfere with the mounting portions 66 or mating portions 68 of the contacts. The outer surface of the plate 98 (which is illustrated as the upper surface as illustrated in FIGS. 1A-D) or portions of the outer surface of the plate 98, can be retained inside the housing, or can be exposed directly to the ambient environment. Thus the ground shorting bar 94 does not alter the ability of the connector 52 to mate with the electrical device 72 or the mating connector 54. As a result, a connector such as connector 52 that is provided without a ground shorting bar can be removed from connection with a mating connector such as connector 54, and replaced by the connector 52 including the ground shorting bar 94 that can be inserted into the mating connector.

The ground shorting bar 94 does not extend over the entire length or substantially the entire length of the signal contacts 62 such that the signal contacts or corresponding differential pairs would be shielded from crosstalk, and thus the ground shorting bar 94 does not provide an electrical shield as is understood by one having ordinary skill in the art. In fact, the ground shorting bar 94 is elongate in a direction that is perpendicular to the direction of elongation of the signal contacts 62. Furthermore, as illustrated, the first connector 52 does not include any shields, though it should be appreciated that, unless otherwise specified, one or more shields may be provided as metallic crosstalk plates that cover substantially the entire length of the signal contacts 62 if desired. Thus, unless otherwise indicated, the connector 52 can be a shieldless connector (that is, a connector that operates in the absence of metallic crosstalk plates) having a shieldless ground shorting bar 94, or a shielded connector having a shieldless ground shorting bar 94.

Without being bound by theory, it is believed that shorting the ground contacts to each other at multiple locations makes the ground more robust and effectively shortens the electrical length of the ground, thereby shifting the electrical resonance of the ground contacts to higher frequencies. This improves both insertion loss and crosstalk. The ground coupling assembly 92 can thus achieve various performance advantages for the connector 52 and connector assembly 50, such as shifting the frequency at which resonance occurs, which can refer to a frequency at which significant unwanted signal degradation occurs as described in more detail below. Shifting significant unwanted insertion loss resonances to higher frequencies can allow for more usable bandwidth in the connector assembly 50. For example, consider a connector that can operate with acceptable insertion loss and crosstalk (such as six percent or −24 dB or less) at 1.5 GHz (about 3 Gigabits/sec). The data transfer rate can be increased until a resonance frequency is encountered. At the resonance frequency, the crosstalk becomes too high (i.e., above six percent for time domain or a comparable time domain measurement) or the insertion loss to crosstalk ratio becomes too low and the connector no longer functions accecptably (out of specification or loss of data). According to the embodiments of the invention, the example 3 Gigabit/sec connector can be modified as described herein to shift the first resonance frequency so that the connector can operate acceptably at 3 GHz (about 6 Gigabits/sec). This increases the usable bandwidth of the electrical connector from 3 Gigabits/sec to 6 Gigabits/sec without changing the form factor of the connector. Furthermore, it is believed that shifting the above-described resonant frequencies can be achieved without substantially altering the impedance profile of the connector.

It is believed that shorting ground contacts 64 at locations closest to the middle of the longest electrical length section of the ground contacts 64 halves that ground length, which thereby doubles the frequency at which the first resonance occurs. Improvements have also been observed in embodiments where the grounds are shorted at locations offset from the middle of the longest electrical length section, or at multiple locations. It is also believed that the geometric configuration of the ground coupling assembly 92, or ground shorting bar 94, can affect the frequency of the electrical resonance. It should be appreciated that the multiple ground shorting bars 94 may connect the same or different grounds in a given connector. Thus, a first ground shorting bar 94 can electrically connect a first set of ground contacts, and a second ground shorting bar 94 can connect a second set of ground contacts, and the first set of ground contacts can be the same or different than the second set of ground contacts.

Thus, one or more electrical connectors, for instance connectors 52, can be provided having a ground coupling assembly that can include one or more ground shorting bars, such as ground shorting bar 94, that causes the signal contacts to have at least one differing performance characteristic, which can be an electrical resonant frequency characteristic, with respect to one or more of the other connectors. For instance, the electrical connectors 52 can have ground coupling assemblies 92 that 1) are connected at one or more different locations along the ground contacts 64, 2) are connected to different ground contacts 64, and/or 3) have different geometric configurations such that a kit of electrical connectors can be provided, wherein different connectors have differently tuned electrical resonant frequencies. This is believed to apply to not only the connectors 52, but any electrical connector or electrical connector module that incorporates a ground coupling assembly of the type described herein.

For instance, the legs 100, or any alternative location of a ground shorting bar of the type illustrated or described herein, can be connected to one or more location of each ground contacts 64 to which the ground shorting bar is attached. For instance, the ground shorting bar can be attached to a location that is coincident or substantially coincident with the longitudinal midpoint of the ground contact 64, at a location rearward of the longitudinal midpoint, or at a location forward of the longitudinal midpoint, including at or proximate the terminal end 73 of the contact 64. Furthermore, the ground shorting bar, for instance ground shorting bar 94, can be constructed having a geometry such that the plate 98 or portions of the plate 98 are positioned at alternative locations. For instance, the plate 98 can extend above, or otherwise along, the ground contacts 64 such that the plate 98 is centered or otherwise disposed at a location spaced forward from the longitudinal midpoint of the contacts, at a location that includes the longitudinal midpoint, or at a location that is disposed rearward of the longitudinal midpoint. The plate 98 may also be constructed having a geometry such that portions of the plate 98 are located at different locations with respect to the longitudinal midpoint of one or more contacts 64 than other portions of the plate 98. The plate 98 may also be centered with respect to the connection interface between the ground contacts 64 and 90, or can be offset with respect to the connection interface.

Thus, a first electrical connector 52 can be provided that includes a first ground coupling assembly 92, having a first geometrical configuration, that is connected to two or more ground contacts at a first location or first set of locations of the respective ground contacts. Another connector can be provided that is constructed similar to the connector 52 (and can be constructed substantially identical or identical with respect to connector 52), but having a ground coupling assembly 92, having a second geometrical configuration, that is connected to two or more ground contacts at a second location or second set of locations of the respective ground contacts. The second geometrical configuration can be different than the first geometrical configuration and/or the second location or second set of locations can be different than the first location or first set of locations. In other words, the second ground coupling assembly 92 can be connected to one or more different locations to a given ground contact with respect to the first ground coupling assembly 92, the second ground coupling assembly 92 can be connected at different locations to some but not all ground contacts with respect to the first ground coupling assembly 92, and/or the second ground coupling assembly 92 can be connected to different ground contacts with respect to the first ground coupling assembly 92.

In this regard, a method can be provided of tuning the electrical resonant frequency of a connector or a plurality of electrical connectors by adjusting an electrical resonant frequency characteristic, for instance 1) the location on the ground contacts 64 to which the ground coupling assembly 92 is connected, 2) the identity of the ground contacts 64 to which the ground coupling assembly 92 is connected and/or 3) the geometrical configuration of the ground coupling assembly 92.

The geometrical configuration of the ground coupling assembly 92 can be varied, for instance, by changing the geometry of the conductive plate 98. For example, while the conductive plate 98 is illustrated as being substantially rectangular in FIGS. 1A-D, the conductive plate can assume any alternative regular or irregular geometry. Furthermore, the conductive plate 98 has an aspect ratio (that is, the ratio of the length to width) that can be greater or less than that illustrated in FIGS. 1A-D.

Figure 2A:
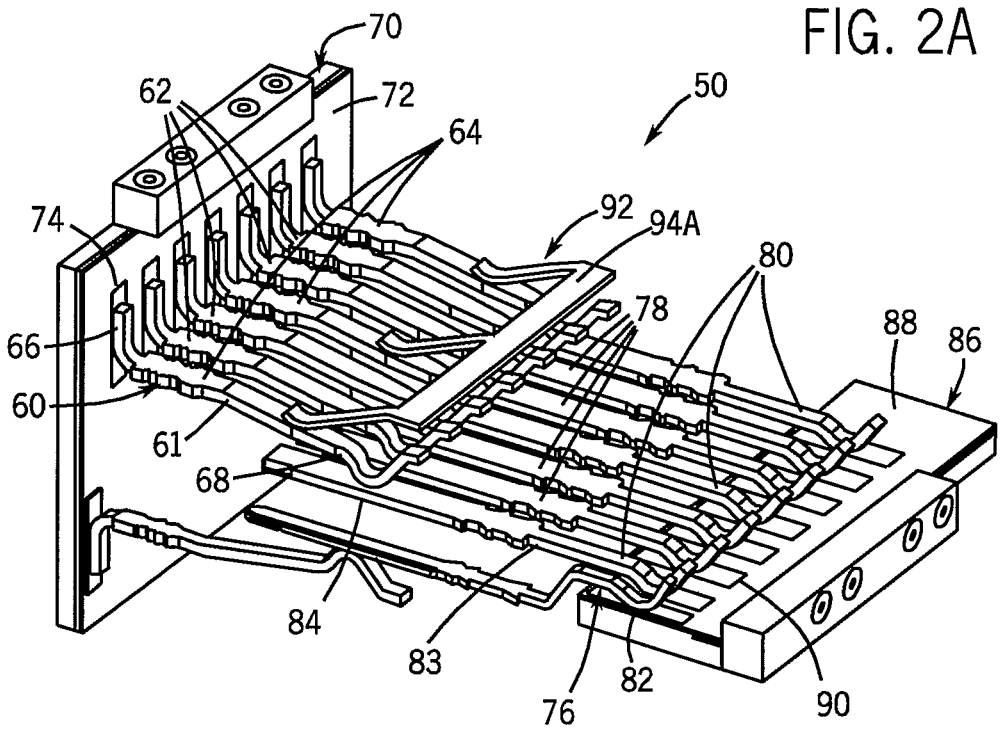
FIG. 2A is a perspective view of an electrical connector assembly as illustrated in FIGS. 1A-D, but including a ground coupling assembly constructed in accordance with an alternative embodiment.
Figure 2B:
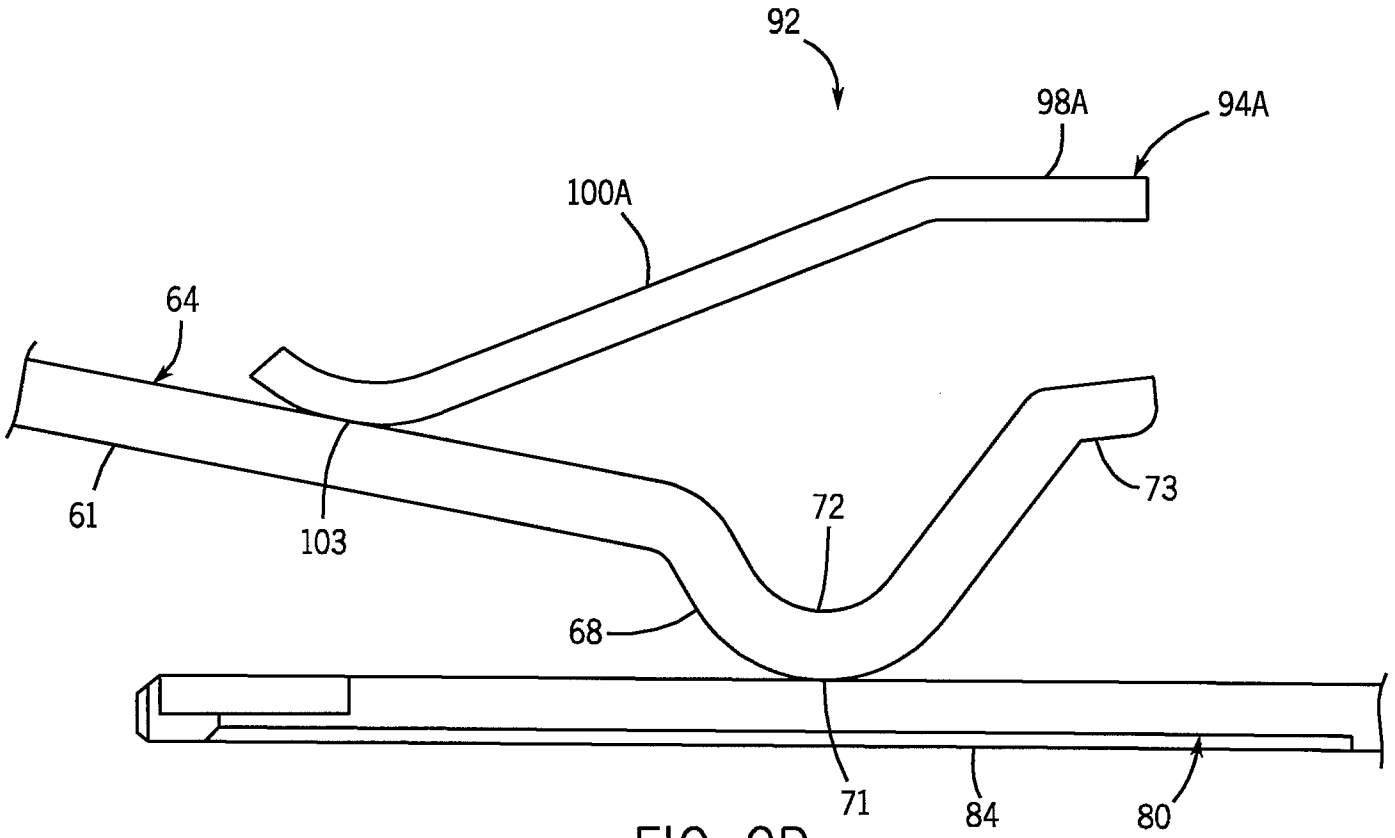
FIG. 2B is a side elevation view of a portion of the electrical connector assembly illustrated in FIG. 2A.

Referring to FIGS. 2A-B, the electrical connector 52 is illustrated including an ground coupling assembly 92 in the form of a second example ground shorting bar 94A constructed in accordance with an alternative embodiment. As shown, the ground shorting bar 94A is connected at different locations along the ground contacts 64, and further has a geometric configuration that is different with respect to the ground shorting bar 94. For instance, the legs 100A extend rearward and downward from the rear end of the plate 98A, and are connected to only one contact location 103 of the ground contacts 64. The plate 98A has aspect ratio greater than that of plate 98, and the plate 98A is disposed and contained above the terminal ends 73 of the ground contacts 64. It should be appreciated that while the second example ground shorting bar 94A is connected to one location on the ground contacts 64, the shorting bar 94A could alternatively be connected at more than one location on the ground contacts 64, and at any desired location or locations along the ground contacts 64 in the manner described above. Furthermore, the second example ground shorting bar 94A can have any alternative geometrical configuration as described above.

Figure 3A:
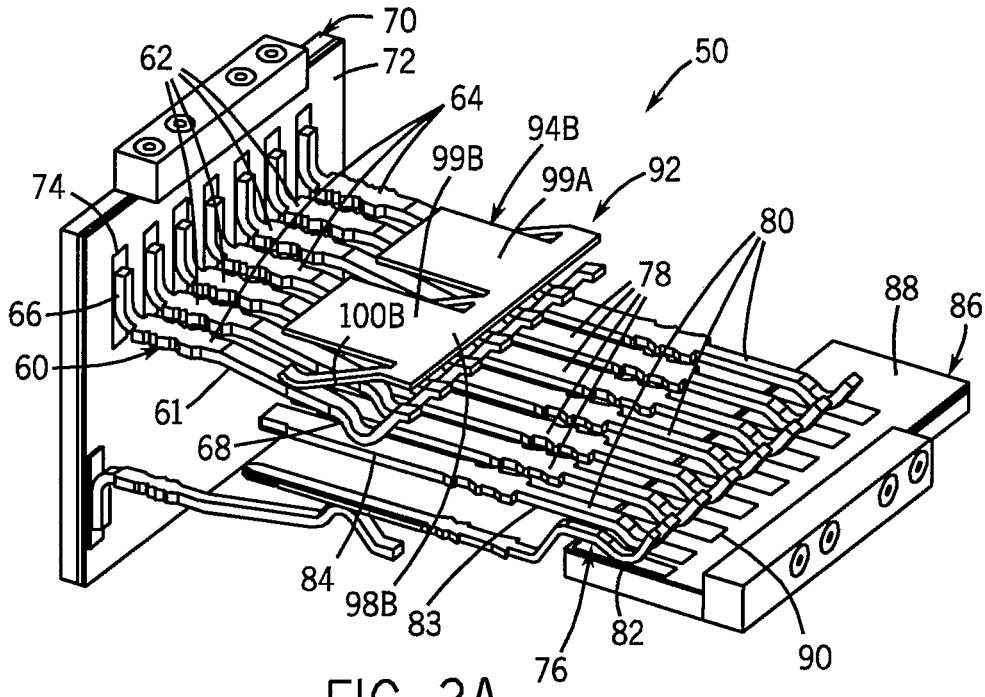
FIG. 3A is a perspective view of an electrical connector assembly as illustrated in FIGS. 1A-D, but including a ground coupling assembly constructed in accordance with an alternative embodiment.
Figure 3B:
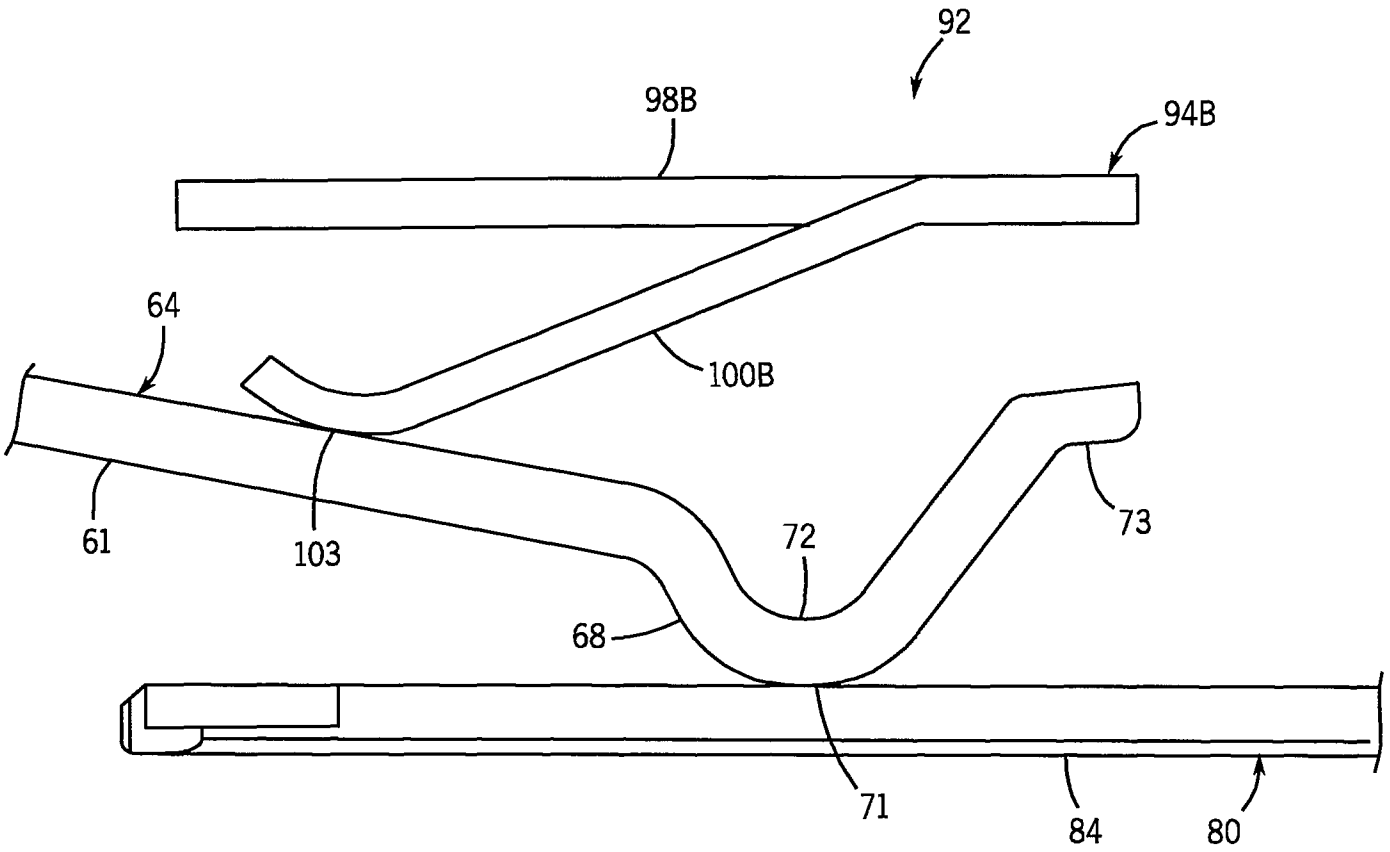
FIG. 3B is a side elevation view of a portion of the electrical connector assembly illustrated in FIG. 3A.

Referring now to FIGS. 3A-B, the electrical connector 52 is illustrated as including an ground coupling assembly 92 in the form of a third example ground shorting bar 94B constructed in accordance with an alternative embodiment. For instance, the third example ground shorting bar 94B has a geometric configuration that is different than that of the ground shorting bars 94 and 94A. In particular, the plate 98B includes alternating first plate portions 99A and second plate portions 99B that have different geometries, and extend over different portions of the respective ground contacts 64. In the illustrated embodiment, the third example ground shorting bar 94B includes additional material disposed between ground contacts 14 with respect to the second example ground shorting bar 94A.

As illustrated, the first plate portions 99A extend over the terminal ends 73 of the ground contacts 64 in the manner described above with respect to the second example ground shorting bar 94A. The legs 100B extend rearward and down from the rear end of the first plate portions 99A, and connect to the ground contacts 64 in the manner described above with respect to the legs 100A of the second example ground shorting bar 94A. The second plate portions 99B extend over the terminal ends 73 along with a portion of the lead portion 61. It should be appreciated that while the third example ground shorting bar 94B is connected to the ground contacts 64 at one connection location 103, the shorting bar 94B could alternatively be connected at more than one location on the ground contacts 64, and at any desired location or locations along the ground contacts 64 in the manner described above. Furthermore, the third ground shorting bar 94B can have any alternative geometrical configuration as described above.

Figure 4:
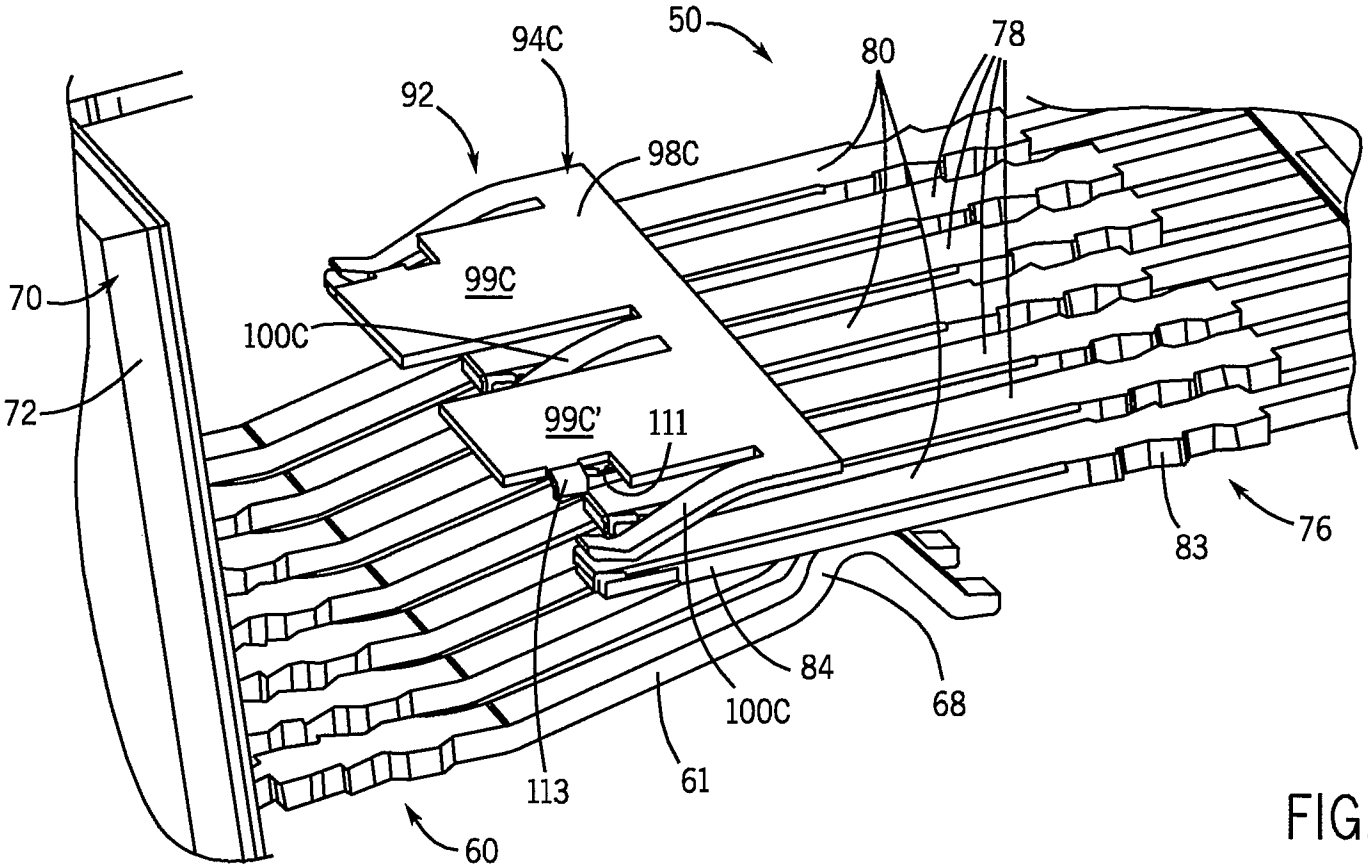
FIG. 4 illustrates the electrical connector as illustrated in FIGS. 1A-D, but including a ground coupling assembly constructed in accordance with an alternative embodiment.

Referring now to FIG. 4, the electrical connector assembly 50 is illustrated as including a ground coupling assembly 92 constructed as a fourth example ground shorting bar 94C that is connected to the ground contacts 80 of the electrical connector 54 as opposed to the ground contacts 64 of the electrical connector 52. The fourth example ground shorting bar 94C includes a plate 98C having first and second plate portions 99C and 99C' constructed similar to the plate 98B of the third example ground shorting bar 94B. The legs 100C extend down and forward from the first plate portions 99C and connect to the terminal ends of the header ground contacts 80. The plate portions 99C and 99C' can each include a notch 111 formed in the outer portions toward the front of the plate portions 99C', and a tab 113 that extends laterally out from the second plate portions 99C'. Of course, when the electrical connector 52 is mated to the electrical connector 54, the ground shorting bar 94C can couple the same ground connections as the ground shorting bars that were directly coupled to the ground contacts 64 of electrical connector 52. While the fourth example ground shorting bar 94C is constructed to have a geometrical configuration similar to that of the third example ground shorting bar 94B, it should be appreciated that the fourth example ground shorting bar 94C could have any desired geometrical configuration, and can be connected to one or more different locations on the ground contacts 80 than illustrated, in the manner described above.

While the ground contacts 80 extend vertically above the ground contacts 64 in the illustrated embodiment, it should be appreciated that the connector 54 can include a ground coupling assembly 92 when the ground contacts 80 extend vertically below the ground contacts 64.

Figure 5:
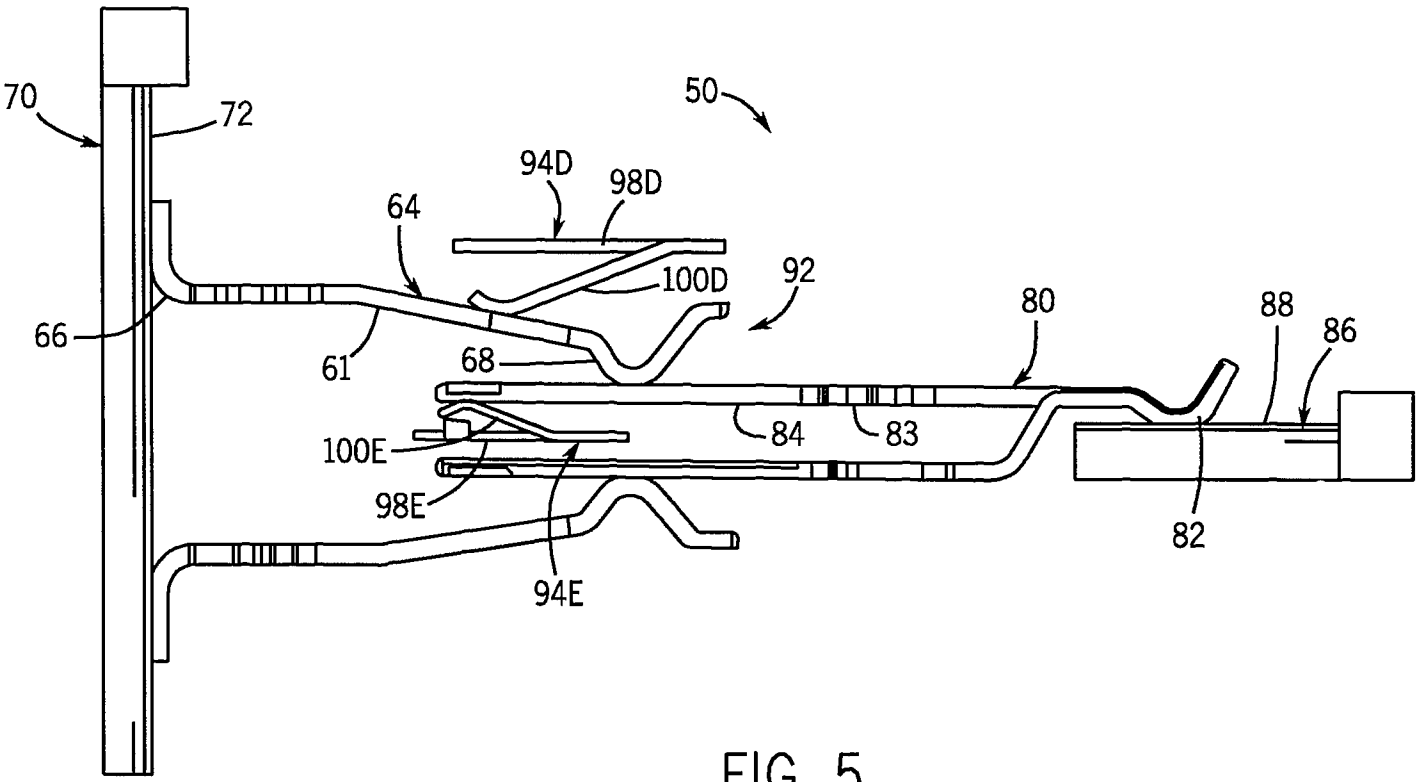
FIG. 5 illustrates the electrical connector as illustrated in FIGS. 1A-D, but including a ground coupling assembly constructed in accordance with an alternative embodiment.
Figure 6B:
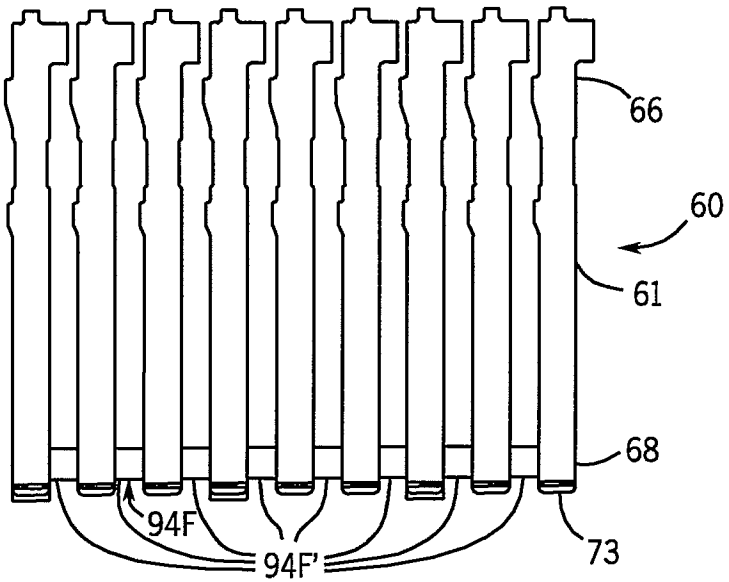
FIG. 6B is a top plan view of the set of electrical contacts illustrated in FIG. 6A.
Figure 6A:
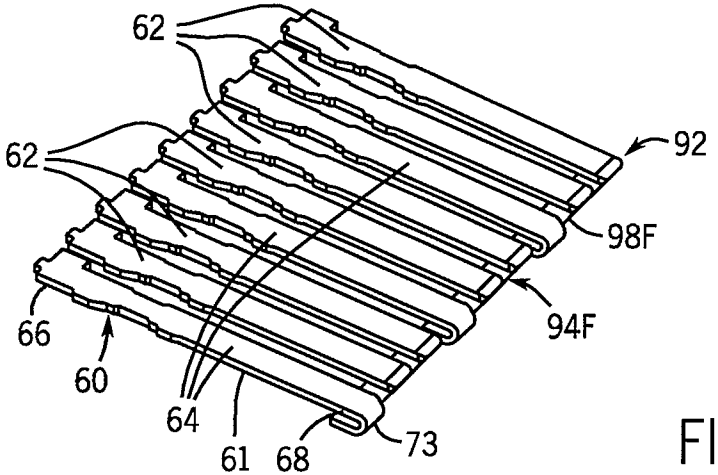
FIG. 6A is a perspective view illustrating a set of electrical contacts usable with an electrical connector assembly, having ground contacts integrally connected to a ground coupling assembly constructed in accordance with an alternative embodiment.
Figure 6C:
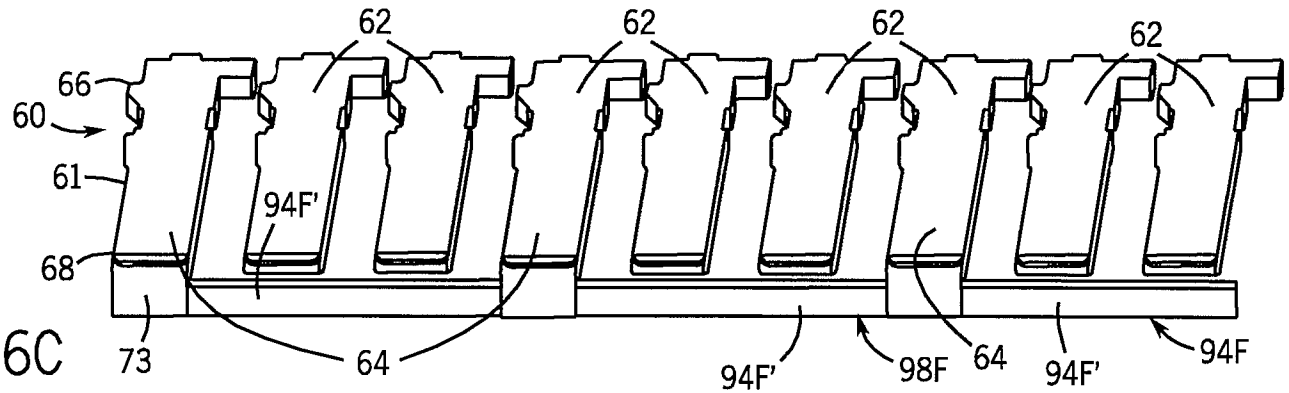
FIG. 6C is a perspective view of the set of electrical contacts illustrated in FIG. 6A.

For instance, referring now to FIG. 5, the electrical connector assembly can include the ground coupling assembly 92 in the form of a pair of ground shorting bars including a fifth example ground shorting bar 94D connected to the ground contacts 64 and a sixth example ground shorting bar 94E connected to the ground contacts 80. The fifth ground shorting bar 94D includes a conductive plate 98D which can be constructed in accordance with any embodiment or alternative described herein, and legs 100D extending rearward and down from the plate 98D and connect to the ground contacts 64 in accordance with any embodiment or alternative described herein. The sixth example ground shorting bar 94E includes a plate 98E which can be constructed in accordance with any embodiment or alternative described herein, and one or more legs 100E extending forward and up from the plate 98E and connect to the ground contacts 80 in accordance with any embodiment or alternative described herein.

While the ground coupling assembly 92 has been illustrated as a ground shorting bar constructed in accordance with various embodiments, it should be appreciated that the ground coupling assembly can be configured as a ground shorting bar that is integrally connected to the ground contacts 64 as illustrated in FIGS. 6A-D. For instance, the terminal ends 73 of the ground contacts 64 defines a bent portion that curves down from the lead portion 61 as illustrated (or could curve upward) into a hairpin turn, such that the distal end of the terminal ends 73 are vertically offset with respect to the terminal ends of the signal contacts 62. A laterally extending seventh example ground shorting bar 94F can include a plate 98F without legs that is directly connected to the terminal ends 73 at a location vertically offset with respect to the signal contacts 62. The seventh example ground shorting bar 94F can be discretely connected to the ground contacts 64 or can be integrally connected to the ground contacts 64 as described above. For instance, the ground shorting bar 94F can be provided as a plurality of segments 94F' that extend between and are coplanar with the terminal ends 73 of the ground contacts 64.

Figure 7:
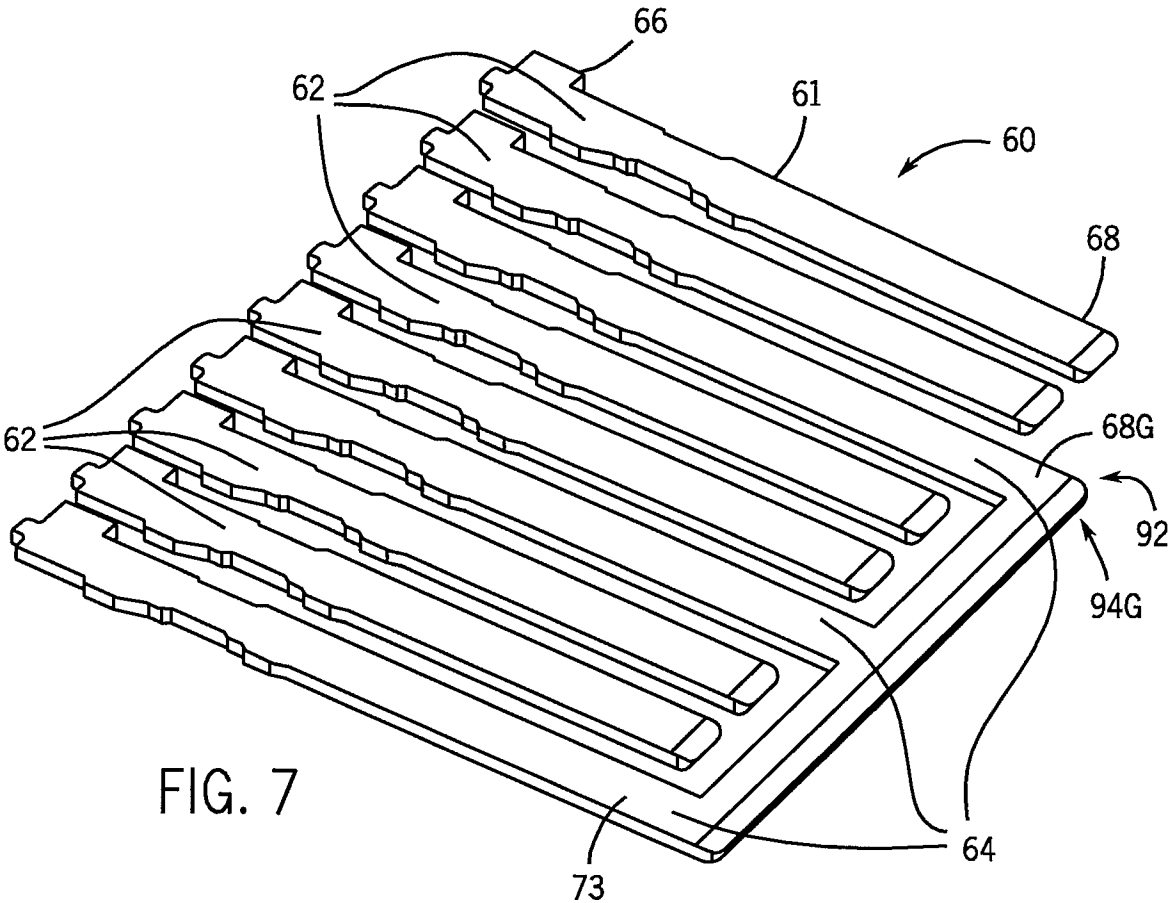
FIG. 7 is a perspective view of a set of electrical contacts having ground contacts integrally connected to a ground coupling assembly constructed in accordance with an alternative embodiment.
Figure 6D:
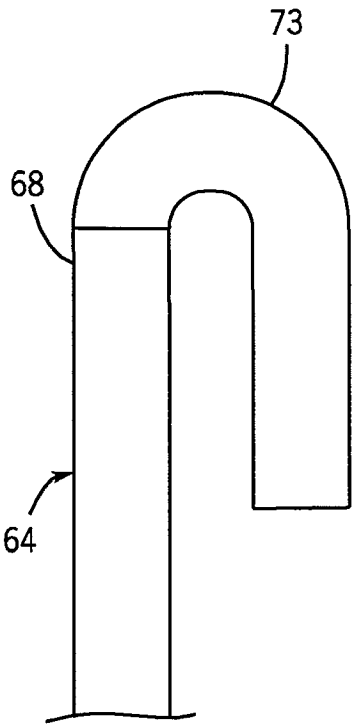
FIG. 6D is a side elevation view of the set of electrical contacts illustrated in FIG. 6A.

It should be further appreciated that the ground coupling assembly 92 can include an eight example ground shorting bar 94 that is spaced longitudinally forward with respect to the signal contacts 62. For instance, as illustrated in FIG. 7, the terminal ends 73 of the ground contacts 64 are spaced longitudinally forward with respect to those of the signal contacts 62. A laterally extending eighth example ground shorting bar 94G can include a plate 98G without legs that is directly connected to the longitudinally forward edges of the terminal ends 73 of ground contacts 64 at a location longitudinally offset, and substantially vertically aligned, with respect to the signal contacts 62.

While the ground coupling assembly 92 has been illustrated and described above in combination with a SAS or SATA connector, or any suitable alternative vertical or mezzanine connector, a ground coupling assembly can further be installed in a right-angle electrical connector, as will now be described.

Figure 8:
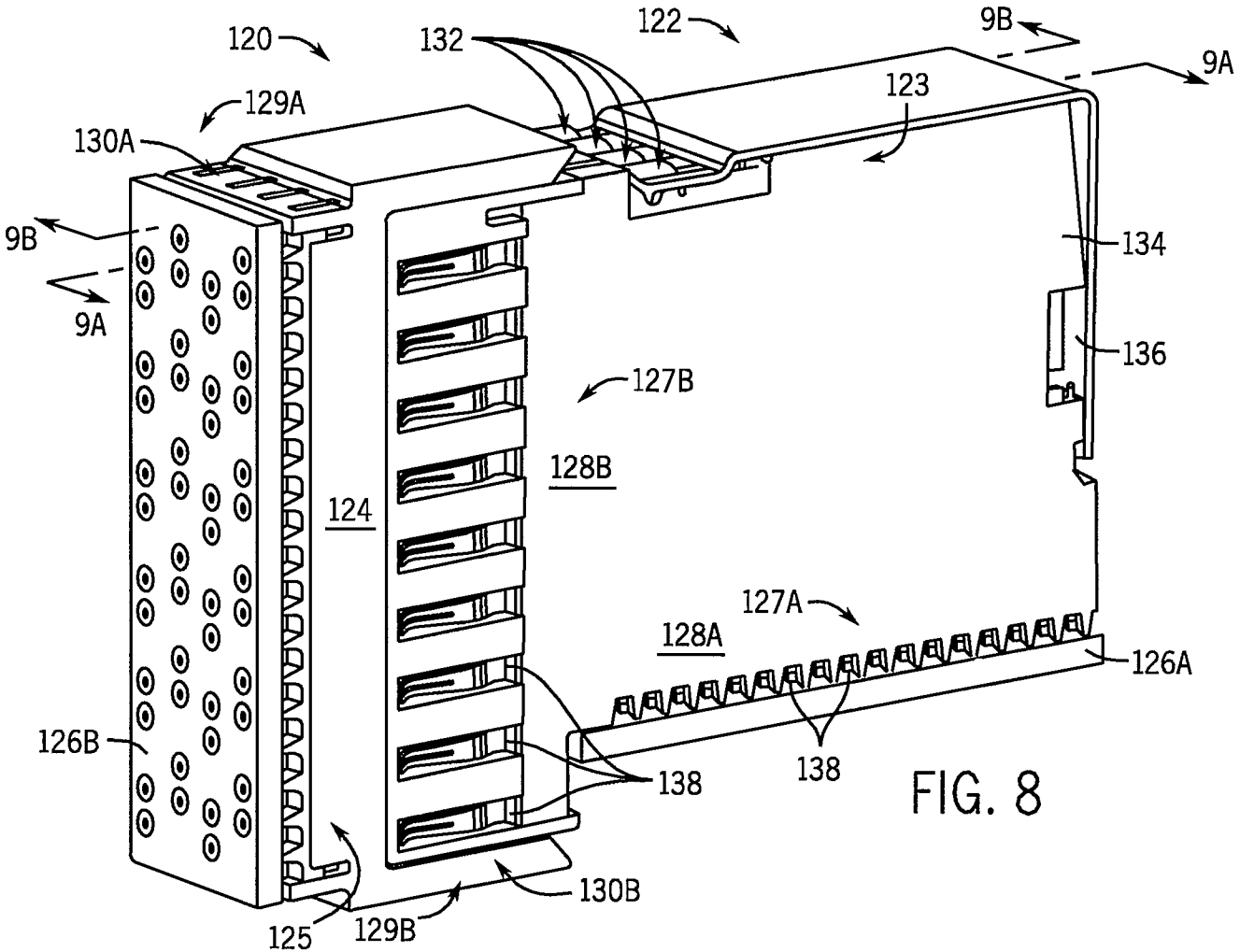
FIG. 8 is a perspective view of a connector assembly constructed in accordance with an alternative embodiment, including an example right angle electrical connector.

Referring now to FIG. 8, a connector assembly 120 includes an example right-angle electrical connector 122 and a header connector 124 configured to be mated with the right-angle connector 122. It should be appreciated that the right-angle connector 122 could alternatively present header contacts that mate with a receptacle connector. The connector assembly 120 may be adapted to electrically connect one electrical component to another electrical component, such as printed circuit boards 126A and 126B, or any desired electronic device such as cables. The header connector 124 may be shielded or shieldless, that is the header connector 124 may include, or may be devoid of, metallic cross-talk shielding material or plates disposed between adjacent first and second connector modules of the type described herein or between arrays of differential signal pairs if the contacts are stitched. While the connector 122 is shown as a right-angle connector, the connector 122 may include other types of connectors, such as a vertical or horizontal electrical connector, or a connector that connects two or more devices oriented at different angles with respect to one another.

The connector 122 may include a connector housing 123, and can have a first end 127A that defines a mounting end 128A and a second end 127B that defines a mating end 128B. Similarly, the header connector 124 may include a connector housing 125, and can have a first end 129A that defines a mounting end 130A and a second end 129B that defines a mating end 130B. The mounting end 128A of the right-angle connector 122 may be adapted to connect to the printed circuit board 126A, and the mounting end 130A of the header connector 124 may be adapted to connect to the printed circuit board 126B. The mating end 128B of the right-angle connector 122 may be adapted to connect to the mating end 130B of the header connector 124. Although the connector 122 is shown as mating with the header connector 124, it will be appreciated that, in other embodiments, the connector 122 may mate directly with the printed circuit board 126B.

The connector 122 may include one or more electrical connector modules 132 which can be provided as insert molded leadframe assemblies (IMLAs). At least one of the modules 132, including all modules, may be shieldless in the manner described above. The connector 122 can be constructed as described in U.S. patent application Ser. No. 11/958,098, the disclosure of which is hereby incorporated by reference as if set forth in its entirety herein. Each connector module 132 may include an insulating or dielectric module housing 134, or IMLA housing. The connector modules 132 may be attached to one another by way of a retaining clip 136, which can be provided in the form of an organizer housing such as the organizer housing 196 described below. Therefore, the connector modules 132, including the electrical contacts therein, may be removably secured within the connector 122. As such, one or more connector modules 132 within the connector 122 may be removed and/or replaced as necessary.

Figure 9B:
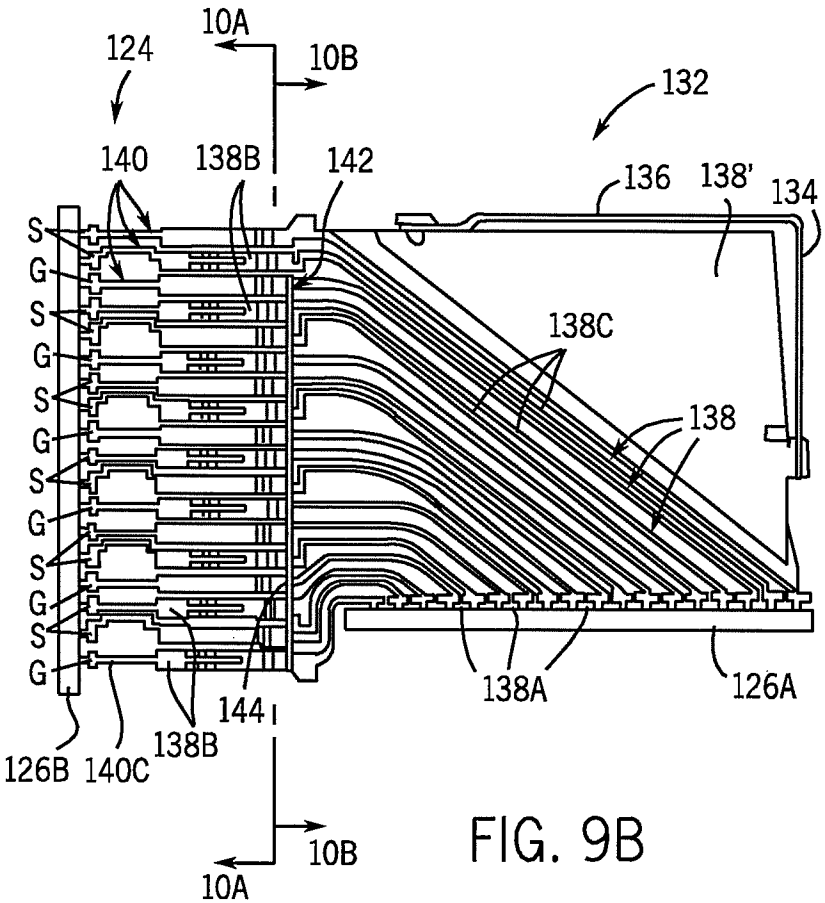
FIG. 9B is a sectional side elevation view of the right angle electrical connector illustrated in FIG. 8 taken along line 9B-9B, showing a connector module.
Figure 9A:
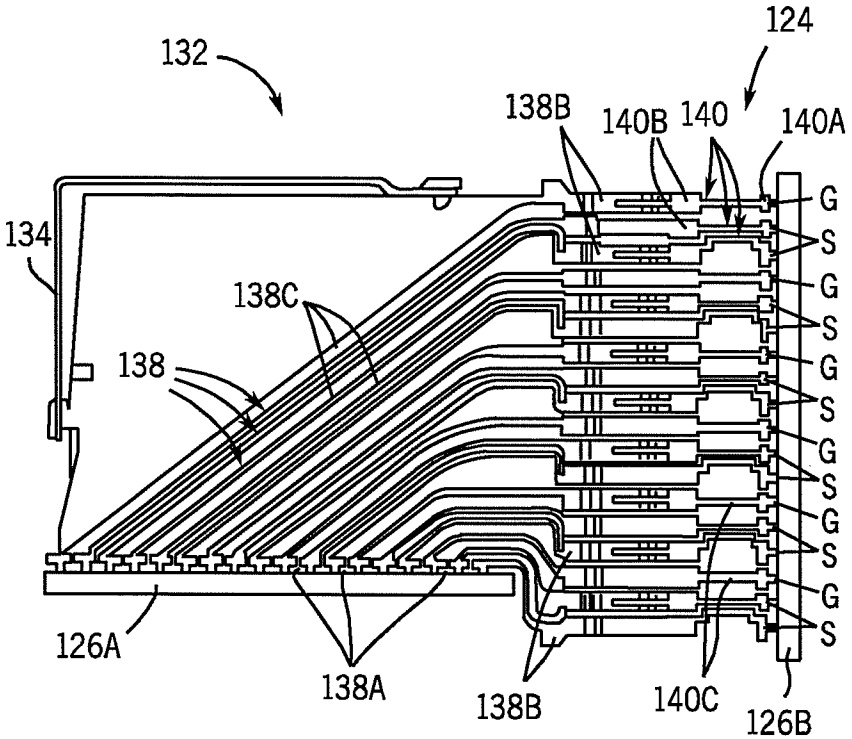
FIG. 9A is a sectional side elevation view of the right angle electrical connector illustrated in FIG. 8 taken along line 9A-9A, showing a connector module.

Referring now also to FIGS. 9A and 9B, each connector module 132 may include a set of one or more right-angle electrical contacts 138. Similarly, the header connector 124 may include one or more vertical electrical contacts 140. Each electrical contact 138 may include a first mounting end 138A, a second mating end 138B, and a lead portion 138C extending between the first end 138A and the second end 138B. Each electrical contact 140 may include a first end 140A, a second end 140B, and a lead portion 140C extending between the first end 140A and the second end 140B.

The first end 138A of the electrical contact 138 may include any suitable terminal for establishing an electrical and mechanical connection with the printed circuit board 126A. For example, the mounting end 138A may include a solder ball that is soldered to a solder pad on the printed circuit board 126A. In addition, the mounting end 138A may be a compliant end configured to be inserted into a plated through-hole of the printed circuit board 126A. Like the first end 138A, the first end 140A of the electrical contact 140 may also include any suitable terminal for establishing an electrical and mechanical connection with the printed circuit board.

The mating end 138B of each electrical contact 138 may be received within the connector housing 123. The mating end 138B of each electrical contact 138 may include any suitable mating end for establishing an electrical and mechanical connection with the second end 140B of the electrical contact 140 of the header connector 124. For example, as shown in FIGS. 8, 9A and 9B, the mating end 138B of each electrical contact 138 may define two flexible beams, or tines, that form a dual-beam mating end that engages with the second end 140B, which may be a blade-shaped mating end. The dual-beams of the mating end 138B may contact the same side of the mating end 140B or opposing sides of the mating end 140B. Moreover, as further shown in FIGS. 9A and 9B, the dual-beams of one of the electrical contacts 138 may extend from the respective lead portion 138C on one side of the connector module 132 while the dual-beams of an adjacent electrical contact 138 may extend from the respective lead portion 138C on the opposite side of the connector module 132. That is, adjacent dual beams of the electrical contacts 138 in a particular connector module 132 may be arranged on alternating sides of the connector module 132. However, any suitable mating configuration may be provided while remaining consistent with one or more embodiments.

With continuing reference to FIGS. 9A and 9B, the electrical contacts 138 may include signal contacts (S) and ground contacts (G). Adjacent signal contacts (S) may form a differential signal pair. Adjacent differential signal pairs in the connector module 132 may be separated by a ground contact (G). The connector module 132 may include a connecting element, such as a ground coupling assembly 142 that can be provided as a ground clip or ground shorting bar 144. The ground shorting bar 144 may interconnect one or more ground contacts G in the connector module 132. The ground shorting bar 144 may extend, or be arranged, on one side of the connector module 132, and may be accommodated within the module housing 134, which can be overmolded onto the contacts 138.

Though adjacent signal contacts (S) have been described as forming differential signal pairs, it will be appreciated that the electrical contacts 138 of each connector module 132 may also be arranged for single signal applications. For example, the signal contacts (S) and the ground contacts (G) may be arranged or designated in the connector module 132 such that adjacent signal contacts (S) in the connector module 132 may be separated by a ground contact (G) in an S-S-G configuration.

Figure 10A:
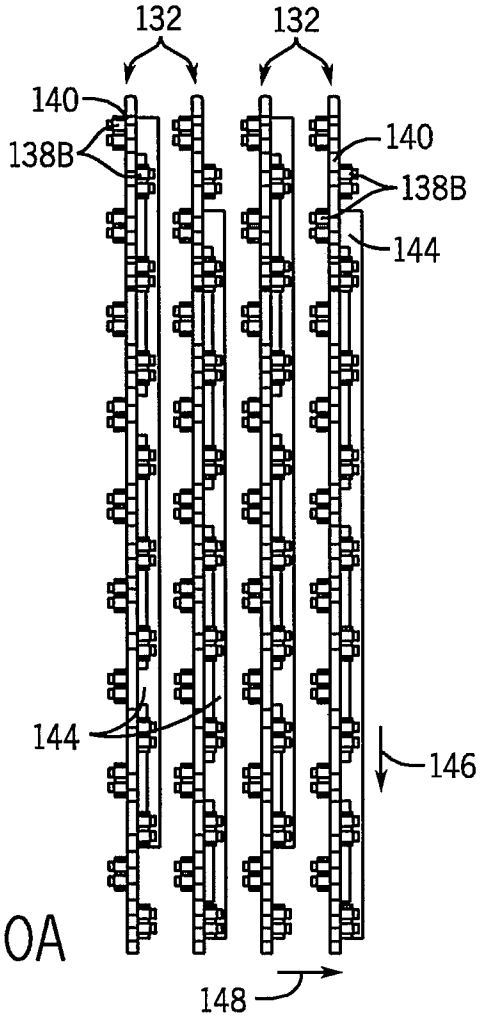
FIG. 10A is a sectional side elevation view of the right angle electrical connector illustrated in FIG. 9B taken along line 10A-10A, showing the mating end of the right angle connector.
Figure 10B:
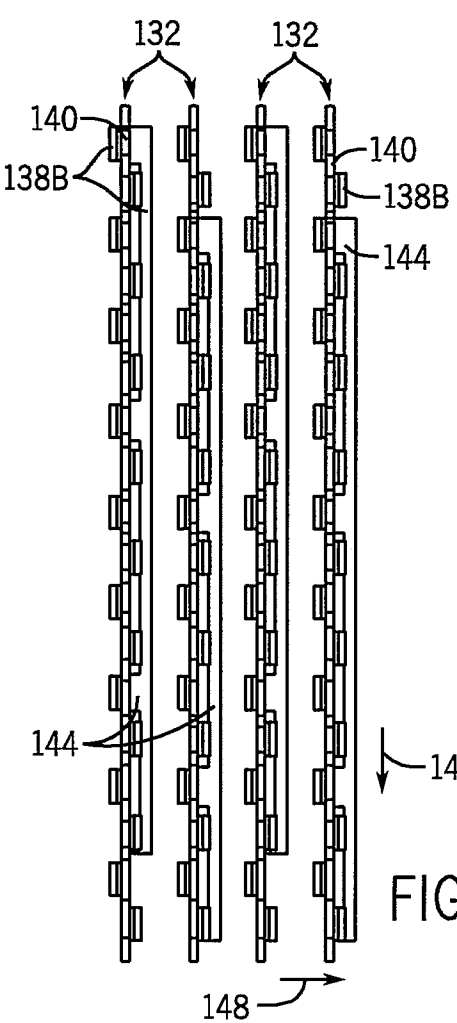
FIG. 10B is a sectional side elevation view of the right angle electrical connector illustrated in FIG. 9B taken along line 10B-10B, showing the mating end of the right angle connector.

Referring now to FIGS. 10A and 10B, the connector modules 132 in the connector 122 may be arranged side-by-side and substantially parallel to one another. In addition, the connector 122 may be devoid of metallic ground plates extending between, or adjacent, to one or more connector modules 132 along a plane that is generally parallel to the plane defined by the connector modules 132. The connector modules 132 may be held in their respective positions by the retaining clip 136. The configuration of the electrical contacts 140 in the header connector 124 may generally correspond to the configuration of the electrical contacts 138 in the connector 122 to accommodate the relative orientation of the connector modules 132. Although the connector 122 is depicted as having four connector modules 132, the connector 122 may include any suitable number of connector modules 132 while remaining consistent with one or more embodiments.

The electrical contacts 138 may be arranged in a linear array within each connector module 132 along a first direction 146. The electrical contacts 138 may also be arranged in a linear array across adjacent connector modules 132 along a second direction 148. The second direction 148 may define a non-zero angle (e.g., 90 degrees) with the first direction 146. The dimensions (e.g., width, length and height) of the electrical contacts 138, the spacing between adjacent electrical contacts 138 within a particular connector module 132, and the spacing between adjacent electrical contacts 138 in adjacent connector modules 132, may each be optimized to minimize cross talk and to match the impedance to a desired system impedance.

The retaining clip 136 may be electrically insulating and, therefore, may assist with the EMI shielding of the connector 122. For example, the retaining clip 136 may be made of a conductive material. In addition, the retaining clip 136 may be floating or grounded. For example, as shown in FIG. 9A, the retaining clip 136 may be grounded via a connection to one of the ground contacts (G) in the connector module 132. Alternatively, as shown in FIG. 9B, the retaining clip 136 may be grounded via a connection to a separate ground contact 138'. The ground contact 138' may be used to tune an impedance of an adjacent signal contact or differential signal pair.

In some embodiments, as shown in FIGS. 10A and 10B, the ground shorting bar 144 may be connected to each ground contact (G) in the connector module 132. As such, the ground shorting bar 144 may be connected to ground via the ground contacts (G).

Figure 10C:
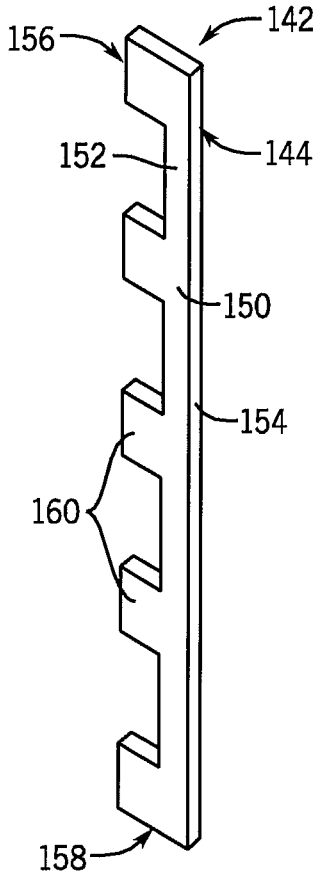
FIG. 10C is a perspective view of an example ground coupling assembly used in the connector assembly.

Referring now to FIG. 10C, the ground shorting bar 144 defines a conductive body portion 150 that presents a broadside 152 and an edge 154. The body portion 150 extends from a top portion 156 to a bottom portion 158. When positioned in the connector 122, the body portion 150 of the ground shorting bar 144 may extend generally parallel to the linear array of electrical contacts 138 in the connector module 132, and the broadside 152 of the ground shorting bar 144 may extend substantially perpendicular to the linear array of electrical contacts 138. The ground shorting bar 144 may also include one or more projections 160 extending from the body portion 150. The projections 160 may be used to connect the ground shorting bar 144 to the ground contacts (G) in the connector module 132. The ground shorting bar 144 may be housed within the module housing 134 of the connector module 132.

It should be appreciated that the ground shorting bar 144 can connect to the ground contacts (G) in various configurations and/or arrangements (e.g., horizontal, vertical, diagonal, etc.). The ground shorting bar 144 may be connected to each ground contact (G) in the connector module 132, or may be connected to less than all of the ground contacts (G) in the connector module 132. Each ground contact (G) in the connector 122 may define an electrical path that extends from the mounting end 138A to the mating end 138B of the ground contact (G). As shown in FIGS. 11A-D, the ground shorting bar 144 may be connected to the lead portion 139C of the ground contacts (G), between the mounting end 138A and the mating end 138B. In addition, the position of the ground shorting bar 144 along the lead portion 138C of the ground contact (G) may divide the electrical path of the ground contact (G) into unequal portions.

Figure 11A:
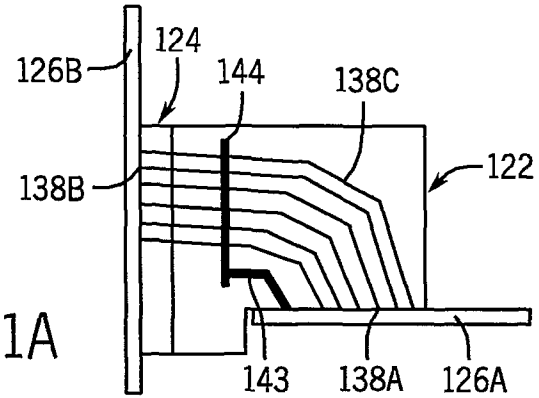
FIGS. 11A-D are schematic views depicting various arrangements of one or more ground shorting bars in the right angle connector.

Referring to FIG. 11A in particular, the electrical path of the ground contact (G) may define a first portion that extends between the mounting end 138A and the ground shorting bar 144. The electrical path may further define a second portion that extends between the ground shorting bar 144 and the mating end 138B. As further shown in FIG. 11A, the first portion of the electrical path may be longer and than the second portion of the electrical path. Conversely, in other embodiments, the first portion of the electrical path may be shorter than the second portion of the electrical path.

Figure 11B:
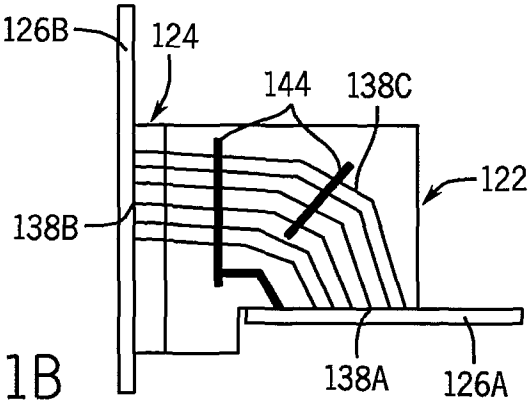
Figure 11C:
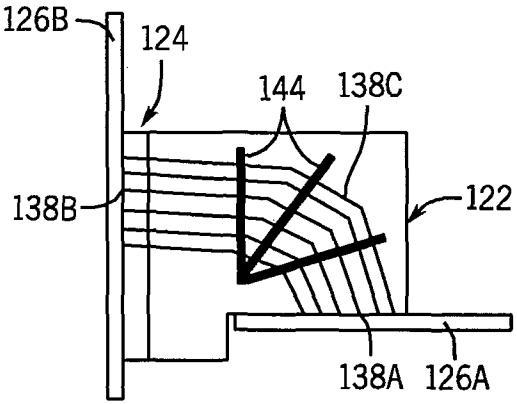
Figure 11D:
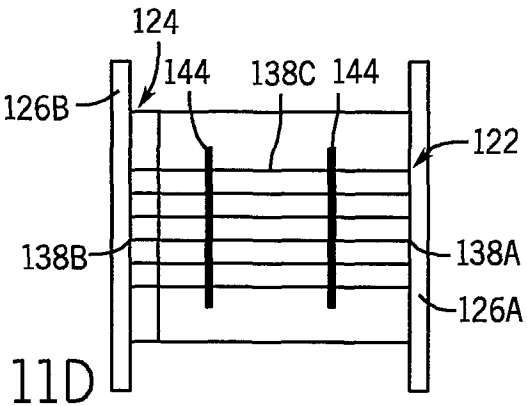
Figure 13:
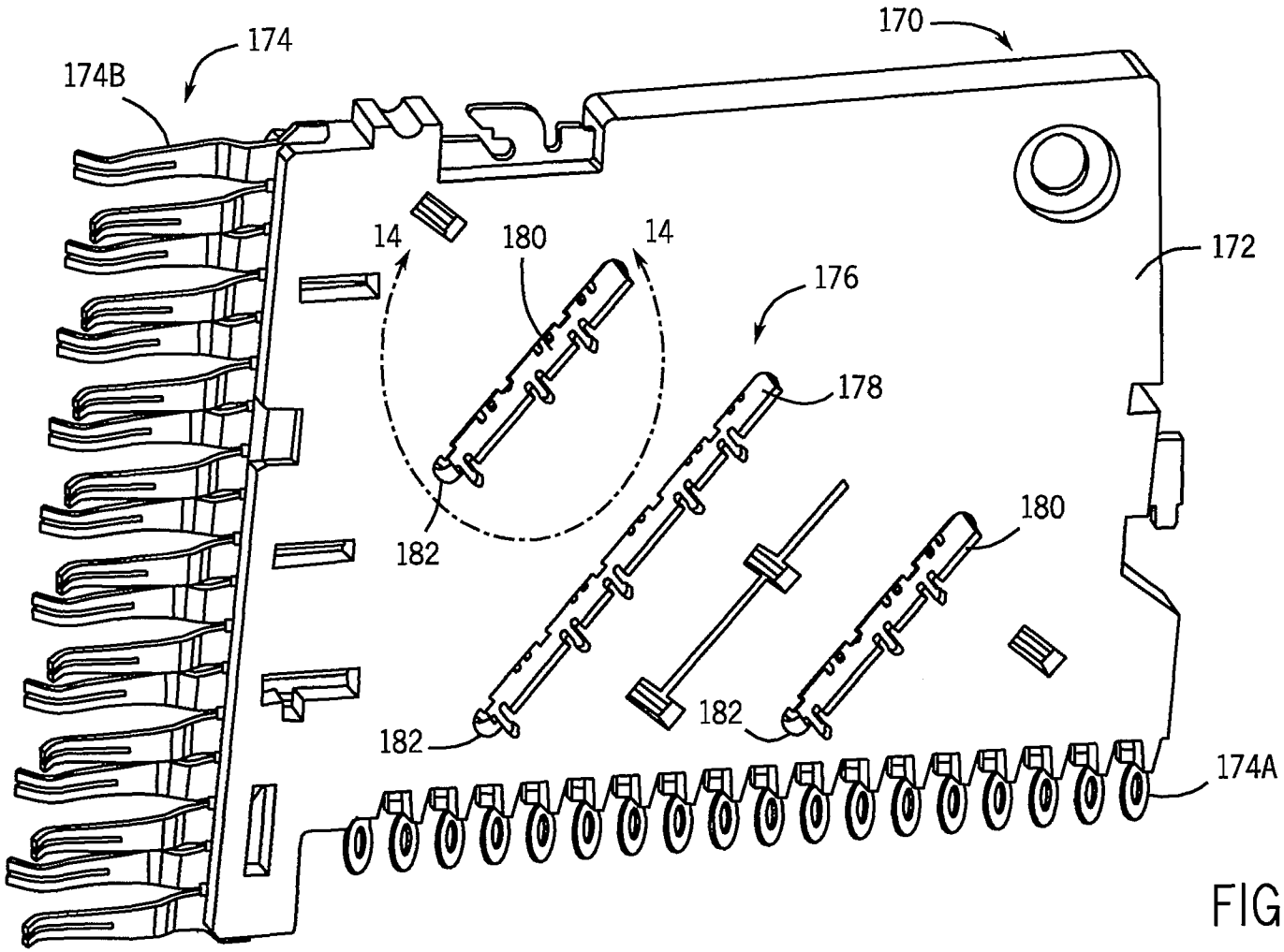
FIG. 13 is a perspective view of an electrical connector module configured for installation in a right-angle electrical connector, the electrical connector module including a ground coupling assembly constructed in accordance with an alternative embodiment.
Figure 14:
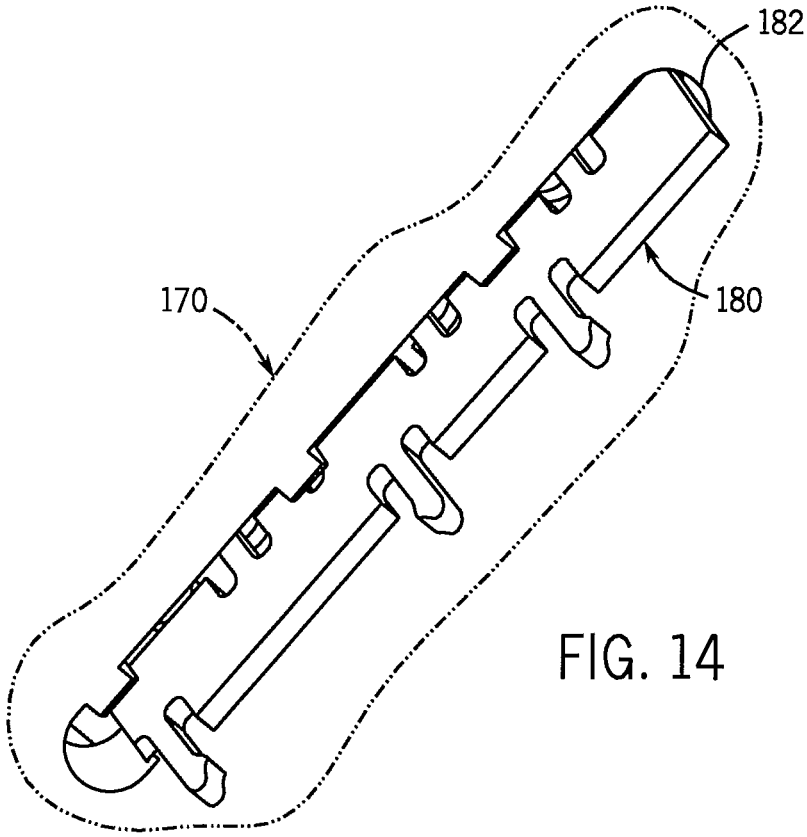
FIG. 14 is an enlarged view of a ground shorting bar that partially forms the ground coupling assembly illustrated in FIG. 13, taken along line 14-14.
Figure 16:
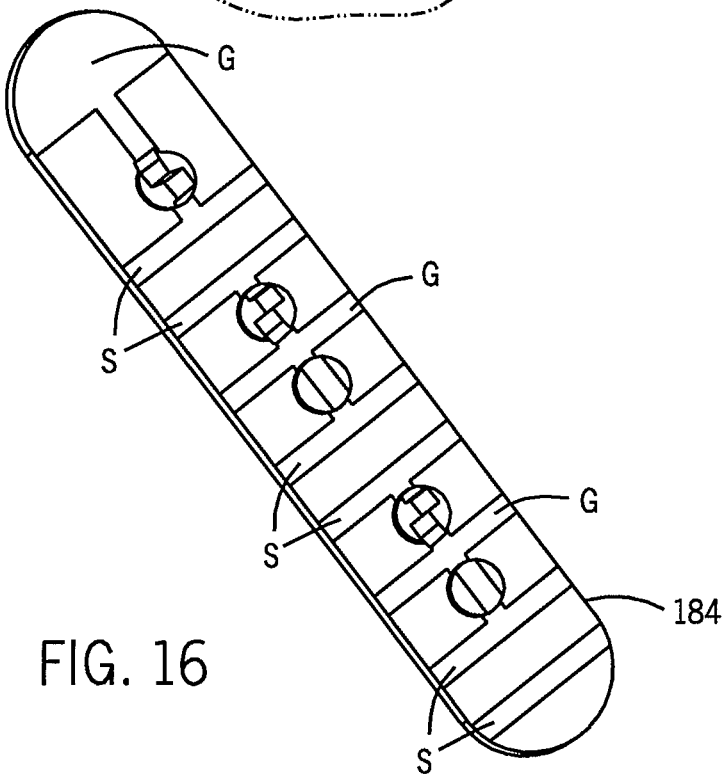
FIG. 16 is a close-up view of a portion of the connector module illustrated in FIG. 15 taken along line 16-16.
Figure 15:
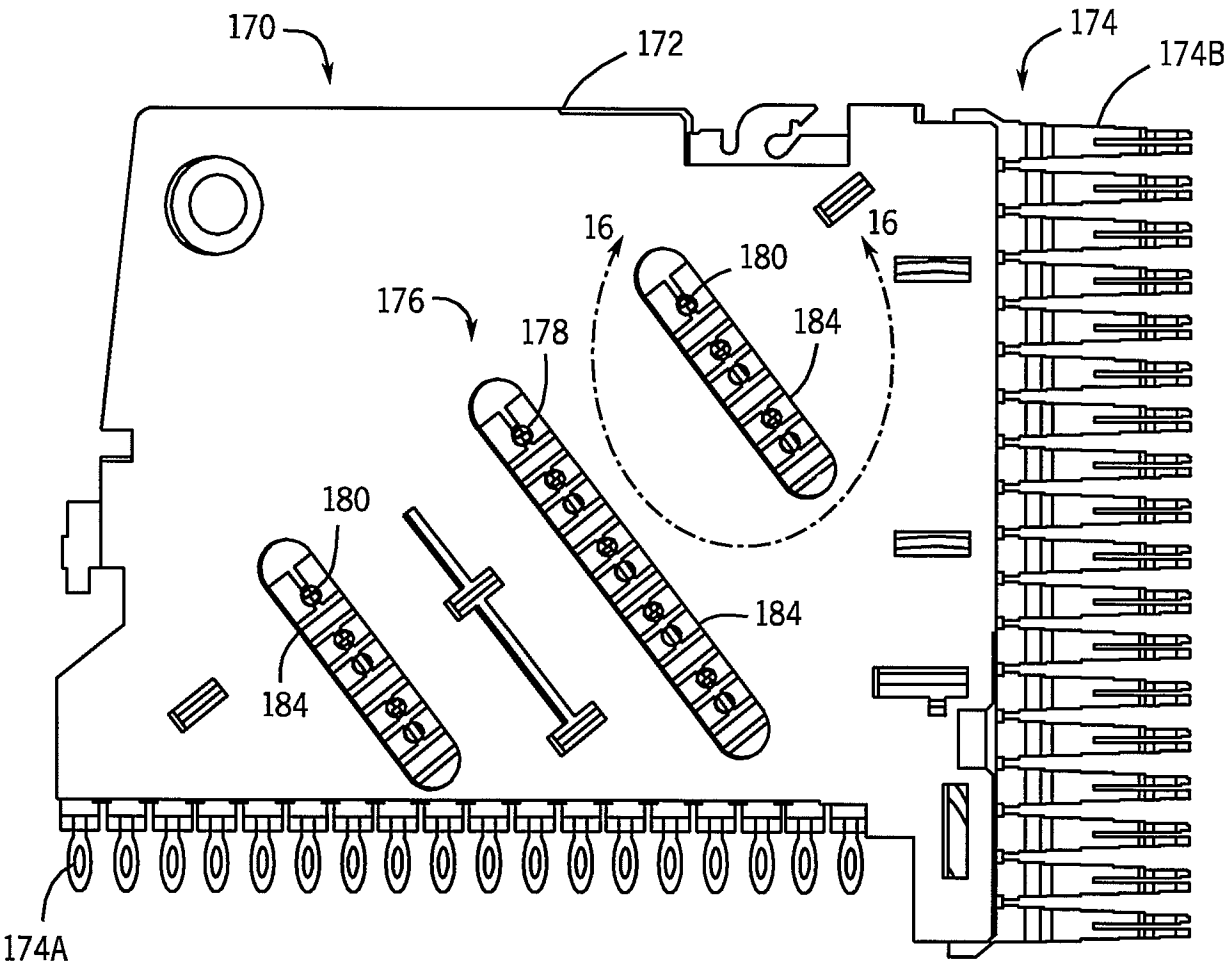
FIG. 15 is a reverse perspective view of the connector module illustrated in FIG. 13.

As shown in FIGS. 11B-D, the electrical path of the ground contact (G) may be divided into more than two portions by connecting one or more ground shorting bars 144 at multiple positions along the length of the ground contact (G).

By dividing the overall electrical path of the ground contact (G) into relatively shorter portions, it is believed that the fundamental wavelength for resonant signals, and thus that of higher harmonics thereof, is reduced, thereby shifting the resonance to higher frequencies. Particular resonances may further be prevented, or the frequency shifted, by applying additional ground shorting bars 144 to further divide the electrical path of the ground contact (G) into additional portions.

The ground shorting bar 144 may be connected to the ground contacts (G) in the connector module 132 by any suitable means, such as by soldering or a clamping mechanism. In addition, one or more ground shorting bars 144 may be at least partly accommodated in the connector module 132 by being fit or integrated in or onto the insulating material of the connector module 132.

As shown in FIG. 11A, the ground shorting bar 144 may be in direct connection with the printed circuit board 126A via a contact portion 143. This may reduce a length of the electrical path between the ground shorting bar 144 and a grounding portion on the printed circuit board 126A.

The ground shorting bar 144 may define any suitable shape, such as an L-shape, a U-shape, V-shape, etc. If the connector 122 includes two or more ground shorting bars 144, the ground shorting bars 144 may be arranged in any suitable orientation. For example, as shown in FIG. 11B, one of the ground shorting bars 144 may extend in direction that is transverse to the other ground shorting bar 144. As shown in FIG. 11C, the ground shorting bars 144 may form a series of spokes that originate from a common hub. As shown in FIG. 11D, the ground shorting bars 144 may extend substantially parallel to one another. Dividing the electrical path of each ground contact (G) into unequal portions may substantially prevent, minimize, or shift resonances.

The length of the electrical path of each electrical contact 138 may depend on the physical parameters (e.g., dimensions, materials, etc.) of the electrical contact 138 and any nearby contacts and any nearby dielectric materials. Generally, it has proven advantageous to provide air as the main dielectric material for high-speed connectors (e.g., by providing the module housing 134 with one or more openings between adjacent connector modules 132 and between adjacent electrical contacts 138 in each connector module 132, and to reduce shielding material. Thus, the ground shorting bar 144 may be relatively small. For example, the dimensions of the ground shorting bar 144 may be the same or similar to the dimensions of the electrical contacts 138.

Figure 12:
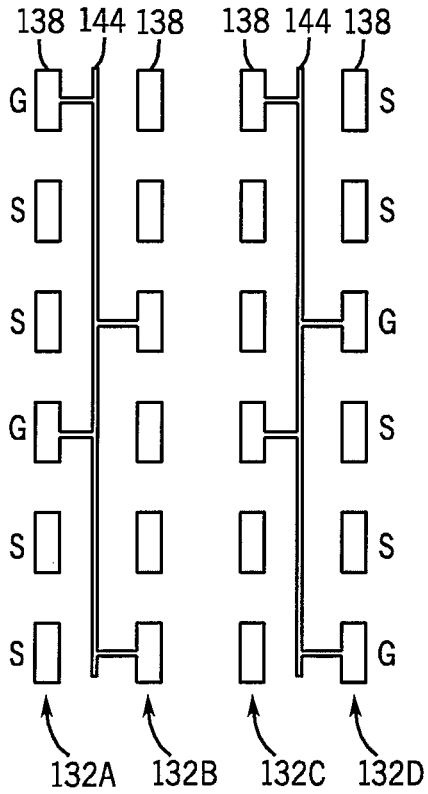
FIG. 12 is a cross sectional view of the right angle connector illustrating a ground shorting bar according to another embodiment.

Referring now to FIG. 12, the ground coupling assembly 142 can include a ground shorting bar 144 of the type described above connected to ground contacts (G) in adjacent connector modules 132. Moreover, the differential signal pairs in one connector module 132 may be offset from the differential signal pairs in an adjacent connector module 132 along the direction of the linear array of electrical contacts 138. That is, the ground coupling assembly 142 can be configured to electrically connect ground contacts G of different connector modules when each connector module 132 includes different ground-signal contact patterns than one or more other connector modules. The electrical contacts 138 in the connector module 132*a* may be arranged G, S, S, G, S, S, the electrical contacts 138 in the connector module 132*b* may be arranged S, S, G, S, S, G, the electrical contacts 138 in the connector module 132*c* may be arranged G, S, S, G, S, S, and the electrical contacts 138 in the connector module 132*d* may be arranged S, S, G, S, S, G.

Furthermore, it is appreciated that a kit can be provided that includes a first and a second connector housing of the type described herein, or a plurality of connector housings. Each housing retains a plurality of signal contacts and ground contacts. The housings can be similarly, substantially identically, or identically constructed. The kit can further include a ground coupling assembly that is carried by each housing, and electrically connected to at least two ground contacts of the housing, wherein the ground coupling assembly has a different configuration in the first housing than in the second housing, and the different configuration causes the signal contacts retained in the first housing to achieve at least one differing performance characteristic with respect to the signal contacts retained in the second housing. The performance characteristic can include resonant frequencies of differential return loss, and/or different resonant frequencies of differential insertion loss, and/or different resonant frequencies of near end and/or far end differential cross talk. The housings in the kit can be configured for installation in an electrical connector, such as a SAS connector, a SATA connector, or a right-angle connector. The connector can thus be a vertical, mezzanine, or a right-angle connector. Alternatively, the kit can include a first and a second electrical connector that includes the first and second housings, respectively, or a plurality of electrical connectors that includes a plurality of housings. One or more connectors in the kit can be vertical, mezzanine connectors, and/or right-angle connectors, and can be header and/or receptacle connectors. It should be appreciated that the electrical connectors provided in the kit can be retrofitted into an existing electrical connector assembly without changing the dimensions of either connector, thereby replacing a previous electrical connector in the electrical connector assembly.

Accordingly, a preexisting connector having a footprint, height, depth, and mating interface that operates at a commercially acceptable speed at no more than 6% crosstalk at a 40 ps rise time or another speed according to an existing standard can be modified or replaced by a connector of any type described herein having a ground shorting assembly to produce a replacement connector having the same footprint, height, and mating interface as the preexisting connector (e.g., externally identical). Furthermore a connector of any type described herein can be configured to operate at a speed that is higher than that of the preexisting connector at no more than 6% crosstalk, while shifting resonant frequencies to levels that are higher than that of the operating frequency, and higher than the preexisting resonant frequency at the preexisting speed. An existing connector that does not meet the IEEE 802.3ap insertion loss over a frequency domain cross talk ratio can be modified or replaced to produce an externally identical connector as described herein to produce a replacement connector that meets the IEEE cross talk standard IEEE 802.3ap. Examples of resonant frequencies that can be shifted include differential return loss, differential insertion loss, near end differential crosstalk, and far end differential cross talk.

It should also be appreciated that a method can be provided for tuning an electrical connector to a desired performance characteristic, which can include desired resonant frequencies of differential return loss, and/or desired resonant frequencies of differential insertion loss, and/or desired resonant frequencies of near end differential cross talk, and/or desired resonant frequencies of far end differential cross talk. The method can include the steps of providing an electrical connector having a dielectric housing that retains a set of electrical contacts. The electrical contacts can include a plurality of signal contacts and a plurality of ground contacts. The method can further include installing a ground coupling element, for instance one or more ground shorting bars, into the connector. The installing step can include attaching one or more ground shorting bars to some or all ground contacts in the connector. Differently geometrically configured ground shorting bars can be installed, and connected to different locations of the ground contacts, until the desired performance characteristic is achieved.

Referring now to FIGS. 13-16, a plurality of electrical connector modules, such as an electrical connector module 170, is configured to be installed into a right-angle connector, such as the connector 122 described above. The electrical connector module 170 can be provided as an insert molded leadframe assemblies (IMLA) constructed as described in U.S. patent application Ser. No. 11/958,098, the disclosure of which is hereby incorporated by reference as if set forth in its entirety herein.

The connector module 170 may include an insulating or dielectric connector module housing 172 that retains a plurality of right-angle electrical contacts 174. Each electrical contact 174 may include a first mounting end 174A, a second mating end 174B, and a lead portion 174C (see FIGS. 27A-B) extending between the first end 174A and the second end 174B. The mounting end 174A of the electrical contact 174 may include any suitable terminal for establishing an electrical and mechanical connection with an electrical device. For example, the mounting end 174A may include a solder ball that is soldered to a solder pad on the electrical device. In addition, the mounting end 174A may be a compliant end configured to be inserted into a plated through-hole of the electrical device. The mating end 174B of each electrical contact 174 may include any suitable mating end for establishing an electrical and mechanical connection with a complementary connector, for instance a header connector 124 of the type described above. Alternatively, the mating ends 174B can electrically connect directly to an electrical device. As illustrated, the mating ends 174B of the contacts 174 are arranged as receptacle contacts configured to receive mating header contacts. It should be appreciated, however, that the mating ends 174B could alternatively define a blade-shaped mating end.

The connector module 170 includes a ground coupling assembly 176 that includes a first ground shorting bar 178 and a second ground shorting bar 180 configured to electrically connect certain ground contacts. The second ground shorting bar 180 has a length that is shorter than that of the first ground shorting bar 178. The connector module 170 is illustrated as including a pair of the second ground shorting bars 180 disposed proximate to the mounting end 174A and the mating end 174B of the contacts 174, and the first ground shorting bar 178 is disposed between the second ground shorting bars 180. Because the first ground shorting bar 178 is longer than each of the second ground shorting bars 180, the first ground shorting bar 178 is configured to electrically connect a greater number of ground contacts than the second ground shorting bars 180. It should be appreciated, however, that the connector module 170 can include any number of ground shorting bars having different geometrical configurations as desired. For instance, the connector module 170 could include only one of the second ground shorting bars 180, only the first ground shorting bar 178, or a combination of the first ground shorting bar 178 and one second ground shorting bar 180.

Figure 17:
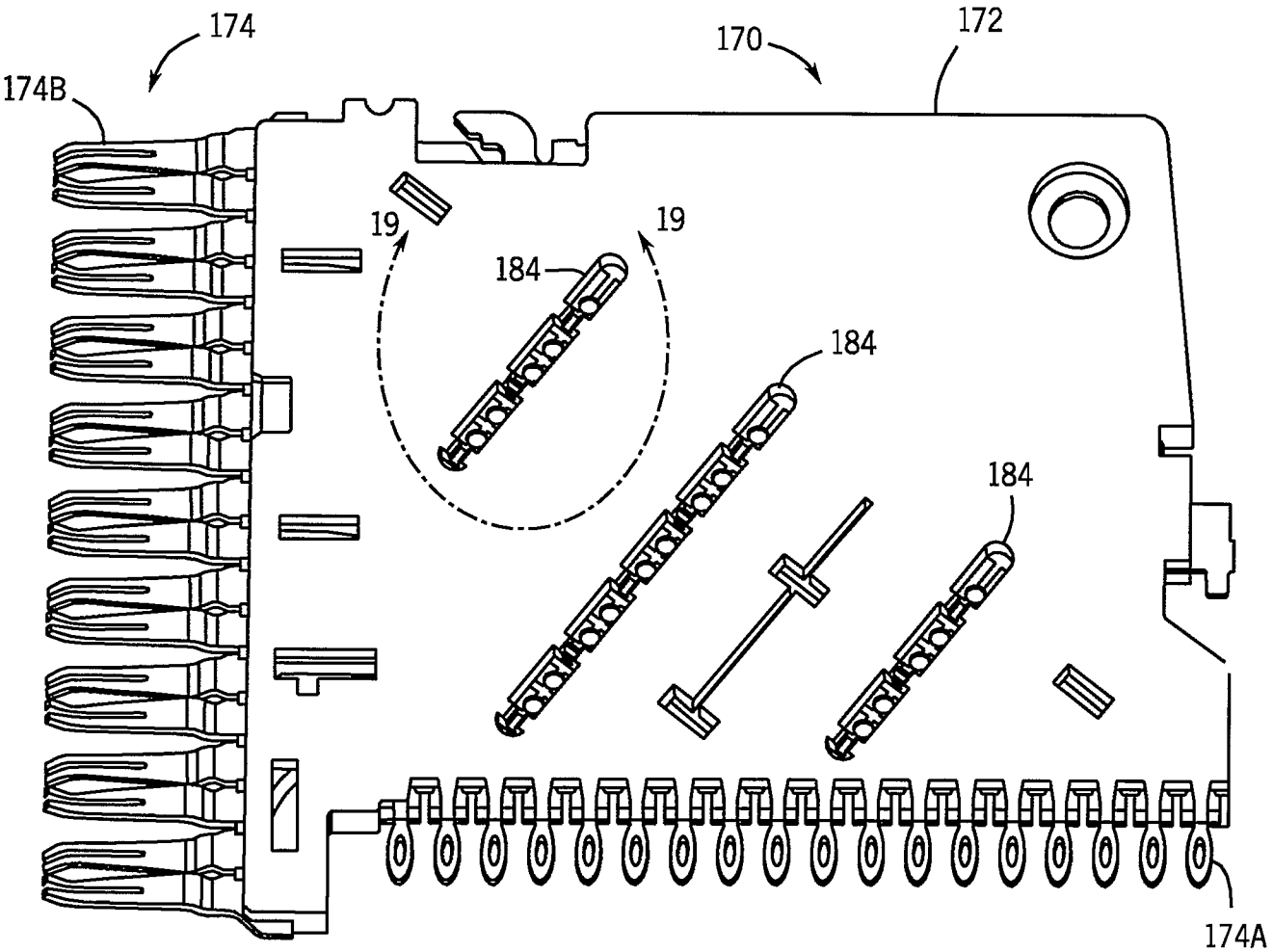
FIG. 17 is a perspective view of the electrical connector module illustrated in FIG. 13 but prior to installation of the ground coupling assembly.
Figure 18A:
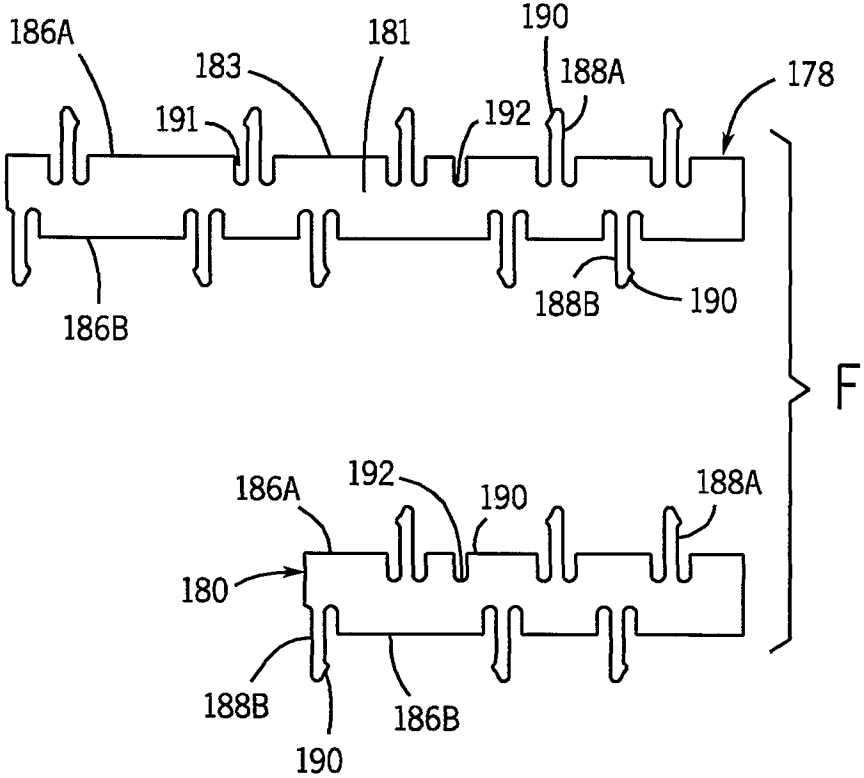
FIGS. 18A-C illustrate ground shorting bars configured for attachment to an electrical connector module.
Figure 18B:
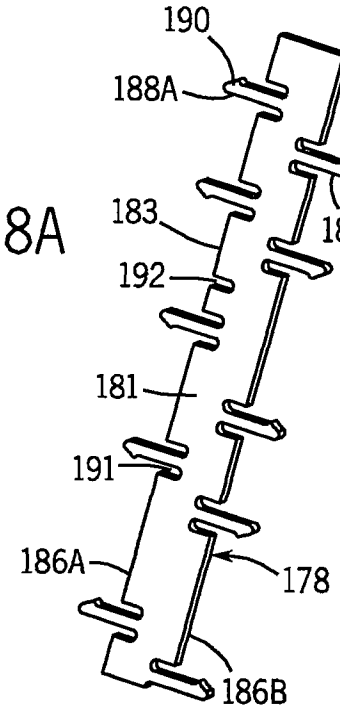
Figure 18C:
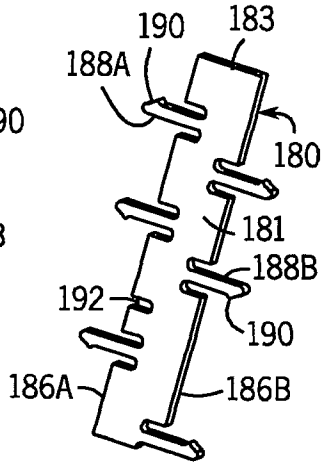
Figure 19:
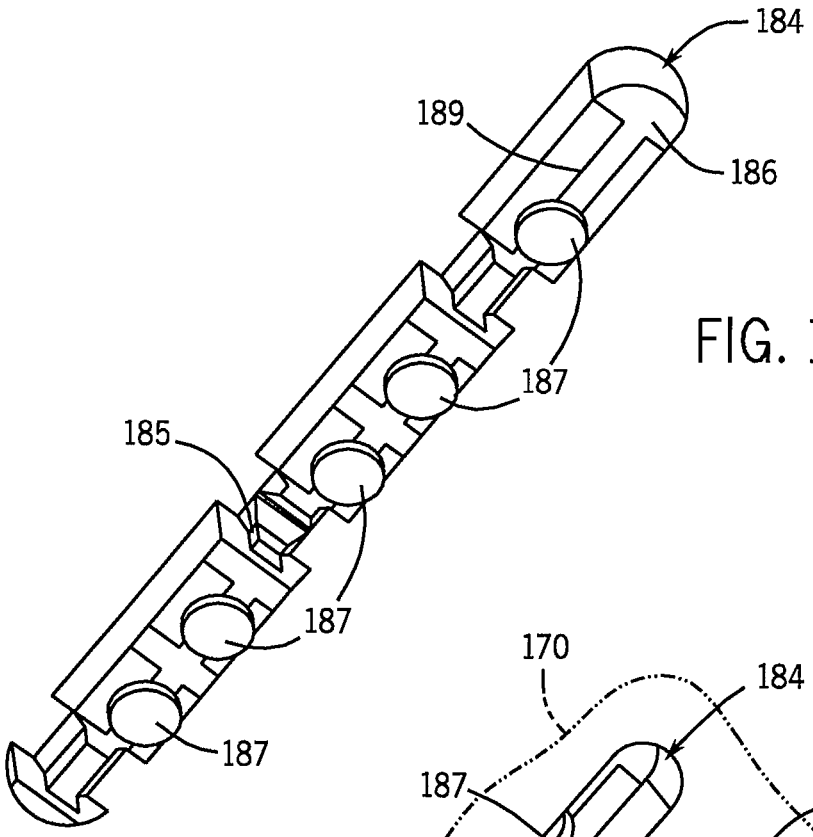
FIG. 19 is a close-up view of a portion of the electrical connector module illustrated in FIG. 17, taken along line 19-19.

Referring now to FIGS. 17-19, the connector module housing 172 includes one or more, for instance a plurality of, openings in the form of slots 182, thereby causing the portions of the electrical contacts aligned with the slots 182 to be exposed to the ambient environment. The slots 182 can have any desired length, and as illustrated one slot 182 has a length greater than the other two slots. The ground coupling assembly can further include an insert 184 that is configured to be installed into each of the slots 182. Each insert 184 can be insulating such that installation of the insert 184 into the slots 182 does not electrically connect the electrical contacts. Alternatively, each insert 184 can be conductive so long as the inserts 184 do not contact the electrical signal contacts when the insert 184 is installed. Each insert 184 can have a length substantially equal to the slots 182 in which the insert 184 is installed, and can be press-fit into the corresponding slots 182. Alternatively, the insert 184 can be mechanically fastened to the connector module housing 172 in any desired manner.

As shown in FIG. 19, each insert 184 includes a longitudinally elongate insert body 186 and a plurality of apertures 187 extending through the insert body. The apertures 187 are cylindrical in shape, or can define any alternative geometric configuration. The apertures 187 are spaced so as to be aligned with the electrical contacts of the connector module 170 when the insert 184 is installed in the connector module housing 172. Alternatively, the insert 184 could define apertures 187 that are sized and spaced so as to be aligned with only ground contacts as opposed to all contacts when the insert 184 is installed. The insert body 186 can carry an outwardly protruding locating rib 185, and a slot 189 is recessed into the insert body 186 and extends substantially centrally along the insert body 186.

Referring now to FIGS. 18A-C, because the ground shorting bars 178 and 180 are similarly constructed, the ground shorting bars 178 and 180 will now be described with reference to the first ground shorting bar 178, unless otherwise indicated. The ground shorting bar 178 includes a conductive plate 183 having a broadside 181 and opposing elongate edges 186A and 186B. The conductive plate 183 is discreetly or integrally connected to a first plurality of legs 188A that projects out from the edge 186A, and a second plurality of legs 188B that projects out from the edge 186B. In the illustrated embodiment, the legs 188A and 188B extend in a direction perpendicular with respect to the corresponding edges 186A and 186B, and are co-planar with respect to the conductive plate 183. As illustrated, one or more of the legs 188A may be out alignment with respect to legs 188B in the longitudinal direction, and may be longitudinally spaced differently than legs 188B. Accordingly, the ground coupling assembly 176 can be configured to electrically connect ground contacts of adjacent connector modules when the adjacent connector modules 170 include different ground-signal contact patterns. Alternatively, the legs 186A and 186B can be longitudinally aligned, and thus configured to electrically connect the ground contacts of adjacent modules when the ground contacts of adjacent modules are longitudinally aligned.

Figure 27A:
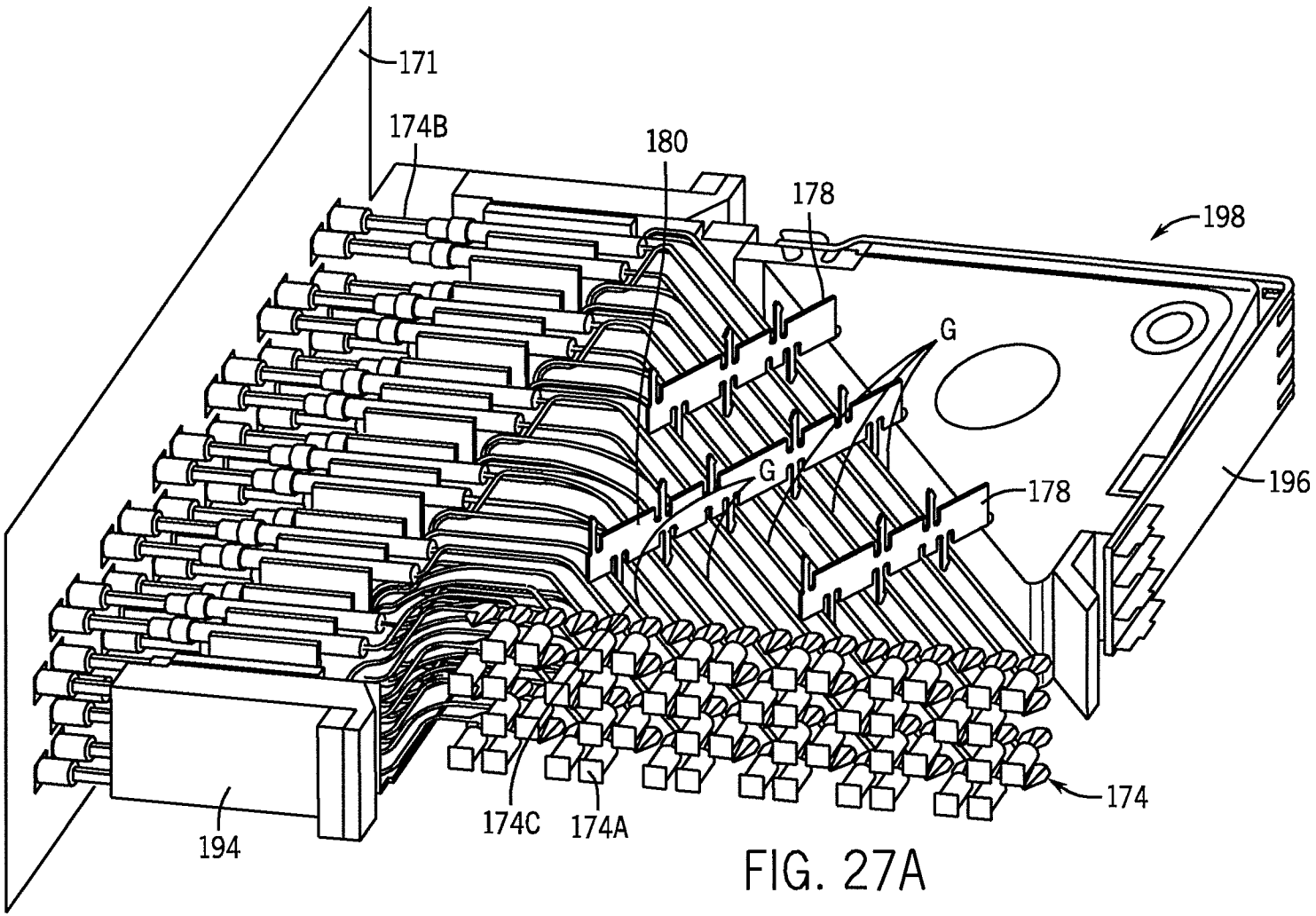
FIG. 27A is a cross-sectional view of the connector module assembly illustrated in FIG. 26.

The legs 188 can present a barbed outer end 190, and can have a thickness less than that of the insert apertures 187 such that the legs 188 can extend through the apertures 187. In one embodiment, the legs 188 do not contact the apertures 187, though if the insert body 186 is insulating or does not contact the signal contacts of the connector module 170, the legs 188 can contact the apertures if desired. The ground shorting bar 178 can include a greater number of legs 188 than the ground shorting bar 180. While the second ground shorting bar 180 includes three legs 188 as illustrated, and the first ground shorting bar 178 includes five legs as illustrated, it should be appreciated that the ground shorting bars 178 and 180 can include any desired number of legs configured to electrically connect to the ground contacts G of the connector module 170 in the manner as illustrated in FIG. 27A.

The edges 186 include a plurality of notches 191 formed in the edges on opposing sides of the legs 188. One or both of the edges 186A and 186B can further include one or at least one locating notch 192 constructed similar to the notches 191. The locating notch 192 is disposed between notches 191, and is sized to receive the locating rib 185 of the insert 184 when the ground shorting bar 178 is inserted into the slot 189 of the insert to ensure that the ground shorting bar 178 is in its desired orientation.

Figure 21:
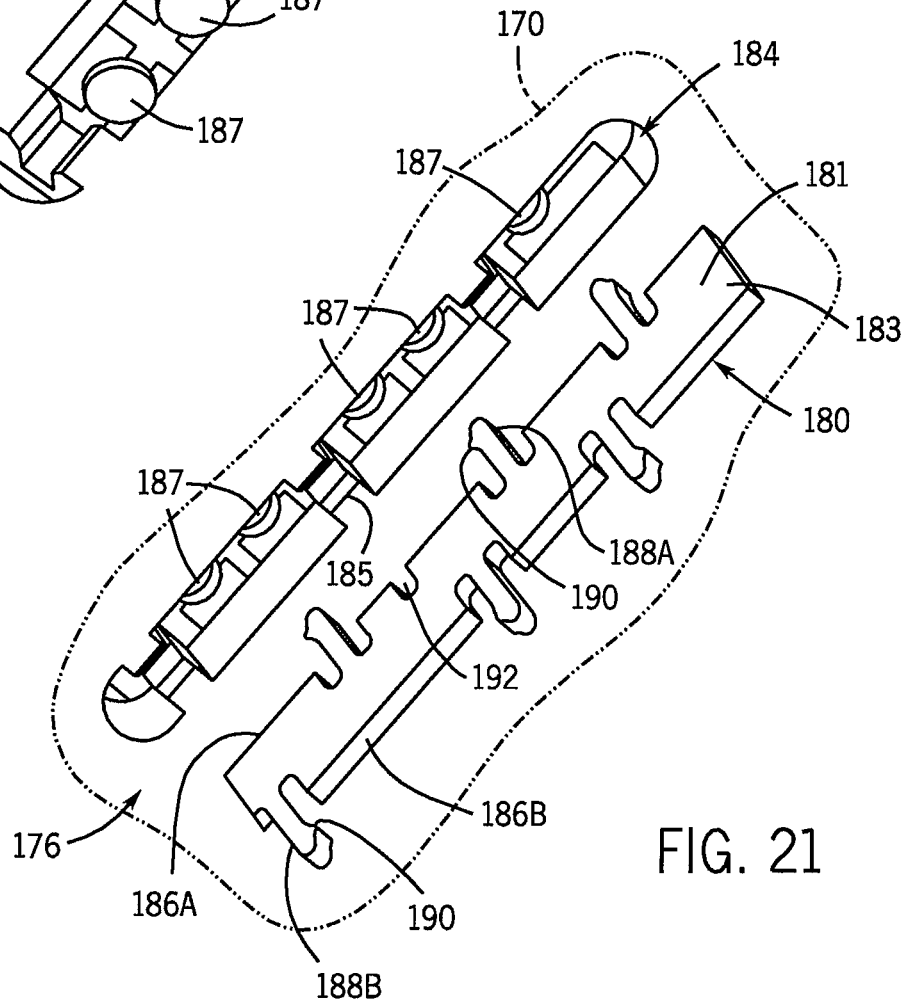
FIG. 21 shows an enlarged portion of the electrical connector module illustrated in FIG. 20, taken along line 21-21.
Figure 20:
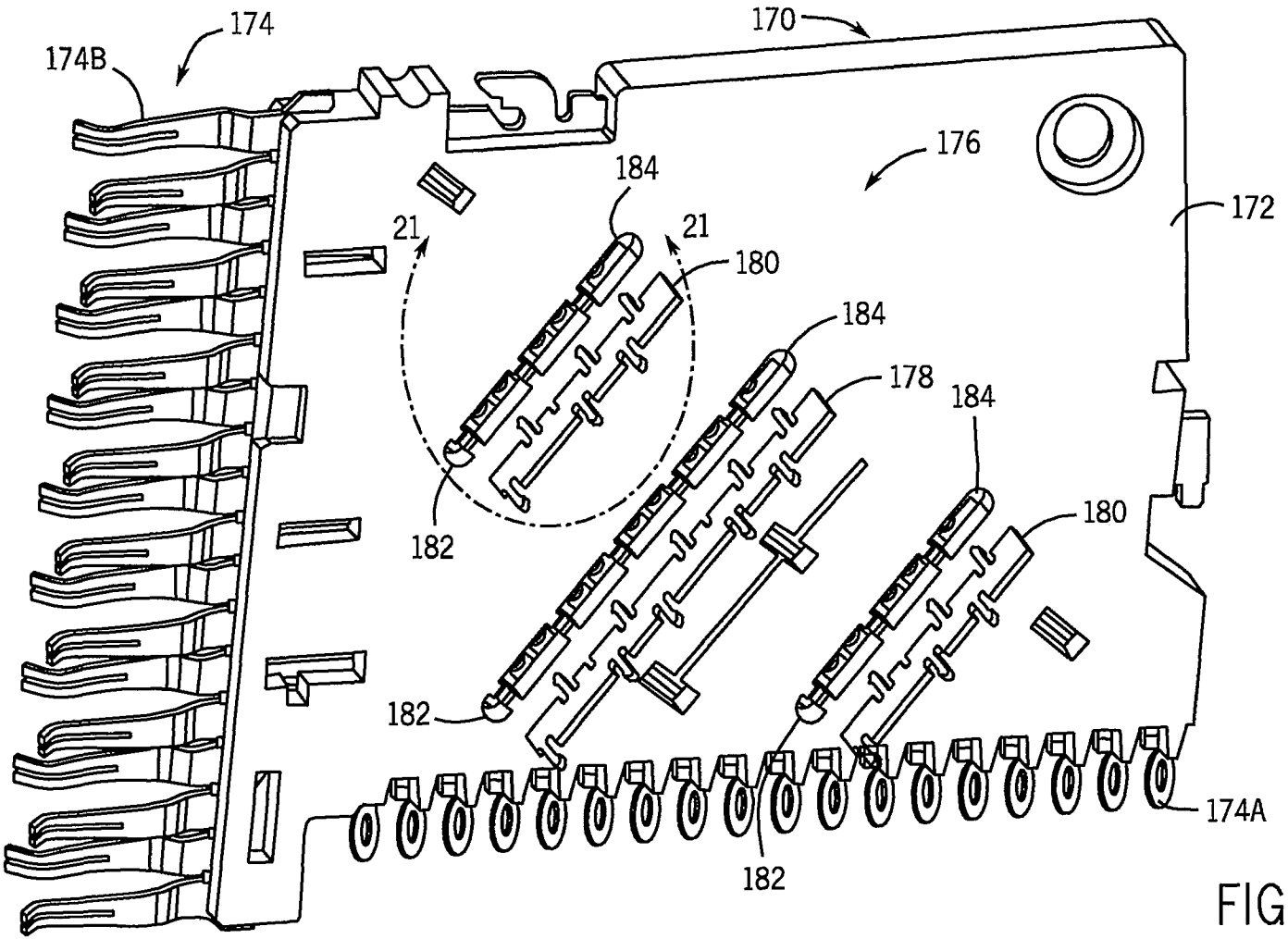
FIG. 20 is a perspective view of the electrical connector module illustrated in FIG. 17, showing installation of the ground coupling assembly.

Referring now to FIGS. 20-21, the installation of the ground shorting bars 178 and 180 into the connector module 170 will now be described with reference to the ground shorting bar 178, it being appreciated that the ground shorting bars 180 are similarly installed in the connector module 170. In particular, the ground shorting bar 178 is positioned such that the legs 188 are aligned with the apertures 187 of the insert 184. Next, the ground shorting bar 178 is press-fit into the slot 189 of the insert 184 such that the first edge 186A is disposed in the slot 189, and the legs 188 extend through the apertures 187. Thus, the ground shorting bar plate 183 extends in a direction perpendicular to the connector module housing 172. The legs 188 extending from edge 186A mechanically connect to the ground contacts that are aligned with the apertures 187, thereby placing those ground contacts in electrical communication with each other. The barbed end 190 of the legs 188 can cam over the ground contacts as the ground bar 178 is installed, and can snap down over the ground contacts once the ground bar 178 has been fully installed, thereby preventing the ground shorting bar 178 from being inadvertently removed.

Figure 22:
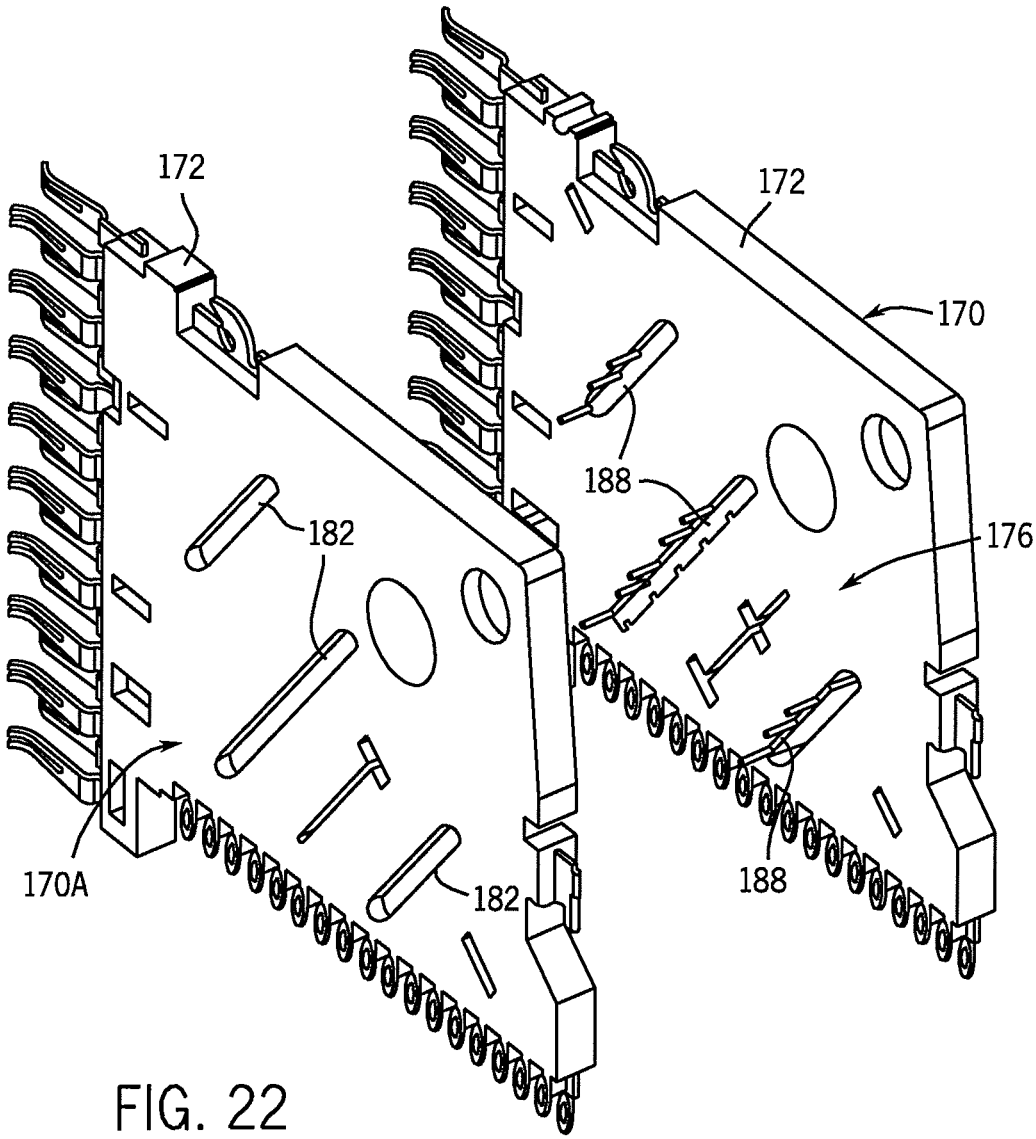
FIG. 22 illustrates a pair of connector modules being assembled with the ground shorting bars.
Figure 23:
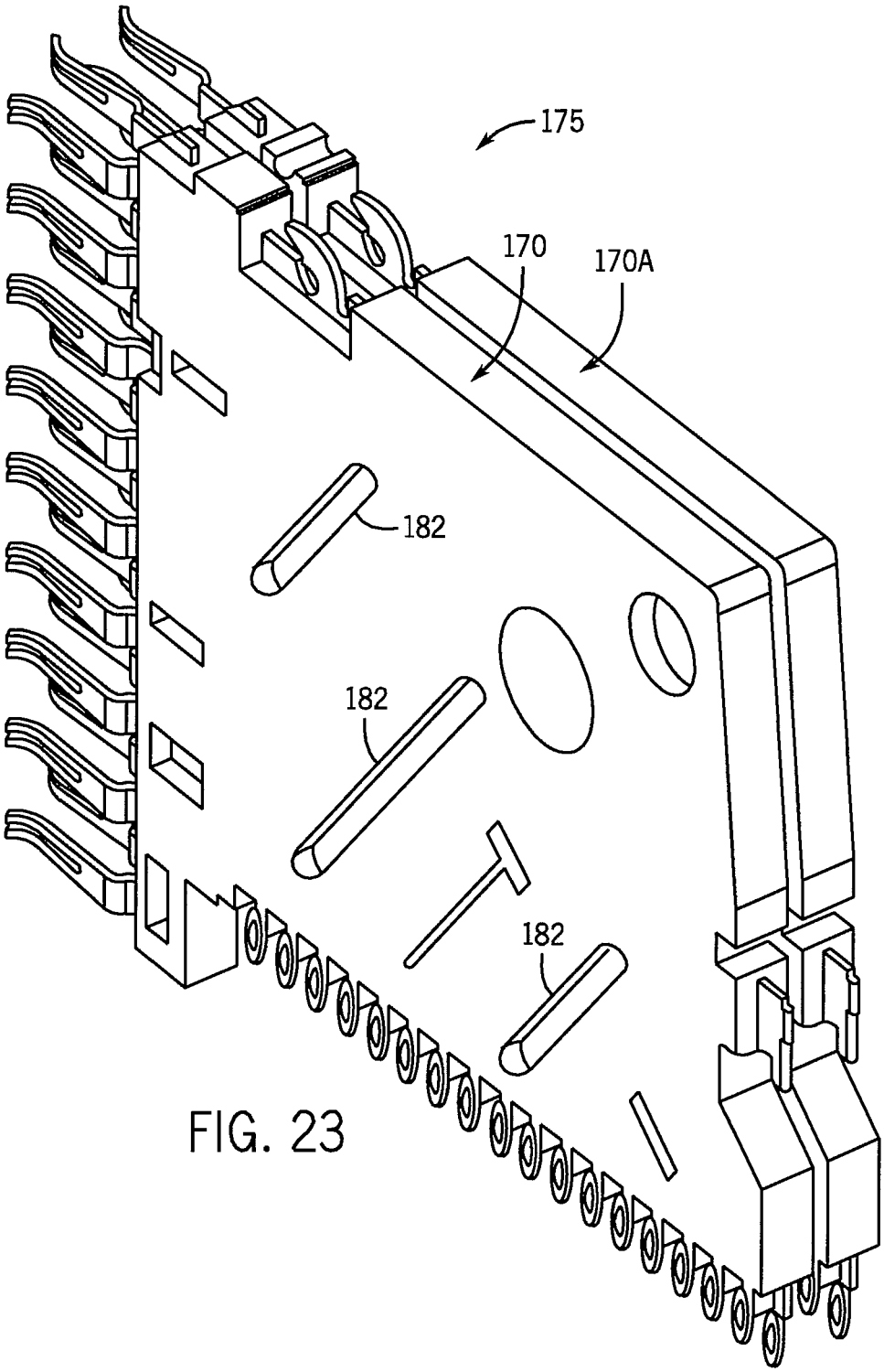
FIG. 23 illustrates the pair of connector modules illustrated in FIG. 22 in an assembled configuration to form a connector module assembly.

Referring now to FIGS. 22-23, once the ground shorting bars 178 and 180 have been installed in the electrical connector module 170, a second connector module 170A can connect to the second edge 186B of the ground shorting bars 178 and 180 to form a connector module assembly 175 having a pair of connector modules 170 and 170A that are mated. The second connector module 170A can be constructed as described with respect to connector module 170. The connector modules 170 of the assembly 175 include ground contacts that are joined by a ground coupling assembly 176, which is provided as one or more common ground shorting bars that connect directly to the ground contacts of a first and second electrical connector. As described above, the legs 188 extending from the second edge 186B can be aligned with the legs 188 extending from the first edge 186A, or can be longitudinally offset with respect to the legs 188 extending from the first edge 186A. The second connector module 170A can be placed in position adjacent the first connector module 170 such that their respective connector housings 172 abut, such that the ground shorting bars 178 and 180 become inserted into the second connector module 170A in the manner as described above with respect to the first connector module 170.

Figure 24:
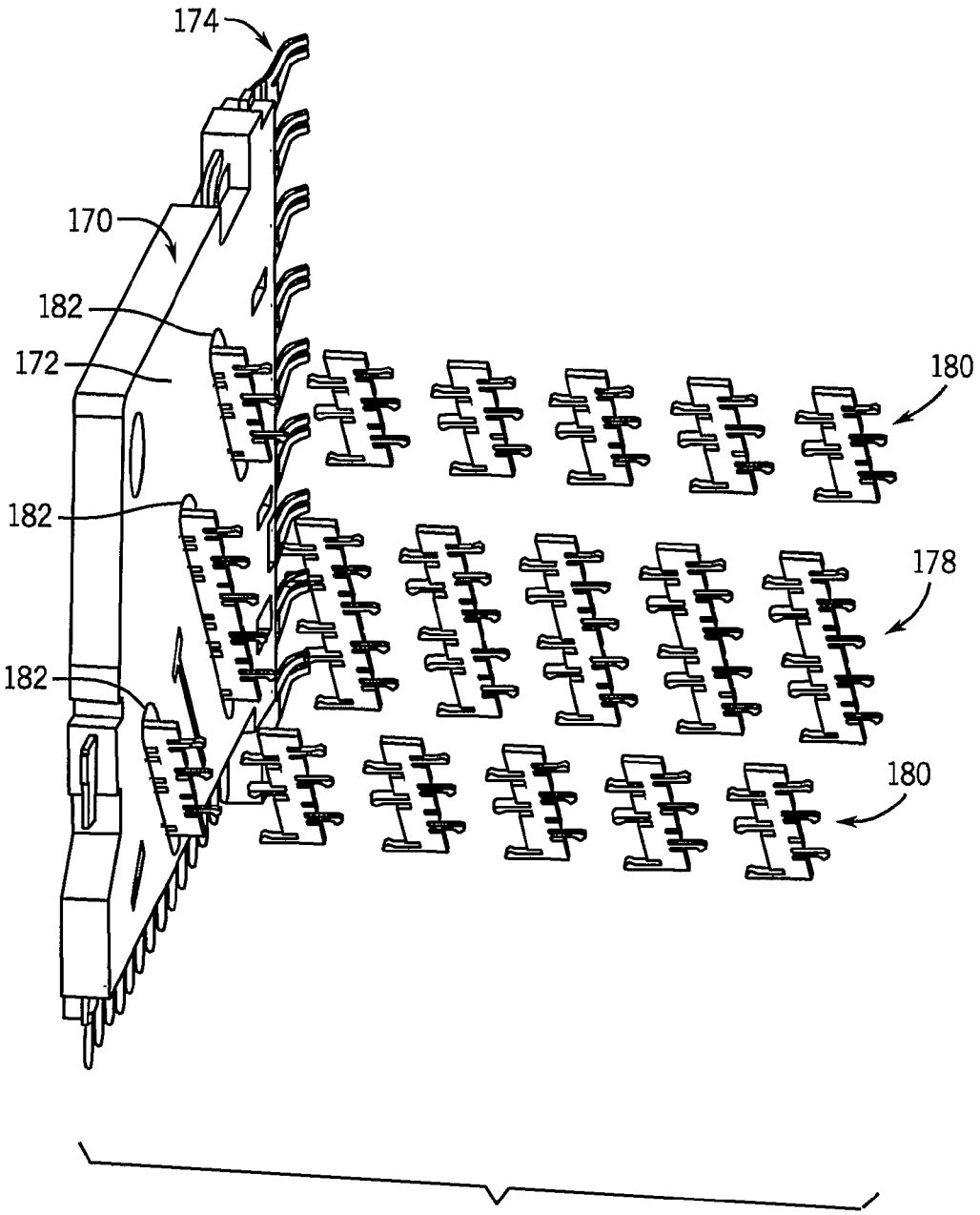
FIG. 24 shows a plurality of ground shorting bars configured for insertion into a plurality of electrical connector modules.
Figure 25:
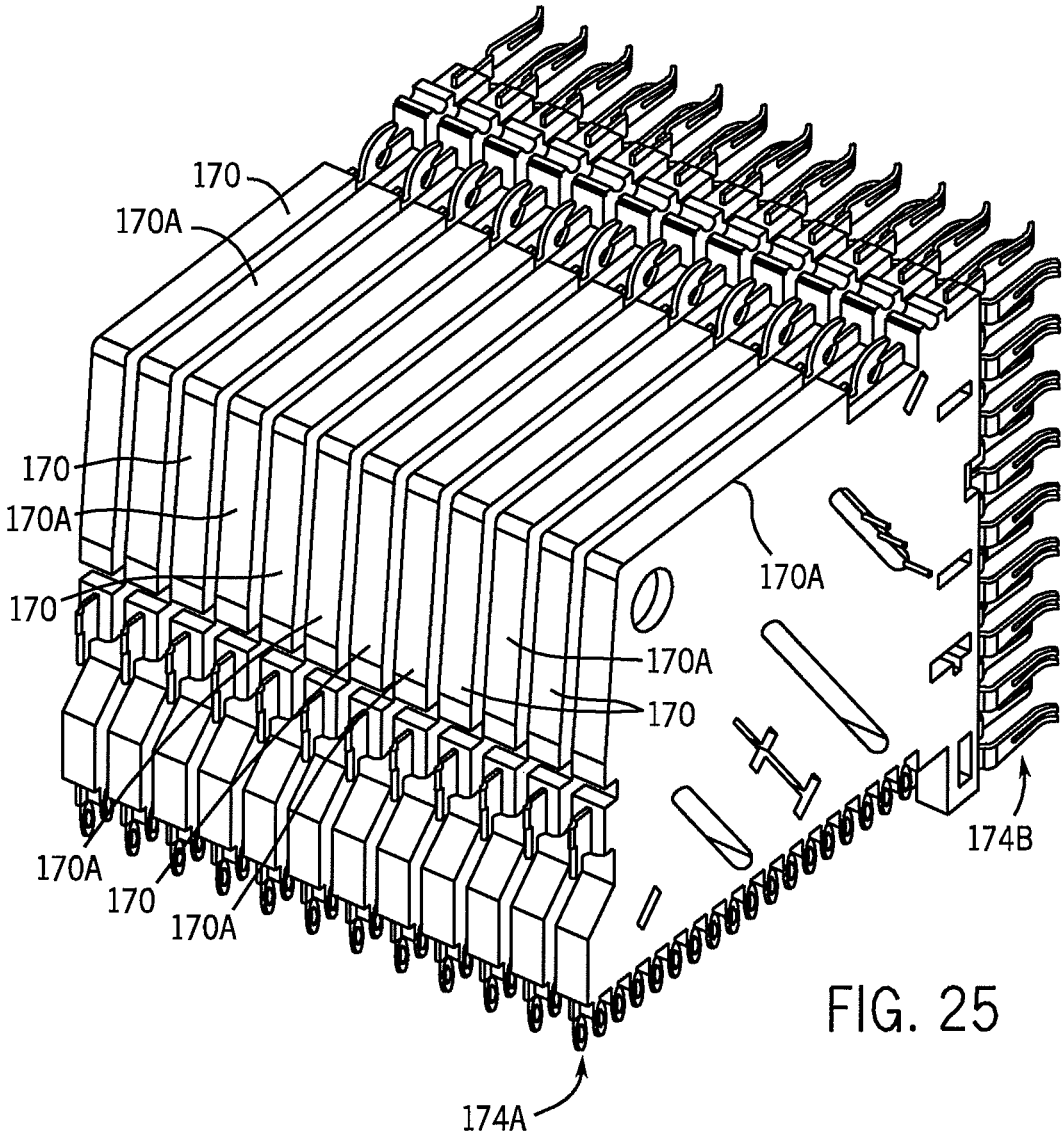
FIG. 25 illustrates a plurality of subassemblies disposed adjacent each other and configured to be assembled.
Figure 26:
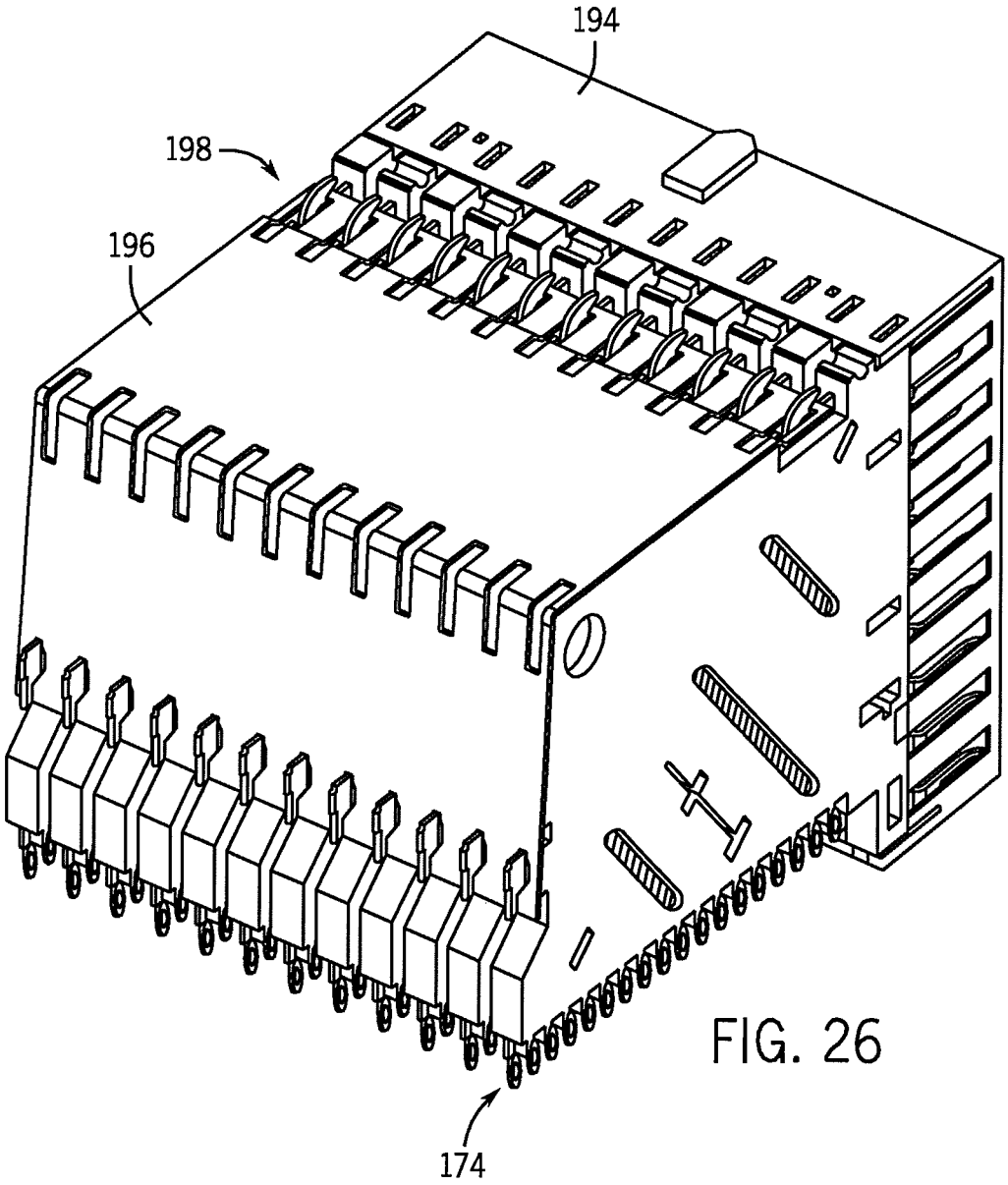
FIG. 26 illustrates a front housing that secures the front end of the plurality of subassemblies illustrated in FIG. 24, and an organizer that secures the rear end of the plurality of subassemblies illustrated in FIG. 24 to form a connector module assembly.

FIG. 24 shows a plurality of ground shorting bars 178 and 180 arranged with respect to a first connector module 170, it being appreciated that connector modules can connect to the plurality of inserts illustrated so as to form a portion of a backplane connector assembly of the type described above. As shown in FIG. 25, a plurality of connector modules 170 can be connected to the ground shorting bars 178 and 180 in the manner described above so as to produce a plurality of subassemblies 175 that are disposed adjacent each other, and configured to form an assembly of the type that can be installed in a backplane system or other suitable electrical connector system. Referring to FIG. 26, a dielectric front housing 194 can be installed onto the assembly 175 proximate to the mating ends of the electrical contacts, and a dielectric rear organizer housing 196 that secures the rear end of the plurality of subassemblies illustrated in FIG. 24 to form a connector 198 that is configured to communicate electrical signals and/or power between electrical devices. The connector 198 can then be integrated into a connector assembly.

Figure 27C:
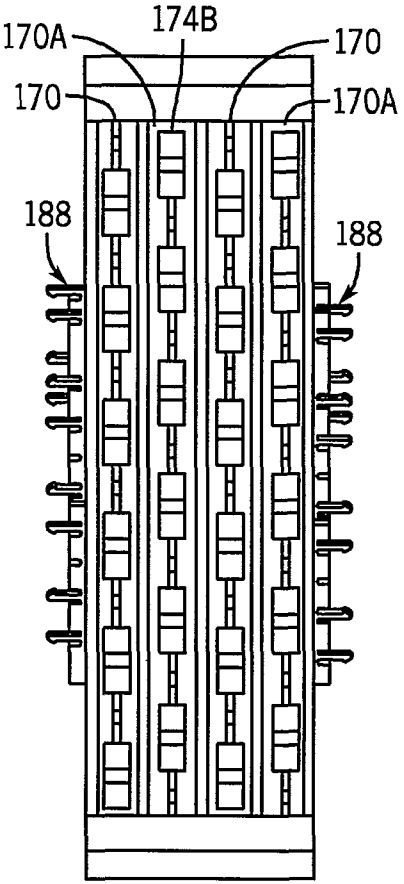
FIG. 27C illustrates the receptacle pairs of the connector module.
Figure 27B:
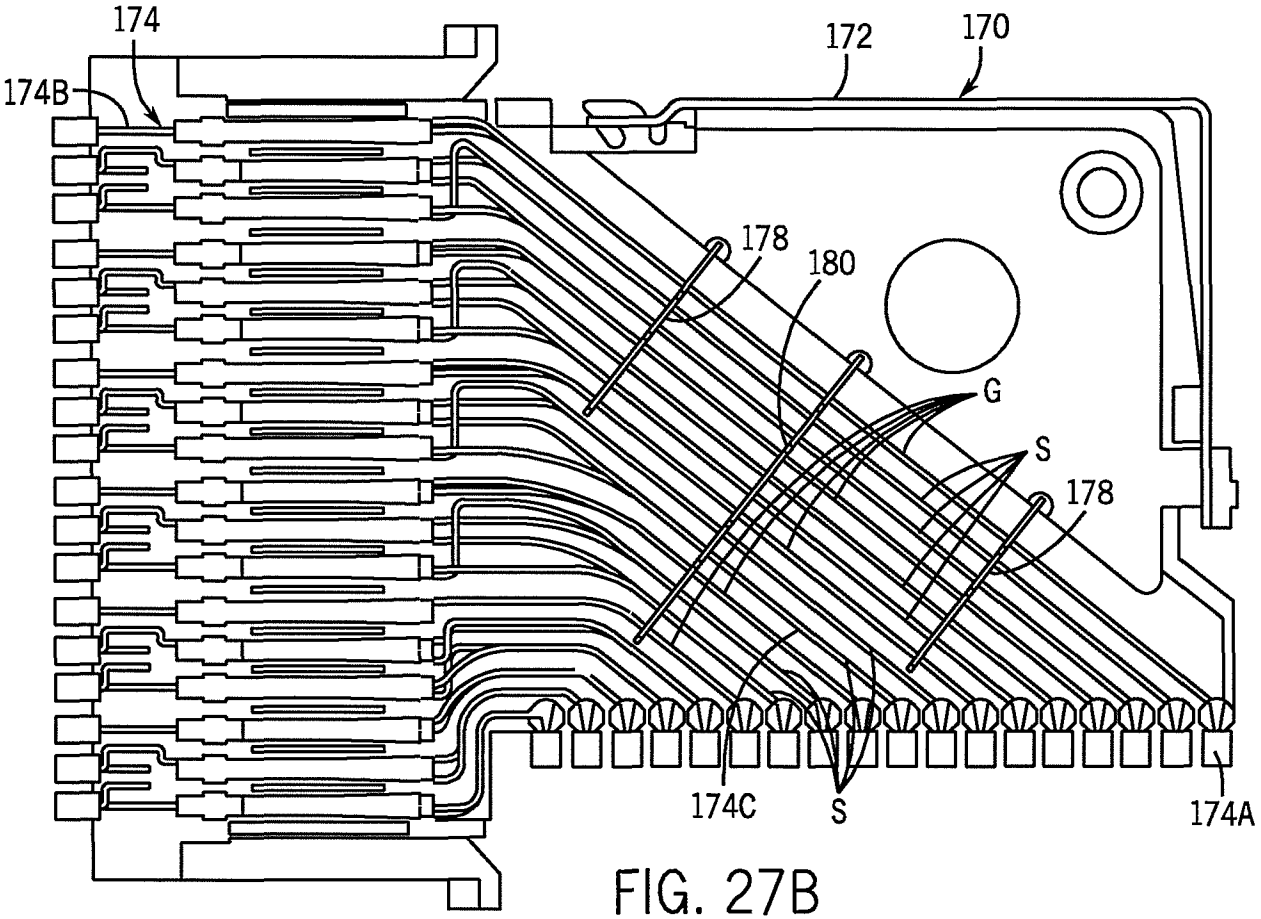
FIG. 27B is a schematic view of the connector module assembly illustrated in FIG. 26, showing an example arrangement of the ground shorting bars as installed in the connector modules.

Referring now to FIGS. 27A-C it should be appreciated that the ground coupling assembly 176 can connect to the ground contacts (G) in various configurations and/or arrangements (e.g., horizontal, vertical, diagonal, etc.). The ground shorting bars 178 and 180 may be connected to each ground contact (G) in the connector module 170, or may be connected to less than all of the ground contacts (G) in the connector module 170. Each ground contact (G) may define an electrical path that extends from the mounting end 174A to the mating end 174B of the ground contact (G). The ground shorting bars 178 and 180 may be connected to the lead portion 174C of the ground contacts (G), between the mounting end 174A and the mating end 174B. The ground shorting bars 178 and 180 can be positioned to divide the electrical path of the ground contact (G) into equal or unequal portions.

Referring now to FIGS. 28-32, a ground coupling assembly 220 is configured to electrically connect directly to the ground contacts of one or more electrical connector modules, such as a first connector module 222 and a second connector module 222A in accordance with an alternative embodiment. As shown in FIGS. 28A-B, each electrical connector module 222 and 222A can be provided as an insert molded leadframe assemblies (IMLA) constructed as described in U.S. patent application Ser. No. 11/958,098, the disclosure of which is hereby incorporated by reference as if set forth in its entirety herein. The connector modules 222 and 222A may include an insulating or dielectric connector module housing 221 that presents opposing housing surfaces 223 and 223A.

Figure 28A:
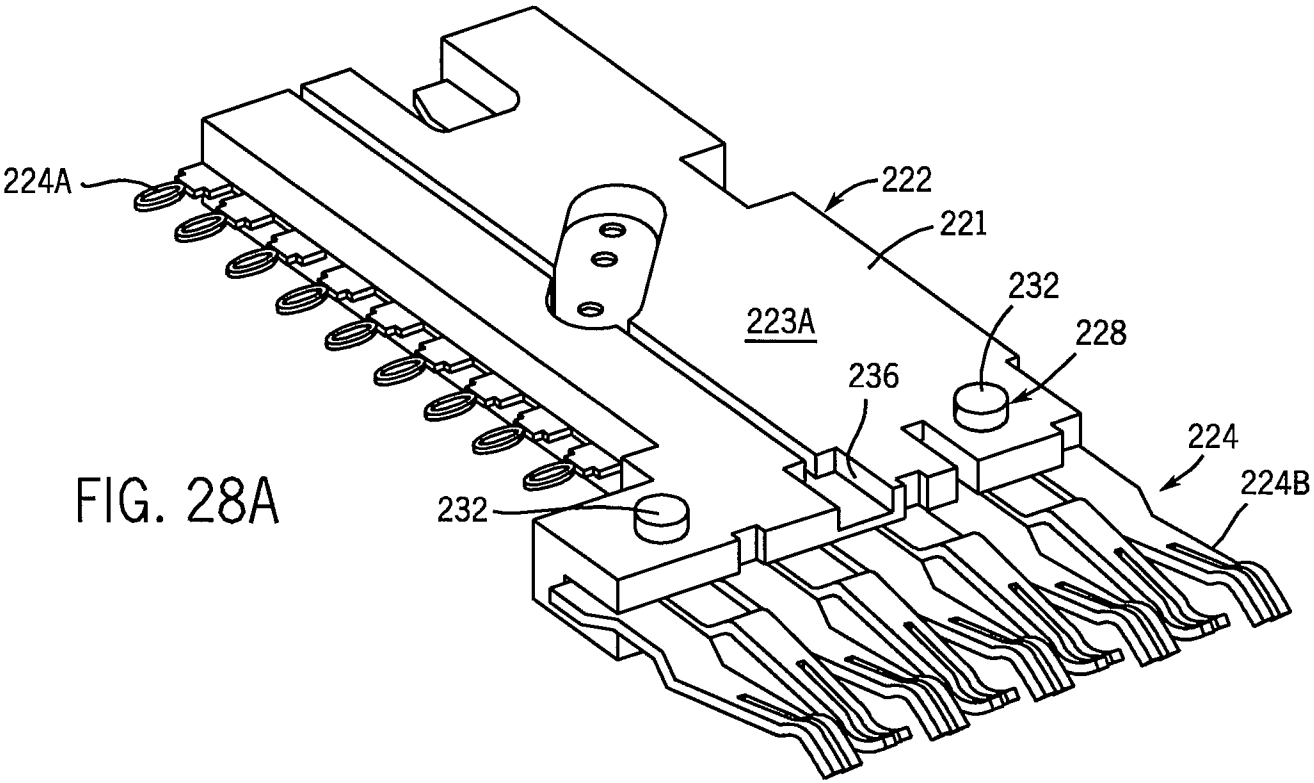
FIG. 28A is a first perspective view of a first connector module configured to attach to a ground shorting bar constructed in accordance with an alternative embodiment.
Figure 28B:
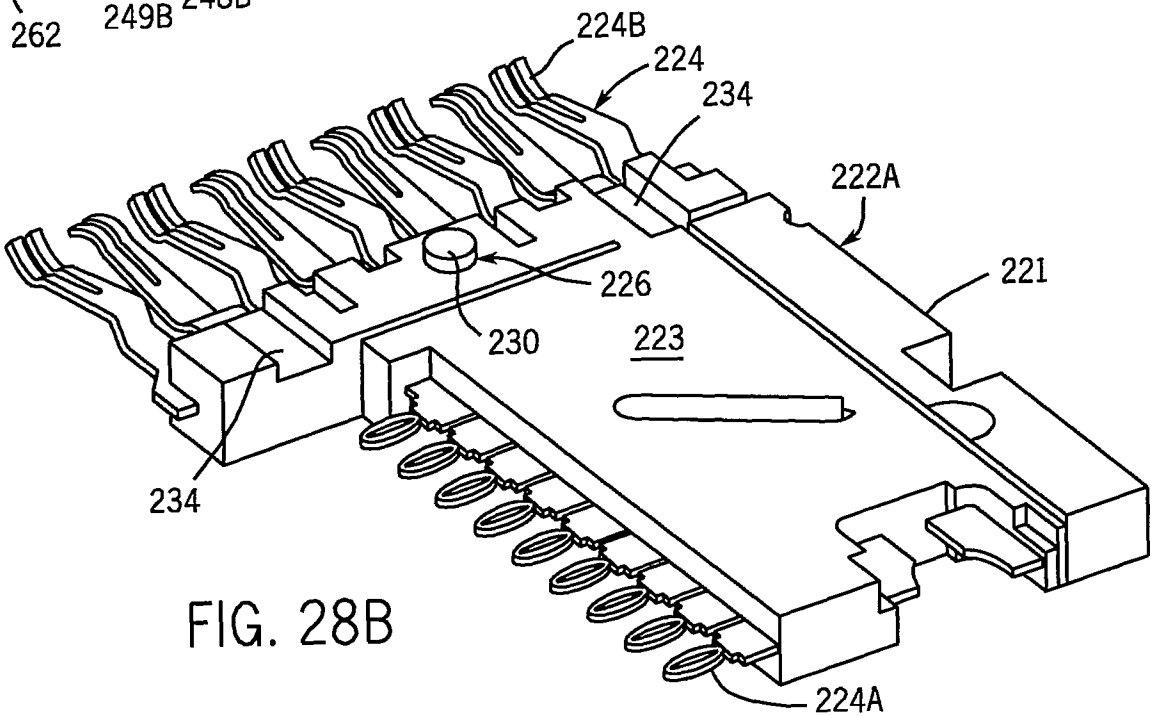
FIG. 28B is an opposing perspective view of a second connector module configured to mate with the first connector module illustrated in FIG. 28A.

With continuing reference to FIGS. 28A-B, a the connector modules 222 and 222A can include a set of one or more right-angle electrical contacts 224 as described above, including a first mounting end 224A, a second mating end 224B, and a lead portion extending between the first end 224A and the second end 224B. The mounting end 224A of the electrical contact 224 may include any suitable terminal for establishing an electrical and mechanical connection with an electrical device. For example, the mounting end 224A may include a solder ball that is soldered to a solder pad on the electrical device. In addition, the mounting end 224A may be a compliant end configured to be inserted into a plated through-hole of the electrical device. The mating end 224B of each electrical contact 224 may include any suitable mating end for establishing an electrical and mechanical connection with a complementary connector, for instance a header connector of the type described above. As illustrated, the mating ends 224B of the contacts 224 are arranged as receptacle contacts configured to receive mating header contacts. It should be appreciated, however, that the mating ends 224B could alternatively define a blade-shaped mating end.

Figure 29:
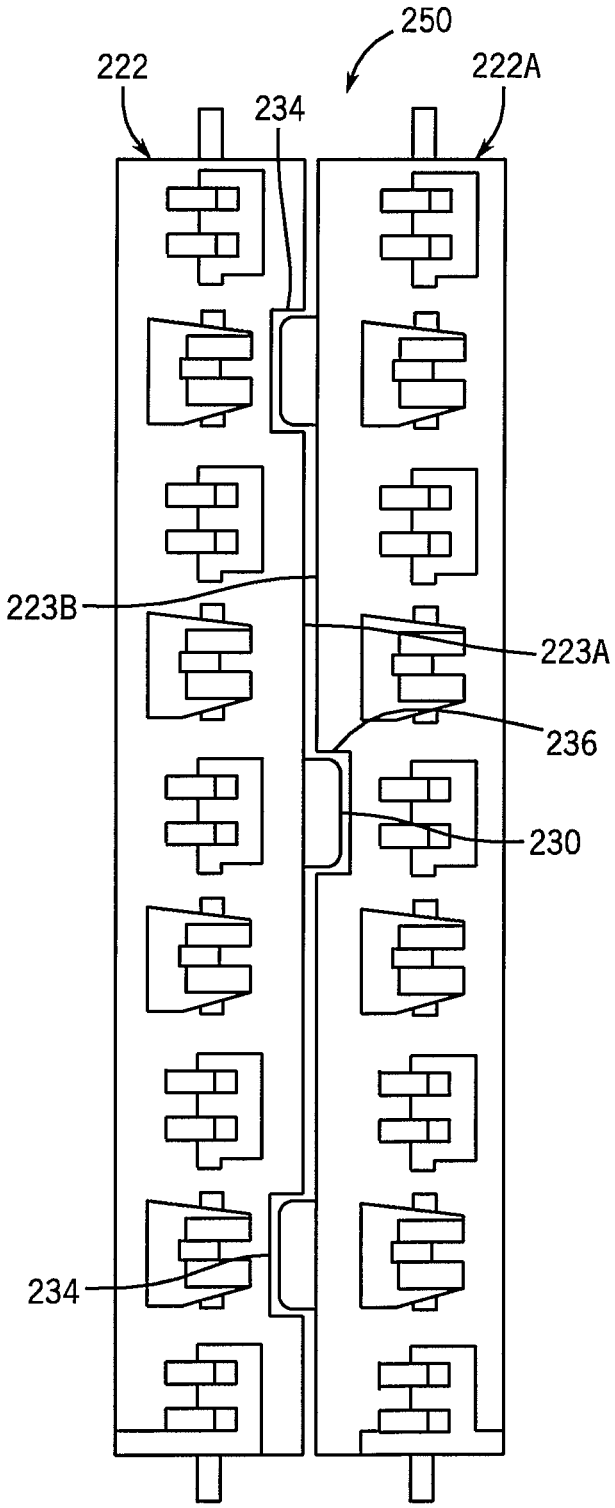
FIG. 29 is an end view of the a pair of mated connector modules of the type illustrated in FIGS. 28A-B.

Referring now to FIGS. 28-29, the first connector module 222 includes a first engagement member 226 carried by the first housing surface 223, and the second connector module 222A includes a second engagement member 228 carried by the second housing surface 223A. In the illustrated embodiment, the engagement member 226 is provided as a protuberance 230 that is centrally disposed at the mating end of the first housing surface 223, and extends out from the first housing surface 223. The engagement member 228 is provided as a pair of protuberances 232 that are disposed at the mating end of the second housing surface 223A, but laterally spaced outwardly with respect to the protuberance 230. The housing surface 223 includes a pair of recesses 234 disposed on both lateral sides of the protuberance 230 and laterally aligned with the protuberance 230. The recesses 234 have a depth substantially equal to the height of the protuberances 232. Likewise, the second housing surface 223A includes a recess 236 disposed between the pair of protuberances 232, and in lateral alignment with the protuberances 232. The recess 236 has a depth substantially equal to the height of the protuberance 230. Thus, the protuberances 230 and 232 can be of equal or substantially equal height.

As illustrated in FIG. 29, the recesses 234 are laterally positioned so as to receive the protuberances 232 of a second connector module 222A constructed as described with respect to connector module 222, when the first side of the connector module 222 is mated with the second side of the like connector module. The recess 236 of the second connector module 222A is sized to receive the protuberance 230 of the connector module 222.

Figure 30:
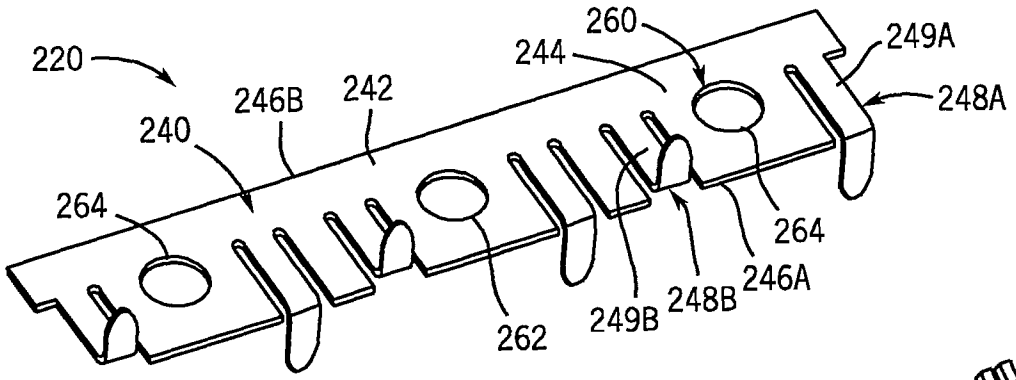
FIG. 30 is a perspective view of the ground shorting bar configured to attach to the connector module s illustrated in FIG. 28.
Figure 31:
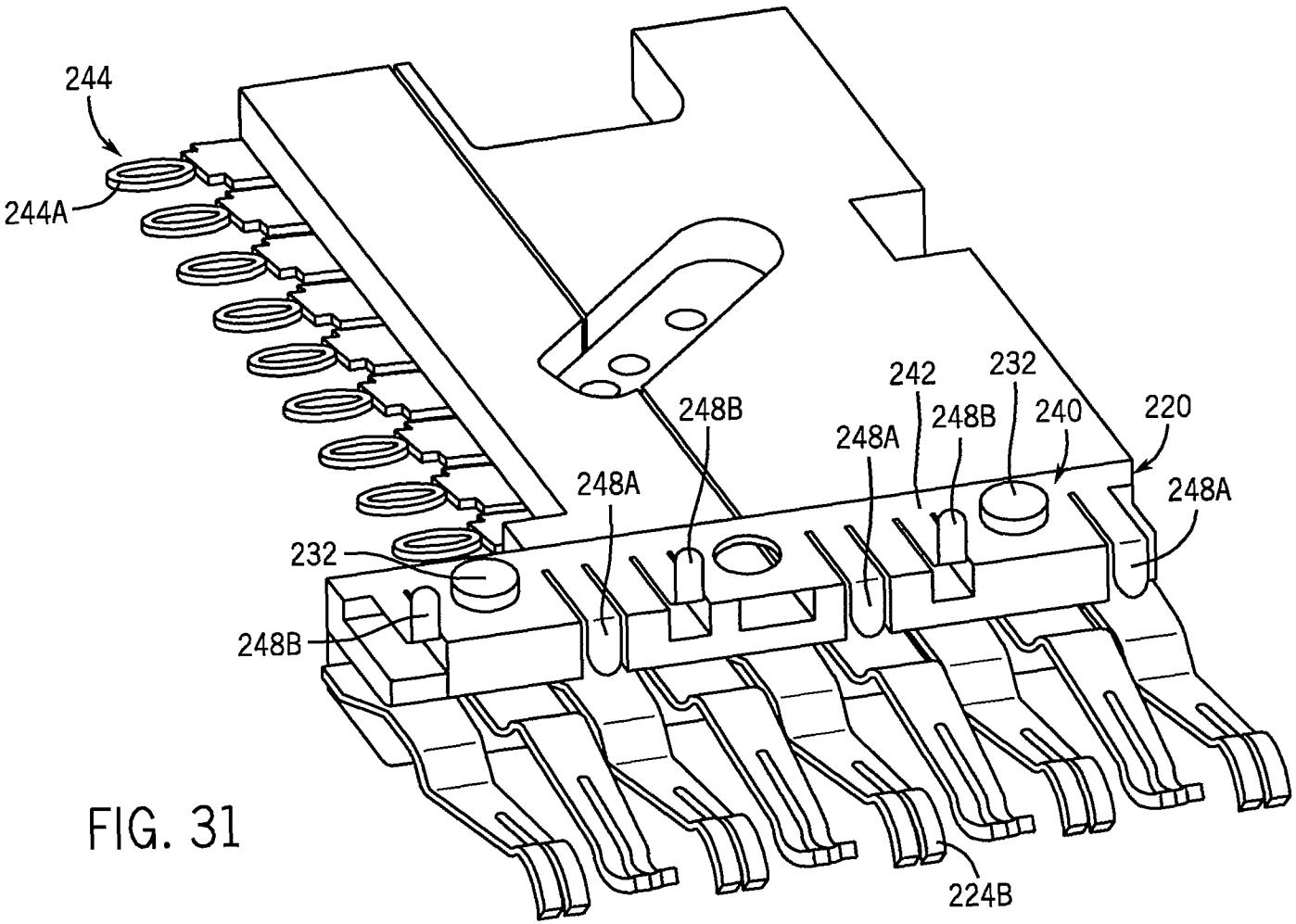
FIG. 31 is a perspective view of the connector module illustrated in FIGS. 28A-B with the ground shorting bar coupled to the ground contacts of the connector module.
Figure 32:
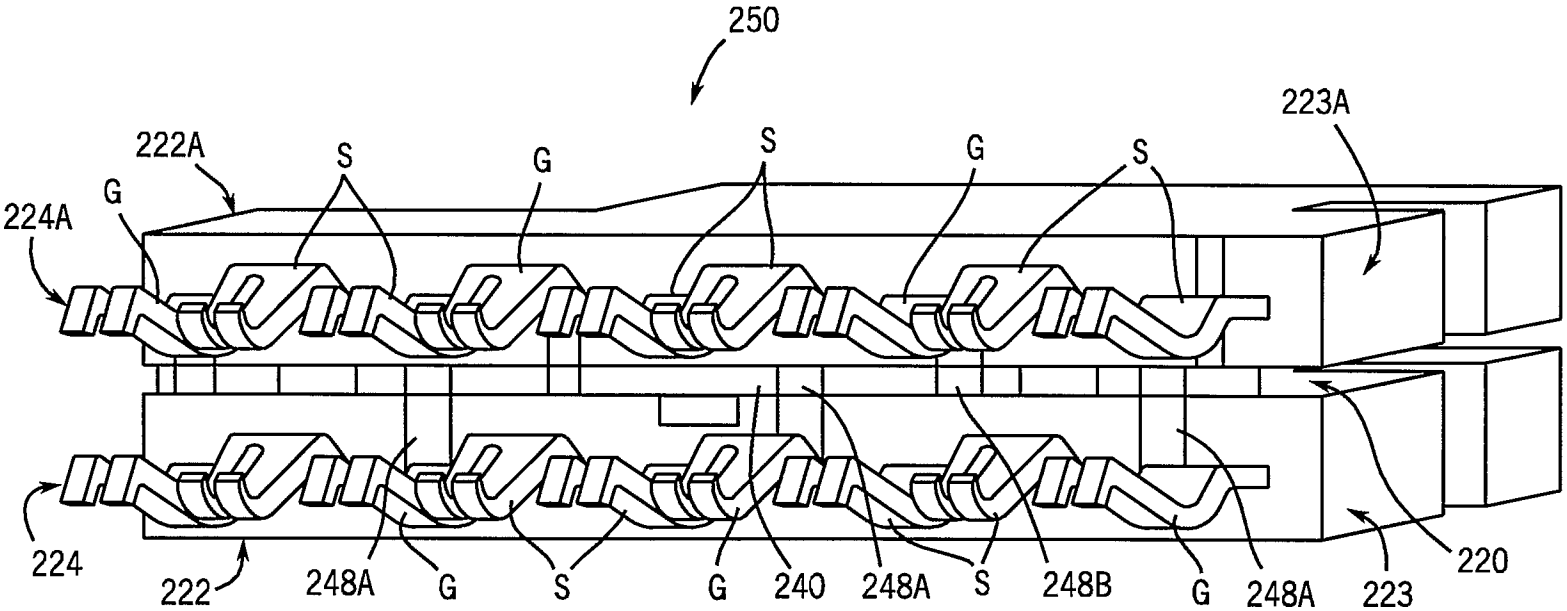
FIG. 32 is a perspective view of a connector module assembly including the connector module illustrated in FIGS. 28A-B connected to a like connector module with the ground shorting bar coupled to the ground contacts of the connector modules.

Referring now to FIGS. 30-32, the ground coupling assembly 220 includes a ground shorting bar 240 having a conductive plate 242 that presents a broadside 244 and opposing elongate front and rear edges 246A and 246B, respectively. The conductive plate 242 carries a plurality of engagement members 260 configured to engage the engagement members 226 and 228. In particular, the engagement members 260 are provided as an inner aperture 262 extending through the plate 242, and a pair of outer apertures 264 extending through the plate 242 and aligned with the inner aperture 262. The inner aperture 262 is sized and positioned to receive the protuberance 230, and the outer apertures 264 are sized and positioned to receive the protuberances 232. While one example of engagement members 226 and 260 has been provided that attaches the ground shorting bar 240 to mating electrical connector modules 222 and 222A to form a connector module assembly 250, any suitable alternative engagement members could be used. A plurality of the connector module assemblies 250 can be joined to form an electrical connector, for instance in the manner described above with respect to connector 198, that can be integrated into a connector assembly.

The conductive plate 242 is discreetly or integrally connected to a first plurality of legs 248A that projects out from the front edge 246A in a first direction, and a second plurality of legs 248B that projects out from the front edge 246A in a second direction opposite the first direction. A first beam 249A can connect each of the first legs 248A to the plate 242, and a second beam 249B can connect each of the second legs 248B to the plate, thereby rendering the legs 248A and 248B compliant. The legs 248A and 248B extend in a direction substantially perpendicular to the connector module housing 221 sufficient so as to engage the mating ends 224B of the ground contacts extending out from the housing 221. The legs 248A and 248B are offset with respect to the lateral direction.

When the ground shorting bar 240 is installed onto the connector modules 222 and 222A, the front edge 246A is substantially aligned with the front edge of the housing 221, such that the legs 248A and 248B are disposed forward of the front edge of the housing 221. The legs 248A contact corresponding ground contacts G of the connector module 222, and the legs 248B contact corresponding ground contacts G of the connector module 222A. Accordingly, the ground shorting bar 240 is a common ground shorting bar that electrically connects two or more, up to all, ground contacts G of a pair of connector modules of a connector module assembly 250. It should be appreciated that because the legs 248A can be laterally offset with respect to legs 248B, the ground shorting bar 240 can be configured to electrically connect to ground contacts G of the second connector modules 222A having offset ground contacts with respect to the connector module 222. It should be appreciated that the legs 248 can be laterally aligned in accordance with alternative embodiments. A plurality of subassemblies 250 can be joined to form a connector, for instance as described above with respect to the connector 198, that can be integrated into a connector assembly.

Figure 33A:
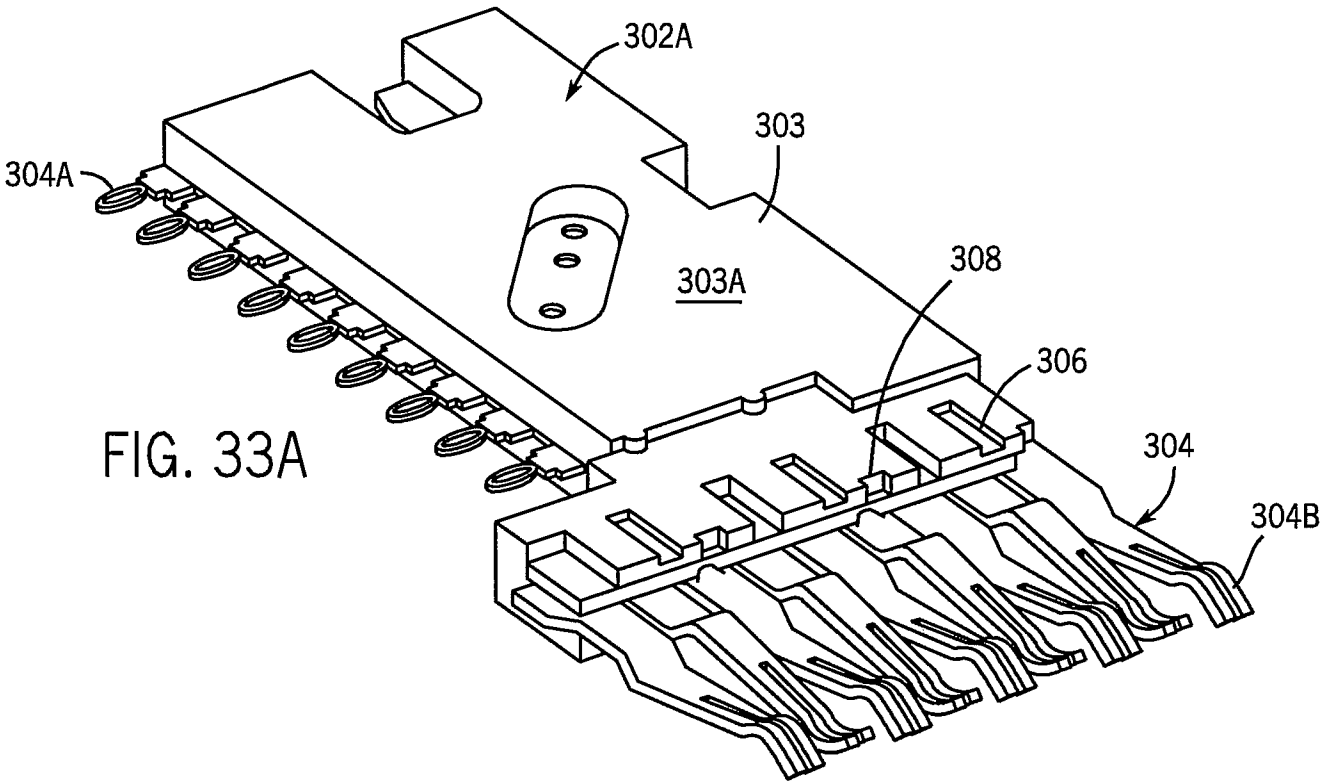
FIGS. 33A-B are perspective views of a first connector module configured to attach to a ground coupling assembly constructed in accordance with an alternative embodiment.
Figure 33B:
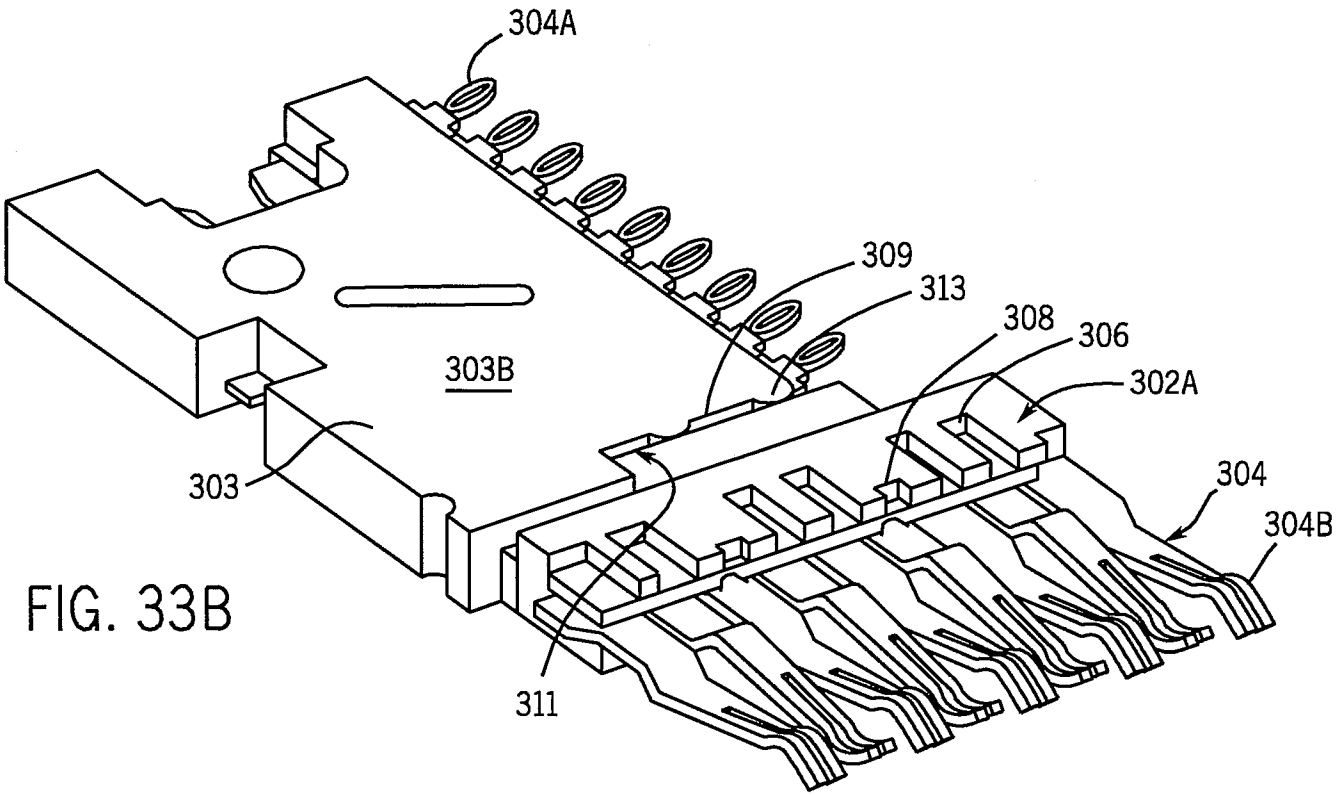
Figure 34A:
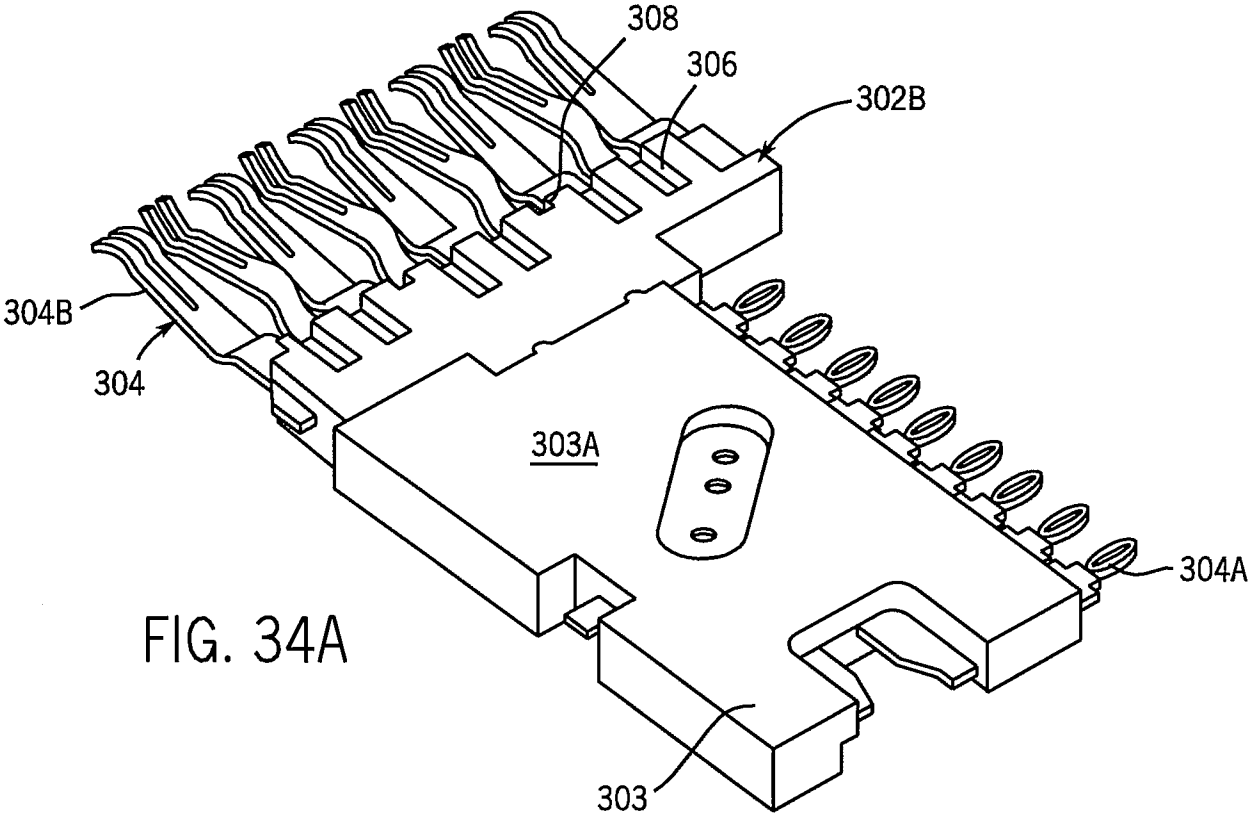
FIGS. 34A-B are perspective views of a second connector module configured to attach to the connector module illustrated in FIGS. 33A-B and the ground coupling assembly to form a connector module assembly.
Figure 34B:
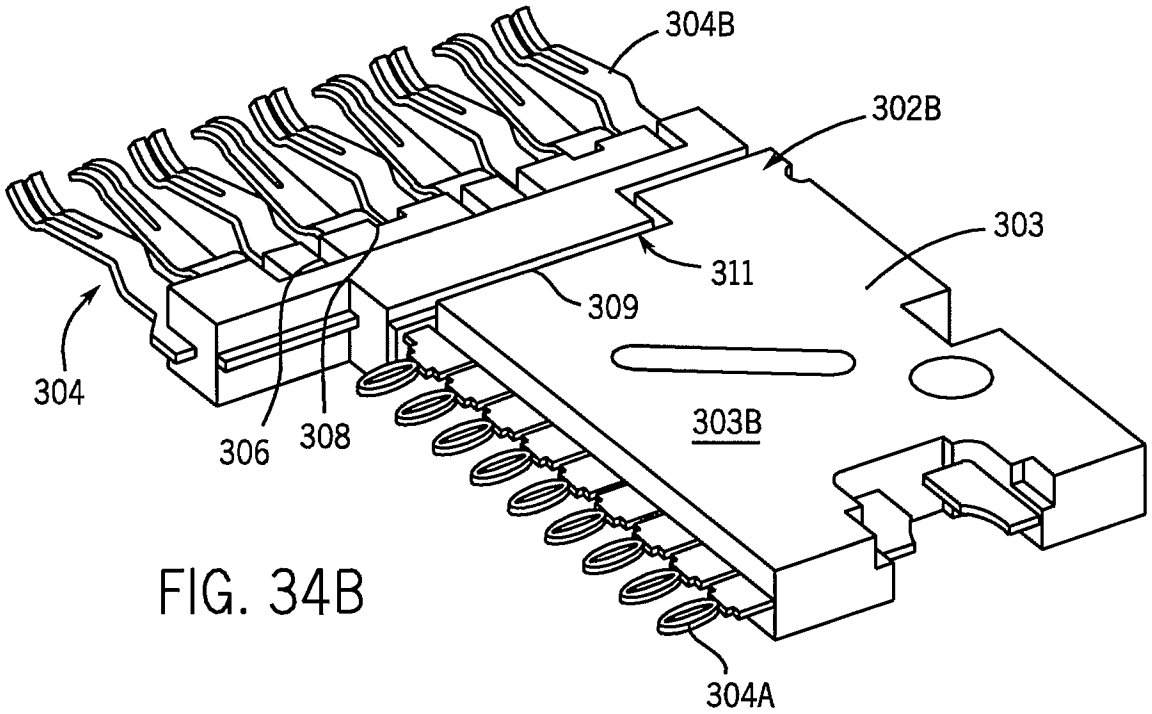

Referring now to FIGS. 33-35, a ground coupling assembly 300 can include a first ground shorting bar 301A configured to electrically connect directly to one or more, such as a plurality of, including all, ground contacts of a first electrical connector module 302A, and a second ground shorting bar 301B configured to electrically connect one or more, such as a plurality of, including all, ground contacts of a second electrical connector module 302B. The ground shorting bars 301A and 301B are substantially identically constructed, such that the description of the first ground shorting bar 301A is intended to apply to the second ground shorting bar 301B, unless otherwise indicated. Furthermore, the connector modules 302A and 302B are substantially identically constructed, such that the description of the first connector module 302A is intended to apply to the second connector module 302B, unless otherwise indicated.

As shown in FIGS. 33-34, the electrical connector module 302A can be provided as an insert molded leadframe assemblies (IMLA) constructed as described in U.S. patent application Ser. No. 11/958,098, the disclosure of which is hereby incorporated by reference as if set forth in its entirety herein. The connector module 302A may include an insulating or dielectric connector module housing 303 that presents opposing first and second housing surfaces 303A and 303B, respectively. The connector module 302A includes a first and second set, or plurality, of notches 306 and 308, respectively, disposed at the mating end of both surfaces 303A and 303B of the connector housing 303. Each notch of the second set of notches 308 is disposed between notches of the first set of notches 306. The notches 306 and 308 of the first surface 303A are aligned with the notches 306 and 308 of the second surface 303B. The connector module 302A further includes an engagement member 309 in the form of a slot 311 that extends into the second surface 303B of the housing 303. The slot 311 is elongate in a direction parallel to the mating end of the connector module 302A.

The connector module 302A can include a set of one or more right-angle electrical contacts 304 as described above, including a first mounting end 304A, a second mating end 304B, and a lead portion extending between the first end 304A and the second end 304B. The mounting end 304A of the electrical contact 304 may include any suitable terminal for establishing an electrical and mechanical connection with an electrical device. For example, the mounting end 304A may include a solder ball that is soldered to a solder pad on the electrical device. In addition, the mounting end 304A may be a compliant end configured to be inserted into a plated through-hole of the electrical device. The mating end 304B of each electrical contact 304 may include any suitable mating end for establishing an electrical and mechanical connection with a complementary connector, for instance a header connector of the type described above. As illustrated, the mating ends 304B of the contacts 304 are arranged as receptacle contacts configured to receive mating header contacts. It should be appreciated, however, that the mating ends 304B could alternatively define a blade-shaped mating end.

Figure 35A:
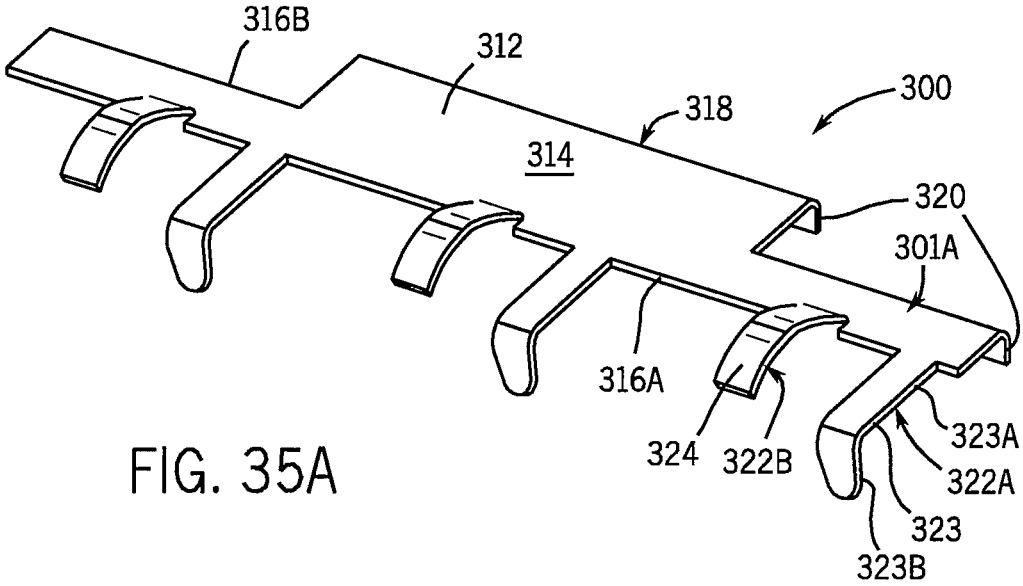
FIG. 35A is a perspective view of a first ground shorting bar of the ground coupling assembly configured for installation in the connector module illustrated in FIGS. 33A-B.
Figure 35B:
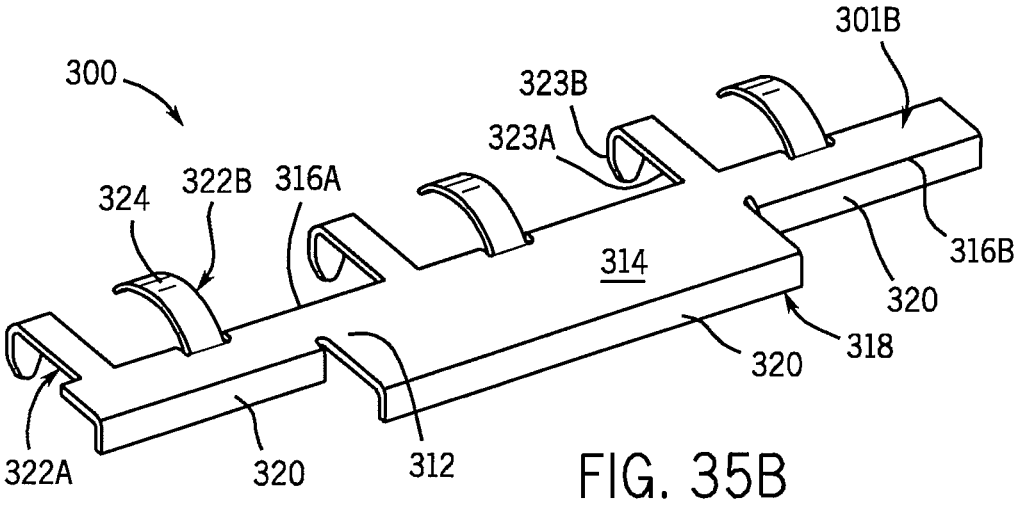
FIG. 35B is a perspective views of a second ground shorting bar of the ground coupling assembly configured for installation in the connector module illustrated in FIGS. 34A-B

Referring now to FIGS. 35A-B, the ground coupling assembly 300 includes the first and second ground shorting bars 301A and 301B, respectively. The first ground shorting bar 301A has a conductive plate 312 that presents a broadside 314 and opposing elongate front and rear edges 316A and 316B, respectively. The conductive plate 312 carries an engagement member 318 in the form of a flange 320 that extends out from the rear edge 316A in a direction substantially perpendicular to the conductive plate 312. The flange 320 is sized to be received in the slot 311 of the connector module 302A.

The conductive plate 312 is discreetly or integrally connected to a first plurality of legs 322A a second plurality of legs 322B. The legs of the first and second pluralities of legs 322A and 322B are arranged in an alternating manner along the front edge 316A of the conductive plate 312.

The first legs 322A extend forward from the plate 312, and include an L-shaped leg 323 having a first portion 323A that extends out from the front edge 316A in a direction co-planar with the plate 312A. The first legs 322A each include a second portion 323B extending in a first downward direction from the outer end of the first portion. The second portion 323B provides a contacting member that is angled with respect to, and as illustrated is perpendicular to, the first portion 323A. The second legs 322B each include a curved beam 324 that is concave with respect to the first direction, and thus presents a contacting member that extends in a second upward direction from the conductive plate 312.

Figure 36:
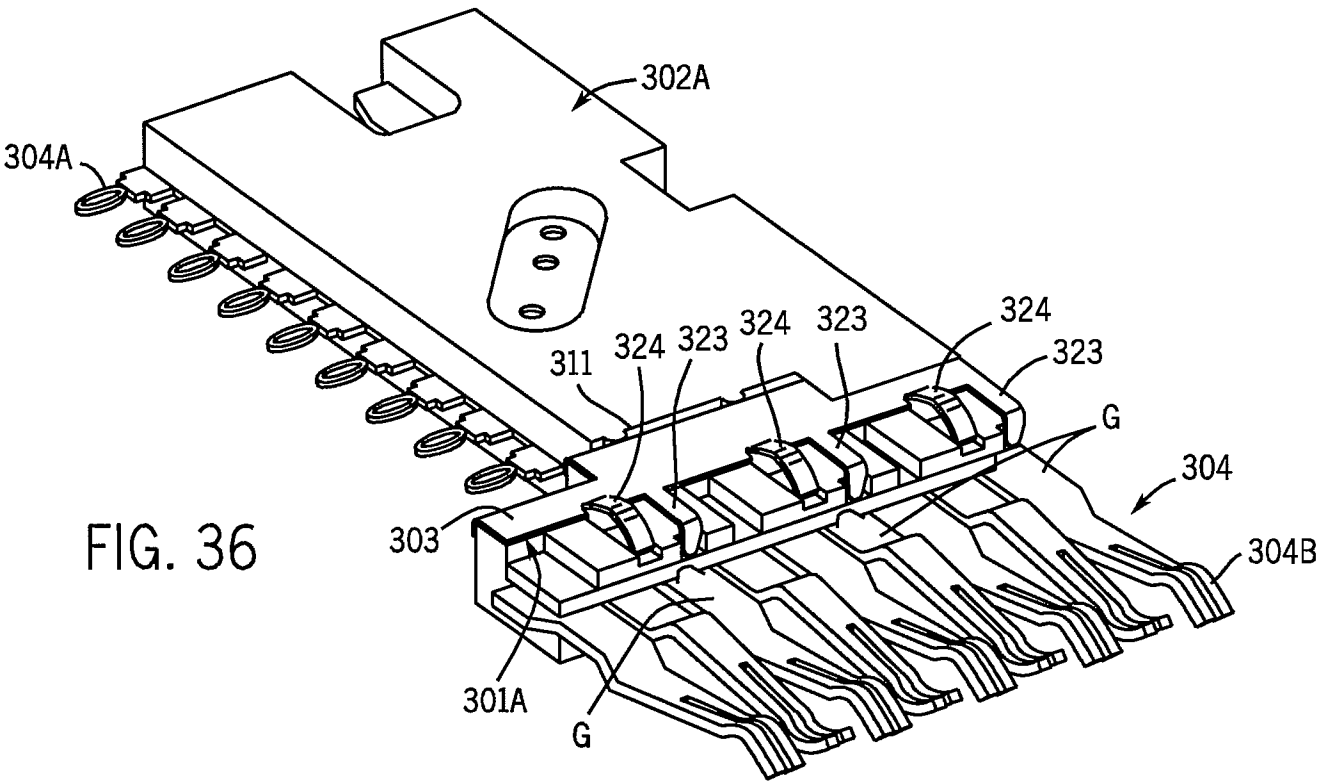
FIG. 36 is a perspective view of the first connector module illustrated in FIGS. 33A-B connected to the first ground shorting bar illustrated in FIG. 35A.
Figure 37:
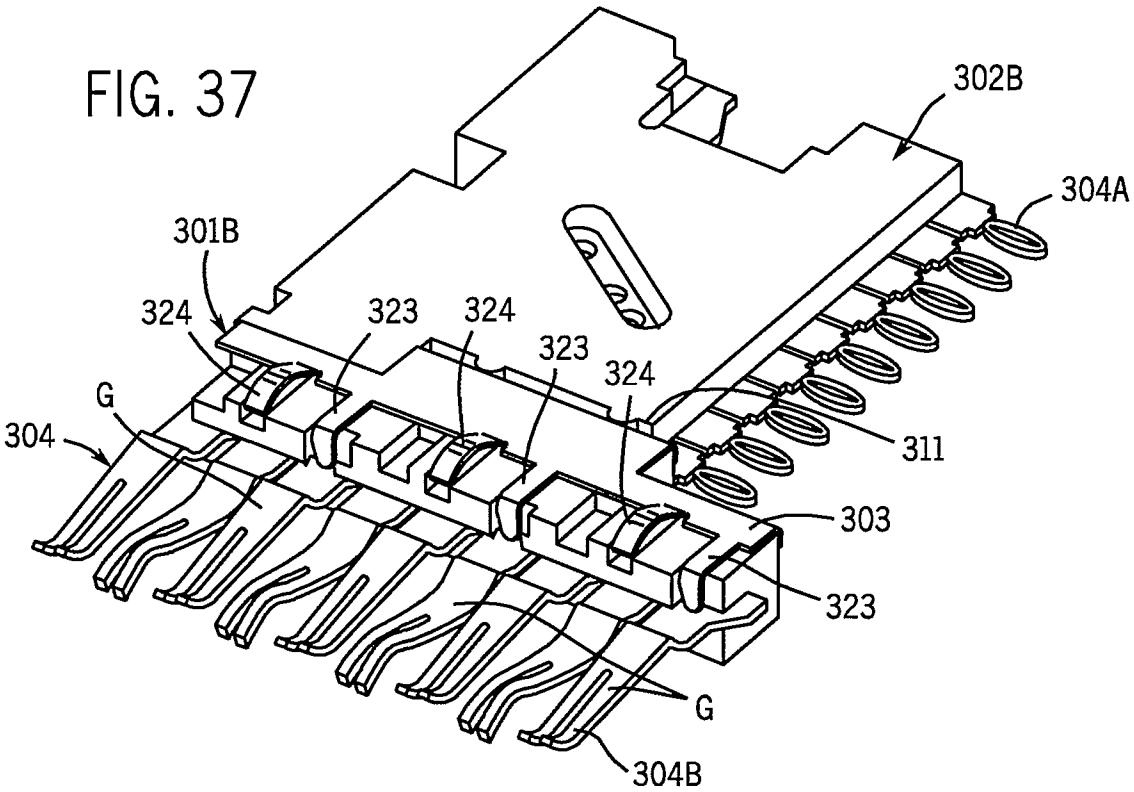
FIG. 37 is a perspective view of the second connector module illustrated in FIGS. 34A-B connected to the second ground shorting bar illustrated in FIG. 35B.
Figure 38:
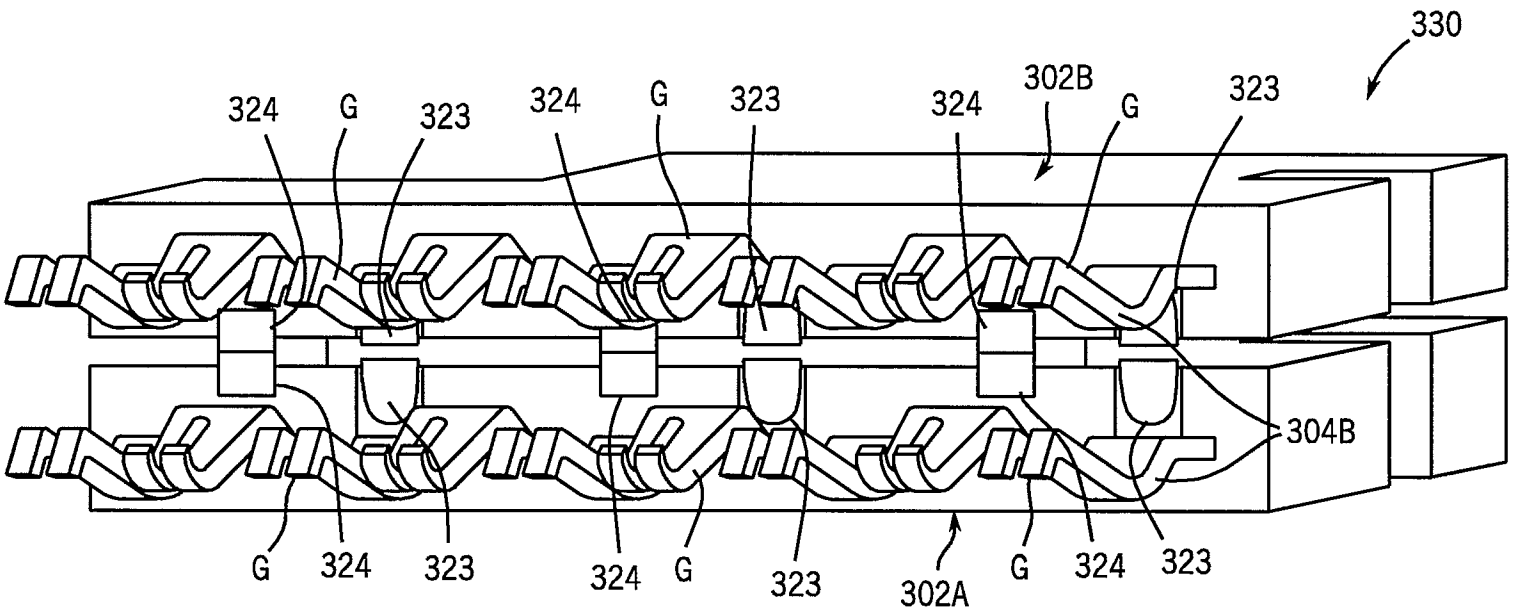
FIG. 38 is a perspective view of a connector module assembly including the connector modules illustrated in FIGS. 33-34 connected to the segments of the ground shorting bar illustrated in FIGS. 35A-B.

Referring now to FIGS. 36-38, the first ground shorting bar 301A is installed in the first connector module 302A by inserting the flange 320 of the ground shorting bar 301A into the slot 311 of the connector module 302A. The connector module 302A can include one or more retention ribs 313 that narrow the slot opening, and thus bias the flange 320 against the housing 303 to assist in retaining the flange 320 in the slot 311.

When the ground shorting bar 301A is installed in the connector modules 302A, each leg of the first plurality of legs 322A is disposed in the corresponding first notches 306, such that the second portion 323B of the first legs 322A contact the ground contacts G of the first connector module 302A. In this regard, it should be appreciated that the first portion 323A of the first legs 322A extends beyond the forward edge of the connector housing 303. Each of the second plurality of legs 322B is disposed in the corresponding second notches 308, and extends vertically above the connector housing 303.

When the second ground shorting bar 301B is installed in the second connector module 302B, the connector modules 302A and 302B can be mated by positioning the first surface 303A of the first connector module 302A to face the second surface 303B of the second connector module 302B. The connector modules 302A and 302B can then be brought towards each other until the curved beams 324 of the first connector module 302A contact the complementary curved beams 324 of the second connector module 302B when the connector modules 302A and 302B are mated. The first legs 324 of the first and second ground shorting bars 301A and 301B are aligned when mounted onto the connector modules 302A and 302B, and are thus configured to electrically connect to aligned ground contacts (G) of the connector modules. The connector modules 302A and 302B thus mate to forming a connector module assembly 330 that can form part of an electrical connector, for instance as described above with respect to the connector 198, that can be integrated into a connector assembly. Thus, the ground coupling assembly 300 can place the ground contacts of the each connector module 302A and 302B in electrical communication with each other, and in further electrical communication with the ground contacts of the other connector module 302A.

Figure 39A:
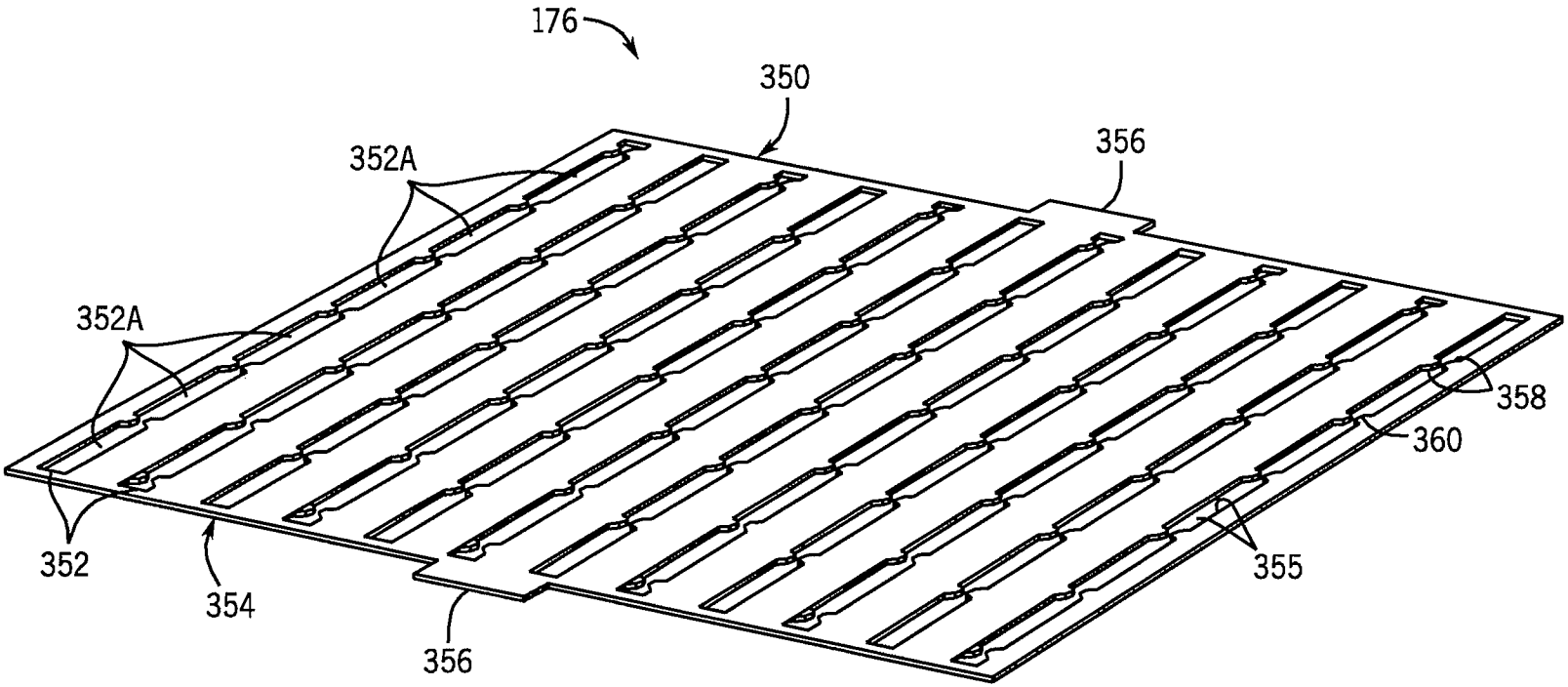
FIG. 39A is a perspective view of a ground coupling assembly including a ground shorting plate constructed in accordance with another alternative embodiment.
Figure 39B:
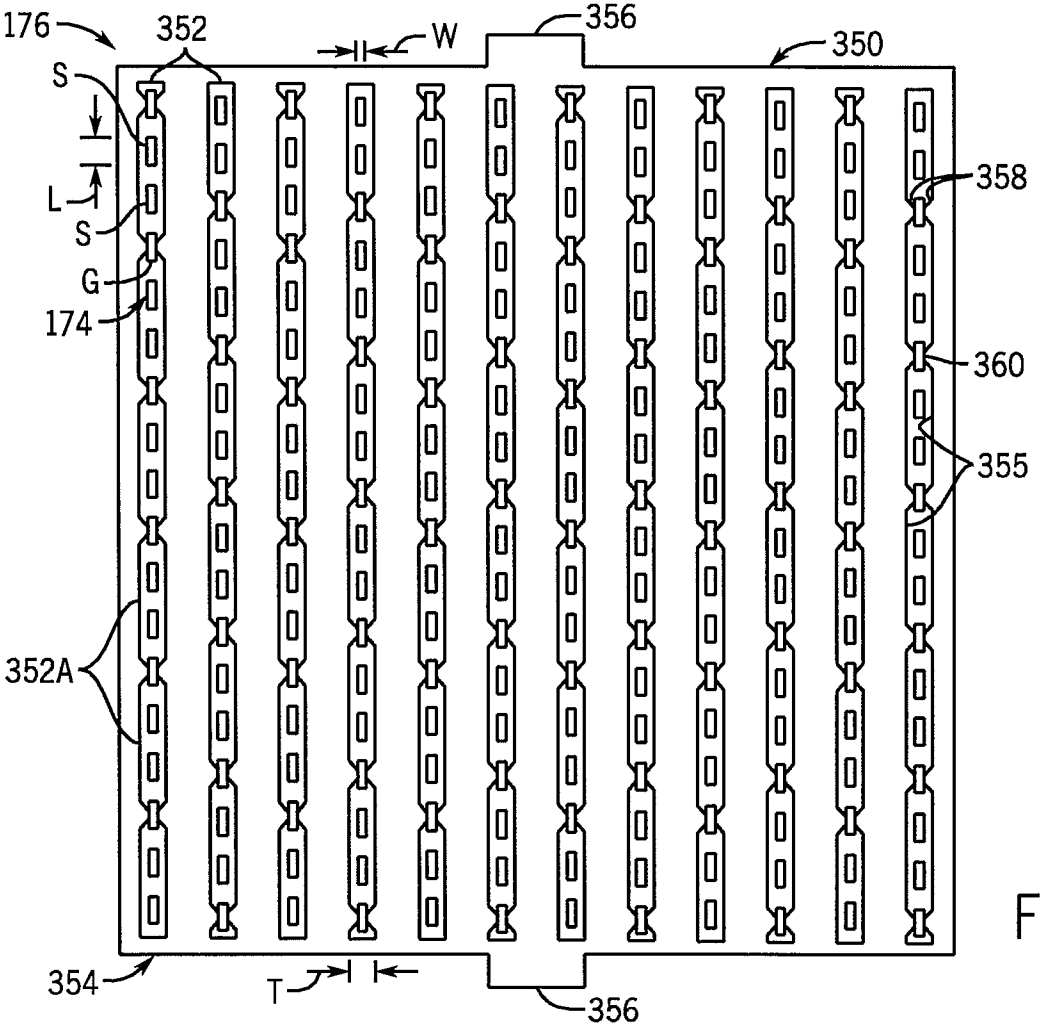
FIG. 39B is a bottom plan view of the ground shorting plate illustrated in FIG. 39A attached to a terminal end of a connector.

Referring now to FIGS. 39A and 39B, the ground coupling assembly 176 as described and illustrated with reference to 13-27C can be constructed in accordance with an alternative embodiment to include a ground shorting plate 350 that can replace the ground shorting bars 178 and 180 and inserts 184. The ground shorting plate 350 can define a plurality of slots 352 formed therein arranged in columns 354. Each slot 352 is defined by opposing edges 355 of the plate 350, has a thickness "T" that is greater than the width of the signal contacts "S" and ground contacts "G" of the electrical contacts 174. In this regard, it should be appreciated that a cross-section of the contacts 174 can be rectangular, with an elongate length "L", and a transverse width "W". The plate 350 includes a pair of locating tabs 356 extending out from the outer edges of the plate and configured to engage complementary structure in the connector, such as connector 198 illustrated in FIG. 26, that locates and/or affixes the plate 350 to the connector housing.

One or more of the slots, up to all slots, can further include opposing aligned necks 358 that extend in from each side edge 355. The necks 358 define a necked gap 360 therebetween that has a thickness substantially equal or slightly less than the width "W" of the ground contacts "G," which can be equal to the width of the signal contacts "S," such that when the ground contacts G are disposed in their associated necked gaps 360, the ground contacts "G" contact each of the opposing necks 358.

The slots 352 further define slot sections 352A that are disposed adjacent one or more necked gaps 360. The slot sections 352A have the thickness "T," as defined by the distance between opposing side edges 355 of a given slot 352 along a direction perpendicular to the side edges 355, that is greater than the width "W" of the contacts 174. Accordingly, when the plate 350 is installed onto the mating end or mounting end of the connector housing, the contacts 174 of a given connector module 170, such as an IMLA, are disposed in a common slot 352, such that the ground contacts "G" are at least partially disposed in the necked gap 360, while the signal contacts "S" are disposed in the slots 352 at slot sections 352A, at locations between the opposing side edges 355 such that the signal contacts "S" do not contact the plate 350.

When the plate 350 is mounted onto a mating end or mounting end of the connector housing, such as the front housing 194 or the rear organizer housing 196, the contacts 174 of each connector module 170 are inserted into a corresponding slot 352. Thus, the number of columns 354 can be equal to the number of connector modules 170 of the connector 198. Thus, the plate 350 can electrically connect the ground contacts "G" of a plurality of adjacent connector modules 170 arranged in columns. The plate 350 is elongate in a direction perpendicular with respect to the direction of elongation of the contacts 174 with respect to the location of the contacts 174 that contacts the plate 350. For instance, when the plate 350 is installed onto the mating end of the connector 198, the plate 350 is oriented such that the plate is elongate in a direction perpendicular to the mating ends of the contacts 174. When the plate 350 is installed onto the mounting end of the connector 198, the plate 350 is oriented such that the plate is elongate in a direction perpendicular to the mounting ends of the contacts 174. The plate 350 can have a thickness less than 1 mm, such as between 0.2 and 0.5 mm, for instance 0.2 mm or 0.35 mm.

It should be appreciated that the necked gaps 360 can be spaced as desired, and as illustrated are spaced to receive contacts 174 arranged in a repeating S-S-G pattern such that each ground contact "G" is disposed in a necked gap 360. It should be appreciated that the number of necked gaps 360 in a given slot 352 can be decreased so as to cause the plate 350 to contact a select number of ground contacts of a given connector module 170 that is less than all of the ground contacts. Furthermore, the necked gaps 360 can be spaced to receive ground contacts "G" of contacts 174 that are arranged in a different pattern than a repeating S-S-G pattern. The plate 350 can be positioned at the mating end and/or the mounting end of the connector housing.

It should be noted that the illustrations and discussions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should be further appreciated that the various alternative embodiments described above with respect to one illustrated embodiment can apply to all embodiments as described herein, unless otherwise indicated.

The invention claimed is:

1. An electrical connector comprising:

a housing that retains a plurality of electrical contacts, wherein the electrical contacts include a plurality of signal contacts arranged in differential signal pairs, and a plurality of ground contacts, such that each of the signal contacts includes a lead portion, a mating portion at one end of the lead portion, and a mounting portion at another end of the lead portion and each of the ground contacts includes a lead portion, a mating portion at one end of the lead portion, and a mounting portion at another end of the lead portion, wherein adjacent differential signal pairs are separated by a ground contact along a lateral direction, an entirety of the lead portion of the ground contact that separates the adjacent differential signal pairs is aligned with the lead portion of each signal contact of the adjacent differential signal pairs along the lateral direction, and the lead portions of the signal contacts of the adjacent differential signal pairs are aligned with each other along the lateral direction; and a shieldless ground coupling assembly that places at least a plurality of the ground contacts in electrical communication with each other.

2. The electrical connector as recited in claim 1, wherein the electrical connector comprises one differential signal pair carried by a first connector module and a second differential pair carried by a second connector module, wherein the electrical connector is devoid of metallic shielding plates between the first connector module and the second connector module.

3. The electrical connector as recited in claim 1, wherein the shieldless ground coupling assembly is not electrically connected to any of the signal contacts.

4. The electrical connector as recited in claim 1, wherein first and second ones of the signal contacts form a differential signal pair, and first and second ones of the ground contacts are disposed on opposing sides of the differential signal pair formed by the first and second ones of the signal contacts.

5. The electrical connector as recited in claim 1, wherein the shieldless ground coupling assembly shifts a resonance frequency of the electrical connector to a higher value.

6. The electrical connector as recited in claim 1, wherein the electrical connector is devoid of metallic shielding plates.

7. The electrical connector as recited in claim 1, wherein the shieldless ground coupling assembly comprises a conductive ground shorting bar connected to the first and second ground contacts.

8. The electrical connector as recited in claim 7, wherein the ground shorting bar comprises a plate and legs connected to respective ones of the ground contacts.

9. The electrical connector as recited in claim 7, wherein the ground shorting bar comprises a plate directly connected to the ground contacts.

10. The electrical connector as recited in claim 7, wherein the shieldless ground coupling assembly further comprising a second ground shorting bar configured to contact a second plurality of ground contacts carried by a second electrical connector.

11. An electrical connector comprising:

a first connector module comprising a first module housing that retains a plurality of electrical contacts including a plurality of ground contacts and a plurality of signal contacts that define at least one differential signal pair;

a second connector module comprising a second module housing that retains a plurality of electrical contacts including a plurality of ground contacts and a plurality of signal contacts; and a non-shielding ground shorting bar that electrically connects at least one of the ground contacts of the first connector module to at least one of the ground contacts of the second connector module, wherein the electrical connector is devoid of metallic shielding plates disposed between the first and second connector modules.

12. The electrical connector as recited in claim 11 wherein the ground contacts of the first connector module are aligned with the ground contacts of the second connector module.

13. The electrical connector as recited in claim 11, wherein the ground contacts of the first connector module are offset with respect to the ground contacts of the second connector module.

14. The electrical connector as recited in claim 11, wherein the electrical contacts of the first and second connector modules are right-angle electrical contacts.

15. The electrical connector as recited in claim 11, wherein the non-shielding ground shorting bar includes a plate that is electrically connected to at least a plurality of the ground contacts of the first connector module, and further electrically connected to at least a plurality of the ground contacts of the second connector module.

16. The electrical connector as recited in claim 15, wherein the non-shielding ground shorting bar further comprises a first plurality of legs extending from the plate and connected to the at least a plurality of the ground contacts of the first connector module, and a second plurality of legs extending from the plate and connected to the at least a plurality of the ground contacts of the second connector module.

17. The electrical connector as recited in claim 11, wherein 1) the first non-shielding ground shorting bar comprises a plate, a first plurality of legs extending from the plate and connected to at least a plurality of the ground contacts of the first connector module, and a second plurality of legs, and 2) the second non-shielding ground shorting bar comprises a plate, a first plurality of legs extending from the plate and connected to at least a plurality of the ground contacts of the second connector module, and a second plurality of legs, wherein the second plurality of legs of the first non-shielding ground shorting bar is electrically connected to the second plurality of legs of the second non-shielding ground shorting bar.

18. The electrical connector as recited in claim 17, wherein the first plurality of legs of the first non-shielding ground shorting bar is aligned with the first plurality of legs of the second non-shielding ground shorting bar.

19. A kit comprising:

a first housing and a second housing, each housing supporting a plurality of signal contacts and ground contacts, each signal contact defining a signal mating portion and an opposed signal mounting portion, and each ground contact defining a signal mating portion and an opposed signal mounting portion; and a first non-shielding ground coupling assembly that is electrically connected to at least two of the ground contacts of the first housing, and a second non-shielding ground coupling assembly that is electrically connected to at least two of the ground contacts of the second housing, wherein the first non-shielding ground coupling assembly has a different configuration than the second non-shielding ground coupling assembly, and the different configuration causes the signal contacts retained in the first housing to achieve at least one differing desired performance characteristic with respect to the signal contacts retained in the second housing.

20. The kit as recited in claim 19, wherein the different configuration comprises a geometric configuration.

21. The kit as recited in claim 19, wherein the different configuration comprises a location of the ground contacts to which the ground coupling assembly is connected.

22. A first electrical connector configured to mate with a second electrical connector at a mating interface of the first electrical connector, the first electrical connector comprising:

a first insulative housing that carries signal contacts arranged in differential signal pairs and ground contacts disposed between adjacent ones of the differential signal pairs, each of the signal contacts and the ground contacts defining a respective mating portion configured to mate with complementary electrical contacts of the second electrical connector, and a respective mounting portion configured to electrically connect to a substrate, the first insulating housing further carrying a non-shielding ground shorting bar electrically connected to at least a plurality of the ground contacts at the mating portions of the plurality of ground contacts so as to shift a resonance frequency to a higher value as compared to a second electrical connector that is otherwise identical to the electrical connector except that the second electrical connector does not include the non-shielding ground shorting bar electrically connected to any of its ground contacts.

23. An electrical connector comprising:

a housing that retains a plurality of electrical contacts, wherein the electrical contacts includes a plurality of signal contacts that define a plurality of differential signal pairs, and a plurality of ground contacts disposed between respective differential signal pairs, each of the signal contacts and ground contacts defining a respective mating end configured to mate with complementary contacts of a second electrical connector, and a respective mounting end configured to electrically connect to a substrate;

a connector module including a connector module housing that supports one of the plurality of differential signal pairs; and a non-shielding ground shorting bar in electrical contact with at least a corresponding first and second ground contacts of the plurality of ground contacts so as to establish an electrical path from the first ground contact to the second ground contact when the ground contacts are not mounted to the substrate, wherein the electrical connector is devoid of metallic shielding plates along the electrical path.

24. The electrical connector as recite in claim 23, wherein the electrical path is also established when the ground contacts are mounted to the substrate.

25. The electrical connector as recited in claim 23, wherein the non-shielding ground shorting bar further comprises an electrically conductive plate, wherein the electrically conductive legs extend from the plate.

26. The electrical connector as recited in claim 25, wherein the electrically conductive plate is planar.

27. The electrical connector as recited in claim 25, wherein the electrically conductive legs are coplanar with the electrically conductive plate.

28. An electrical connector comprising:

a first connector module comprising a first module housing that retains a plurality of electrical contacts including a plurality of ground contacts and a plurality of signal contacts;

a second connector module comprising a second module housing that retains a plurality of electrical contacts including a plurality of ground contacts and a plurality of signal contacts;

a first non-shielding ground shorting bar that is electrically connected to at least a plurality of the ground contacts of the first connector module; and a second non-shielding ground shorting bar electrically connected to at least a plurality of the ground contacts of the second connector module, such that the first and second non-shielding ground shorting bars are electrically connected to each other.

29. The electrical connector as recited in claim 28, wherein the first non-shielding ground shorting bar is further electrically connected to at least one of the ground contacts of the second connector module.

30. An electrical connector comprising:

a housing that retains a plurality of electrical contacts, wherein the electrical contacts include a plurality of signal contacts arranged in pairs, and a plurality of ground contacts, such that adjacent pairs of signal contacts are separated by a ground contact; and a shieldless ground coupling assembly that places at least a plurality of the ground contacts in electrical communication with each other, wherein the electrical connector comprises one differential signal pair carried by a first connector module and a second differential signal pair carried by a second connector module, and the electrical connector is devoid of metallic shielding plates between the first connector module and the second connector module.

31. The electrical connector as recited in claim 30, wherein the shieldless ground coupling assembly is not electrically connected to any of the signal contacts.

32. The electrical connector as recited in claim 30, wherein first and second ones of the signal contacts form a differential signal pair, and first and second ones of the ground contacts are disposed on opposing sides of the differential signal pair formed by the first and second ones of the signal contacts.

33. The electrical connector as recited in claim 30, wherein the shieldless ground coupling assembly shifts a resonance frequency of the electrical connector to a higher value.

34. The electrical connector as recited in claim 30, wherein the shieldless ground coupling assembly comprises a conductive ground shorting bar connected to the first and second ground contacts.

35. The electrical connector as recited in claim 34, wherein the ground shorting bar comprises a plate and legs connected to respective ones of the ground contacts.

36. The electrical connector as recited in claim 34, wherein the ground shorting bar comprises a plate directly connected to the ground contacts.

37. The electrical connector as recited in claim 34, wherein the shieldless ground coupling assembly further comprising a second ground shorting bar configured to contact a second plurality of ground contacts carried by a second electrical connector.

38. A kit comprising:

a first housing and a second housing, each housing supporting a plurality of signal contacts and ground contacts; and a non-shielding ground coupling assembly that is electrically connected to at least two ground contacts, wherein the non-shielding ground coupling assembly has a different configuration in the first housing than in the second housing, and the different configuration causes the signal contacts retained in the first housing to achieve at least one differing desired performance characteristic with respect to the signal contacts retained in the second housing, wherein at least one of the first and second housings defines a connector module that includes a connector module housing and respective ones of the plurality of signal contacts that are supported by the connector module housing and define a differential signal pair.

* * * * *